US006246385B1

(12) United States Patent
Kinoshita et al.

(10) Patent No.: US 6,246,385 B1
(45) Date of Patent: Jun. 12, 2001

(54) LIQUID CRYSTAL DISPLAY DEVICE AND ITS DRIVING METHOD

(75) Inventors: Hiroshi Kinoshita; Toshihiko Kamizono, both of Kanazawa (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/066,841

(22) Filed: Apr. 28, 1998

(30) Foreign Application Priority Data

Apr. 28, 1997 (JP) ..... 9-110705

(51) Int. Cl.[7] ..... G09G 3/36; G09G 5/00
(52) U.S. Cl. ..... 345/87; 345/100; 345/204
(58) Field of Search ..... 345/94, 98, 99, 345/100, 103, 204, 208

(56) References Cited

U.S. PATENT DOCUMENTS

| | | | | |
|---|---|---|---|---|
| 4,779,085 | * | 10/1988 | Mizutome et al. | 345/103 |
| 4,823,176 | | 4/1989 | Nagata et al. | 340/825.79 |
| 4,830,466 | * | 5/1989 | Matsuhashi et al. | 345/103 |
| 4,982,183 | * | 1/1991 | Flegal et al. | 345/103 |
| 5,034,736 | * | 7/1991 | Bennett et al. | 345/100 |
| 5,365,284 | * | 11/1994 | Matsumoto et al. | 345/100 |
| 5,844,539 | * | 12/1998 | Kitagawa | 345/100 |
| 5,850,204 | * | 12/1998 | Maekawa | 345/100 |
| 5,907,314 | * | 5/1999 | Negishi et al. | 345/103 |
| 6,023,260 | * | 2/2000 | Higashi et al. | 345/100 |

FOREIGN PATENT DOCUMENTS

| | | |
|---|---|---|
| 0 216 188 A2 | 4/1987 | (EP) . |
| 0 216 188 A3 | 4/1987 | (EP) . |
| 0 344 323 A1 | 12/1989 | (EP) . |
| 0 424 030 A2 | 4/1991 | (EP) . |
| 0 424 030 A3 | 4/1991 | (EP) . |
| 0 500 354 A2 | 8/1992 | (EP) . |
| 2 543 341 A1 | 9/1984 | (FR) . |
| 2-216120 | 8/1990 | (JP) . |
| 4-9816 | 1/1992 | (JP) . |
| 4-292087 | 10/1992 | (JP) . |
| 5-61432 | 3/1993 | (JP) . |

* cited by examiner

*Primary Examiner*—Bipin Shalwala
*Assistant Examiner*—David L. Lewis
(74) *Attorney, Agent, or Firm*—Parkhurst & Wendel, L.L.P.

(57) ABSTRACT

To eliminate display unevenness caused by lateral luminance error or longitudinal luminance error or crosstalk in image display on liquid crystal panel by using a low-cost drive circuit, relating to a liquid crystal panel 14 having 2N scanning lines (12) arranged in the horizontal direction, and M signal lines (10, 11) disposed in the vertical direction, in which the scanning lines (12) are driven simultaneously at both ends by using scanning line left drive circuit (17A) and scanning line right drive circuit (17B). Drive pulses are sequentially applied to the scanning lines (12) at addresses X1 to X2N to turn on the individual scanning lines (12). Necessary voltage pulses are simultaneously applied to the signal lines (10, 11) at addresses Y1 to YM to control each pixel. As compared with the conventional method of one-end driving, the luminance error is reduced to ¼, and it is effective for enhancing the picture quality, especially in large-sized liquid crystal panels.

39 Claims, 47 Drawing Sheets

OUTPUTS X1, XN+1 OF SCANNING LINE DRIVE CIRCUITS 17A, 17B

OUTPUTS X2, XN+2 OF SCANNING LINE DRIVE CIRCUITS 17A, 17B

OUTPUTS XN, X2N OF SCANNING LINE DRIVE CIRCUITS 17A, 17B

OUTPUT X1 OF SCANNING LINE DRIVE CIRCUITS 17A, 17B

OUTPUT X2 OF SCANNING LINE DRIVE CIRCUITS 17A, 17B

OUTPUT X2N OF SCANNING LINE DRIVE CIRCUITS 17A, 17B

OUTPUT X1 OF SCANNING LINE DRIVE CIRCUITS 17A, 17B

OUTPUT X2 OF SCANNING LINE DRIVE CIRCUITS 17A, 17B

OUTPUT X2N OF SCANNING LINE DRIVE CIRCUITS 17A, 17B

OUTPUT OF SIGNAL LINE DRIVE CIRCUIT (Y1 ~ YM)

OUTPUT OF SCANNING LINE DRIVE CIRCUIT (Xn)

VOLTAGE APPLIED TO PIXEL AT DRIVE END (XN, Y1)

VOLTAGE APPLIED TO PIXEL AT TERMINAL END (XN, YM)

LIQUID CRYSTAL DISPLAY DEVICE AND ITS DRIVING METHOD

TECHNICAL FIELD OF THE INVENTION

The present invention relates to a liquid crystal display device useful as a display for video appliance, computer or other information equipment, and more particularly to a liquid crystal display device and liquid crystal driving method for driving so as to minimize luminance unevenness of each pixel.

BACKGROUND OF THE INVENTION

FIG. 49 is a block diagram of a conventional liquid crystal display device showing an equivalent circuit of a liquid crystal panel and a drive circuit for driving this liquid crystal panel. This liquid crystal display device comprises a liquid crystal panel 14, an upper signal line drive circuit 15, a lower signal line drive circuit 16, a scanning line drive circuit 17, a control circuit 18, and a drive power source circuit 19.

The liquid crystal panel 14 has plural signal lines provided in the y-direction (vertical direction) and plural scanning lines provided in the x-direction (horizontal direction). The signal line is composed of upper signal line 10 and lower signal line 11 divided equally in the vertical direction, and the number of upper and lower signal lines 10, 11 is M each. The number of scanning lines 12 is 2N. The addresses of the upper and lower signal lines 10, 11 are supposed to be Y1 to YM, the addresses of the upper half scanning line 12 to be X1 to XN, and the addresses,of the lower half scanning line 12 to be XN+1 to X2N.

In the liquid crystal panel 14 of such simple matrix type, the upper signal lines 10, lower signal lines 11, and scanning lines 12 are arranged in a matrix, and a pixel 13 is formed each at the intersection of upper signal line 10 and scanning line 12, and the intersection of lower signal line 11 and scanning line 12. The pixel 13 has a liquid crystal cell and a transparent pixel electrode, or a driving terminal including liquid crystal cell and transparent pixel electrode, and its capacitance is determined by the liquid crystal cell and pixel electrode. Herein, the capacitance of the pixel 13 is called the pixel capacitance. Incidentally, in the case of a TFT type liquid crystal panel, for example, the pixel includes TFT, liquid crystal cell and others.

This liquid crystal panel 14 is driven as being divided into upper and lower halves. That is, the upper signal line 10 is driven by an upper signal line drive circuit 15, and the lower signal line 11 by a lower signal line drive circuit 16. The scanning line 12 is driven from one end side of the scanning line 12 by one scanning line drive circuit 17.

The liquid crystal panel 14 shown in FIG. 49 is driven from the left end of the scanning line 12, and such driving method of driving each pixel 13 by applying a driving voltage to the scanning line 12 from one end is called the scanning line one-end drive. The upper signal line drive circuit 15 and lower signal line drive circuit 16 are disposed around the liquid crystal panel 14 depending on the number of upper signal lines 10 and lower signal lines 11 and the number of scanning lines 12.

The control circuit 18 is a control circuit for controlling the upper signal line drive circuit 15, lower signal line drive circuit 16, and scanning line drive circuit 17 on the basis of an input image signal. The drive power source circuit 19 is a circuit for supplying a driving voltage to the upper signal line drive circuit 15, lower signal line drive circuit 16, and scanning line drive circuit 17. Herein, there are five driving voltages, V(+), V(−), VH, Vref, and VL, and the pixels 13 are driven by the combination thereof.

The scanning line drive circuit 17, for upper and lower divided driving of signal lines, scans parallel the scanning lines 12 of addresses X1 to XN and scanning lines 12 of addresses XN+1 to X2N. That is, the scanning line drive circuit 17 starts scanning simultaneously from the scanning lines 12 of addresses X1 and XN+1, and continues to scan sequentially at the same timing from address X1 to XN, and from address XN+1 to X2N.

As shown in FIG. 50, the scanning line drive circuit 17 scans the scanning lines 12 sequentially from address X1 to X2N, applies a driving voltage of V(+) or V(−) to a selected scanning line 12, and applies a operation reference voltage Vref to non-selected scanning lines 12. The upper signal line drive circuit 15 and lower signal line drive circuit 16 drive the signal lines 10, 11 at signal line driving voltages VH, VL which are first scanning pulses, depending on the control signal of the control circuit 18. Output sections of upper signal line drive circuit 15 and lower signal line drive circuit 16 are composed of two analog switches for selecting and issuing one out of two values (VH, VL). The relation of driving voltages V(+), V(−), VH, VL, and Vref should satisfy the following formula (1).

$$VH-Vref=Vref-VL \quad V=V(+)-Vref=Vref-V(-) \tag{1}$$

where V is the amplitude of the scanning line driving voltage applied to the liquid crystal cell of each pixel 13.

The upper signal line drive circuit 15 in FIG. 49 issues a signal line driving voltage of either VH or VL to M upper signal lines 10 simultaneously in every horizontal scanning, corresponding to the scanning lines from address X1 to XN. The lower signal line drive circuit 16 issues a signal line driving voltage of either VH or VL to M lower signal lines 11 simultaneously in every horizontal scanning, corresponding to the scanning lines from address XN+1 to X2N. The scanning line drive circuit 17 selects the scanning line 12 sequentially in every horizontal scanning, and issues a scanning line driving voltage V(+) or V(−), which is a second scanning pulse, to the selected scanning line 12 from the left side end, and issues an operation reference voltage Vref to the non-selected scanning lines 12. Therefore, the output section of the scanning line drive circuit 17 is composed of three analog switches for selecting and issuing one out of three values, V(+), V(−), and Vref. The output resistance of these three analog switches (also called ON resistance) is named Ro.

In this way, the liquid crystal panel 14 is driven sequentially. As shown in FIG. 49, if the liquid crystal panel 14 is composed of upper and lower screens, the two screens are scanned simultaneously. Accordingly, the output ends of the upper signal line drive circuit 14 and lower signal line drive circuit 15 are provided by the same number.

In such conventional liquid crystal display device of one-end driving of scanning lines, a delay occurs in the driving voltage of each pixel due to presence of wiring resistance r of scanning line 12 and pixel capacitance c. Accordingly, the effective voltage differs slightly in each pixel from the driving end to terminal end of scanning line 12, and therefore the brightness of each pixel varies slightly from the driving end to terminal end of scanning line 12. Such luminance unevenness is called a lateral luminance error. Moreover, crosstalk occurs due to distortion of driving voltage of pixels. This is called lateral crosstalk. Similarly, in driving of signal lines, a delay occurs due to wiring resistance of signal line and pixel capacitance, and the brightness of each pixel differs slightly from the driving end to terminal end of signal line, which is a longitudinal luminance error, and crosstalk is caused due to distortion of waveform by signal line driving. It is called longitudinal crosstalk.

Such lateral or longitudinal luminance error or crosstalk become larger as the liquid crystal display device has a wider screen, which was a serious cause of deterioration of picture quality. For development of driving method capable of eliminating the lateral or longitudinal luminance error and crosstalk, drive analysis including the structure of liquid crystal panel and drive circuit is indispensable. However, as for lateral or longitudinal luminance error, crosstalk, or delay time of driving current and driving voltage of scanning line or signal line, results of calculation and measured values did not coincide in the conventional drive analysis method. Further, it requires much time and cost for development of optimum driving method and optimum drive circuit.

The above problems are described in detail below. Herein, problems are analyzed by referring to an example of lateral luminance error and scanning line driving current in the liquid crystal panel 14 of simple matrix type. FIG. 50(A) is an output waveform diagram of upper signal line drive circuit 15 and lower signal line drive circuit 16 satisfying the relation of formula (1). FIG. 50(B) is an output waveform diagram of scanning line drive circuit 17. FIGS. 50(C), (D) are voltage waveform diagrams applied to the pixels 13 located at the driving end and terminal end, respectively. In the diagrams, TH refers to the horizontal scanning time, TV is the vertical scanning time, and N is ½ of total number of scanning lines.

Point (XN, Y1) denotes the pixel 13 at the intersection of the XN-th scanning line 12 and Y1-th signal lines 10, 11, and (XN, YM) is the pixel 13 at the intersection of the XN-th scanning line 12 and YM-th signal lines 10, 11. The pixel 13 at (XN, Y1) in FIG. 50(C) is at the driving end of the scanning line drive circuit 17, and the pixel 13 at (XN, YM) in FIG. 50(D) is at the terminal end of the scanning line drive circuit 17. Thus, the voltage applied to the pixels 13 differs between the driving end and the terminal end of the scanning line 12. The driving end is driven by an ideal waveform (a combined rectangular waveform), but at the terminal end of the scanning line 12, as shown in FIG. 50(D), a delay occurs, and the waveform is distorted at the rising edge of the rectangular waveform.

The fall time of the scanning line driving voltage is identical throughout the driving end to the terminal end in a same scanning line because the signal lines Y1 to YM are simultaneously driven by the upper and lower signal line drive circuits 15, 16, and is hence not related to occurrence of lateral luminance error. Signal line driving voltages VH, VL have a same delay time throughout the driving end to the terminal end in a same scanning line 12, and are hence not related to occurrence of lateral luminance error. Accordingly, in FIGS. 50(C) and (D), regarding the fall time of scanning line driving voltage to be 0, the signal line driving voltages VH, VL may be estimated to be ideal pulse waveforms. Moreover, if there is any change in the pixel capacitance due to driving voltage, it is not related to occurrence of lateral luminance error. Also change in pixel capacitance can be corrected later, and is hence assumed to be constant.

An equivalent circuit of the liquid crystal panel. 14 is shown in FIG. 2. Herein, the wiring resistance per pixel of upper signal line 10 and lower signal line 11 is supposed to be rs, the wiring resistance per pixel of scanning line 12 to be r, and the pixel capacitance of the pixel 13 linked to the scanning line 12 to be c. In the liquid crystal panel 14, 2(N−1) scanning lines other than the scanning line 12 selected by the scanning line drive circuit 17 are driven at operation reference voltage Vref, and the upper signal line 10 and lower signal line 11 are driven at operation reference voltage Vref or signal line driving voltage VH or VL. Accordingly, the driving end of 2(N−1) scanning lines 12, and the driving end of upper signal line 10 and lower signal line 11 are at the potential of Vref in average. Therefore, as electrical characteristics, the potential of one side of each pixel capacitance c is regarded to be Vref. Hence, as shown in FIG. 51 (A), one scanning line 12 is expressed by a distributed parameter circuit composed of wiring resistance r and pixel capacitance c (formed at intersections of addresses Y1 to YM). FIG. 51(A) shows a circuit in which M wiring resistances r and M pixel capacitance c are connected in ladder form. (Supposing the wiring resistance of signal line to be rs and the pixel capacitance linked to the signal line to be cs, one signal line is also expressed by a distributed parameter circuit, same as in FIG. 51(A), composed of N wiring resistances rs and N pixel capacitance cs.)

In the prior art, the liquid crystal panel was driven and analyzed by the equivalent circuit shown in FIG. 51(B). In this equivalent circuit, supposing the sum M·r of the scanning lines 12 to be RL and the sum M·c of the pixel capacitance c to be CL, the scanning lines 12 are expressed by a series circuit composed of resistance RL and pixel capacitance CL. FIG. 51(B) shows a circuit for driving the scanning lines 12 at voltage V, supposing the output resistance of the scanning line drive circuit 17 to be Ro and the analog switch built in the scanning line drive circuit 17 to be SW. In this equivalent circuit, the terminal end voltage of the scanning line 12 is expressed as terminal voltage Vcm of a capacitor having a capacitance value of CL. Supposing SW to be ON when t=0, and, Ro=0, Vcm is given in formula (2).

$$Vcm=V[1-\exp\{-t/(RL\cdot CL)\}]RL=M\cdot r;\ CL=M\cdot c \quad (2)$$

In scanning line one-end driving, the effective voltage of the pixel capacitance c differs between the driving end and terminal end. Accordingly, the transmittance of liquid crystal cell differs in the lateral direction, and a lateral luminance error occurs in the screen of the liquid crystal display device. Due to this lateral luminance error, display unevenness of screen appears, and the picture quality deteriorates. The lateral luminance error is more obvious when the display screen is larger, and it has no practical problem in a liquid crystal display device of, for example, 12.1 inches in the diagonal length, but display unevenness is visually recognized in a 17-inch liquid crystal display device.

Supposing the driving waveform of the signal line drive circuit shown in FIG. 50(A) to be fs, and the driving waveform of the scanning line drive circuit shown in (B) to be fc, the driving waveform of the pixel 13 at the driving end shown in (C) is (fc+fs). The effective voltage Ve of the driving waveform (fc+fs) is obtained by integrating the value of $(fc+fs)^2dt$ over one period TV, dividing the integral value by the period, and extracting the square root of the obtained quotient. The effective value Vecl of the pixel voltage at the driving end of the scanning line 12 is obtained by formula (3).

Where, $$Vecl=[(V+V/a)^2/N+(N-1)(V/a)^2/N]^{(1/2)}$$

V: amplitude of scanning line driving voltage

N: ½ of total number of scanning lines a: ratio of amplitude of scanning line driving voltage (V=V(+)−Vref) and amplitude of signal line driving voltage (VH−Vref)

$$V=a(VH-Vref) \quad (3)$$

In formula (3), V denotes the scanning line driving voltage, and (V/a) refers to the signal line driving voltage, and therefore, supposing the signal line driving voltage to be an ideal pulse, to determine the effect of delay of the scanning line driving voltage at the terminal end, V in formula (3) must be replaced by Vcm in formula (2), but the calculation is complicated, and therefore it is approximated as follows:

$$\int (Vcm+V/a)^2 \cdot dt \approx (1+1/a)^2 \int (Vcm)^2 \cdot dt$$

Then, to determine the effective voltage Vecm of pixel at terminal end of the scanning line 12, the term of $(V+V/a)^2/N$ in formula (3) may be replaced by $$\{(V+V/a)^2/TV\} \cdot \int [1-\exp\{-t/RL \cdot CL\}]^2 \cdot dt$$

The integration is performed in the horizontal scanning period TH. Since the liquid crystal display device is designed to satisfy TV=N·TH, and TH>>CL·RL, the above formula is transformed into formula (4) by integrating from 0 to TH.

$$Vec = (V + V/a)^2/TV \int_0^{TH} [1 - \exp\{-t/RL \cdot CL)]^2 dt \approx \{(V + V/a)^2/N\} \cdot [1 - 1.5RL \cdot CL/TH] \quad (4)$$

Therefore, the effective voltage Vecl at driving end of the scanning line 12 and effective voltage Vecm at terminal end are expressed as shown in formula (5).

$$Vecl = [(V+V/a)^2/N + \{(N-1)(V/a)^2/N\}]^{(1/2)} Vecm = [\{V+V/a)^2/N\}\{1-1.5RL \cdot CL/TH\} + \{(N-1)(V/a)^2/N\}]^{(1/2)} \quad (5)$$

The lateral luminance error is determined by effective voltage Vecl−effective voltage Vecm. Furthermore, the ratio γ of effective voltage Vecm at terminal end and effective voltage Vecl at driving end is as expressed in formula (6).

$$\gamma = Vecm/Vecl = [\{(1 - 1.5RL \cdot CL/TH) \cdot (a+1)^2 + N - 1\}/\{(a+1)^2 + N - 1)\}]^{(1/2)}$$

From a>>1, then $$\gamma \approx [1-1.5RL \cdot CL/TH \cdot a^2/(a^2+N-1)]^{(1/2)} \quad (6)$$

The scanning line driving current I can be determined as follows. When the capacitor c is charged with v, the charge transfer by charging is v·c, and therefore supposing the number of scanning lines to be 2N, number of signal lines to be M, pixel capacitance of scanning line to be c, and vertical scanning time to be TH, formula (7) is obtained when the scanning line driving voltage is V(+) and V(−).

Drive current when driving voltage is *V*(+):

$$I(+) = (2N/TV)M \cdot c\{V(+) - VL\} = 2N \cdot M \cdot c\{V(+) - VL\}/(TV)$$

Drive current when driving voltage is *V*(−):

$$I(-) = 2N \cdot M\ c\{V(-) - VH\}/(TV) \quad (7)$$

In the liquid crystal display devices of 12.1 inches and 17 inches in the screen diagonal length of liquid crystal panel, the value of the lateral luminance error (expressed in the difference of effective voltage) calculated from formulas (5) and (6), and the value of the scanning line driving current calculated from formula (7) in the condition of VH=−VL=2.1 V are shown below (calculation 1).

(1) In 12.1-inch liquid crystal display device
Lateral luminance error=70.5 mV γ=0.975
Voltage Vecl=2.74V
Scanning line driving current I=1.42 mA (measured value=1.0 mA)
Measuring condition
TH=27.8 μS, TV=8.34 mS, c=0.26 pF
r=1.5 Ω, N=300, M=800×3, a=14.5
V=30.5V, V(+)=31.55V (2) In 17-inch liquid crystal display device
Lateral luminance error=96.2 mV
γ=0.963
Voltage Vecl=2.60V
Scanning line driving current I=1.75 mA (measured value=0.97 mA)
Measuring condition
TH=28 μS, TV=14.34 mS, c=0.19 pF
r=1.5 Ω, N=512, M=1280×3, a=15.5
V=32.5V, V(+)=33.55V In the above results, in the 12.1-inch liquid crystal display device, an effective voltage difference of 70.5 mV (lateral luminance error) is caused, whereas in the 17-inch liquid crystal display device, an effective voltage difference of 96.2 mV (lateral luminance error) is caused. Although variable with the display pattern, if the effective voltage difference of the liquid crystal is more than 10 mV, it can be distinguished by the human eye. Numerical expression of the distinguishable effective voltage difference is very difficult because the limit value differs in each display pattern and the human individual error is involved. However, the limit is generally considered to be somewhere between 10 and 15 mV, and at a double value of 20 to 30 mV, the lateral luminance error can be clearly distinguished regardless of the display pattern or human individual difference.

The above result of calculation is far more than the visually distinguishable value, and the lateral luminance error is sure to be recognized in both 12.1-inch and 17-inch liquid crystal display devices. Actually in the 12.1-inch device, if recognized visually, the error is small enough to be allowed practically. In this sense, the effective voltage difference is estimated in a range of 20 to 30 mV. In the 17-inch liquid crystal display device, there is an effect on the picture quality, and the effective voltage difference can be clearly recognized visually, and hence the effective voltage difference is estimated around 30 mV. It is not such a large value as 96 mV as in the result of calculation.

Furthermore, the calculation result of driving current of scanning line is much larger value than the measured value, and the error is significant. Similarly, the driving current of signal line can be determined, and the result of calculation is much larger than the measured value. Thus, in the equivalent circuit in FIG. 51(B), the result of calculation and measured value do not coincide, and when the number of pixels in the liquid crystal panel increases, it cannot be applied in drive analysis.

Thus, the lateral luminance error caused by delay in the scanning line driving voltage appears as display unevenness of screen, and the picture quality deteriorates. In one-end driving of scanning line 12, the lateral luminance error is not a practical problem in the 12.1-inch liquid crystal panel, but it is a serious problem in the 17-inch liquid crystal panel. Incidentally, when driving the signal line from one end, a longitudinal luminance error is caused by the delay time of the signal line driving voltage, which also results in unevenness in the screen. Development of liquid crystal display device free from lateral or longitudinal luminance error or crosstalk requires drive analysis of scanning lines and signal lines, but in the conventional method, as mentioned above, the result of drive analysis does not agree with the measured value.

SUMMARY OF THE INVENTION

The invention is devised in the light of the problems of the prior art discussed above, and hence proposes a liquid crystal display device capable of reducing the delay occurring in the driving voltage caused by the pixel capacitance and the wiring resistance of scanning lines 12 or signal lines 10, 11, in the liquid crystal panel 14. As a result, the lateral or longitudinal luminance error and crosstalk can be decreased, and the picture quality can be enhanced. Moreover, by employing the drive analysis method of higher precision, the scanning lines and signal lines can be expressed by a simple equivalent circuit, thereby realizing a liquid crystal display device and its driving method capable of realizing an optimum design of driving circuit efficiently and at low cost.

To solve the problems (described in the preceding section), an embodiment of the invention comprises:

a liquid crystal panel having plural signal lines and plural scanning lines disposed in a matrix, and disposing pixels at intersections of the signal lines and scanning lines, where the optical state of the liquid crystal cells of said pixels is changed by applying a voltage to the scanning lines and signal lines corresponding to the pixels, a signal line drive circuit for applying a first scanning pulse from each one end of the signal lines to each pixel simultaneously in every horizontal scanning, a first scanning line drive circuit for applying a second scanning pulse from each one end of the scanning lines to each pixel sequentially in every horizontal scanning, a second scanning line drive circuit for applying the second scanning pulse from each other end of the scanning lines to each pixel sequentially, and a control circuit for instructing generation of the first scanning pulse in synchronism with the second scanning pulse to the signal line drive circuit on the basis of an input image signal.

Another embodiment of the invention comprises:

a liquid crystal panel having plural signal lines and plural scanning lines disposed in a matrix, dividing the signal lines into plural upper signal lines and lower signal lines in the vertical direction, and disposing pixels at intersections of the upper and lower signal lines and scanning lines, where the optical state of the liquid crystal cells of said pixels is changed by applying a voltage to the scanning lines and signal lines corresponding to the pixels, a first signal line drive circuit for applying a first scanning pulse from one end of the upper signal lines to each pixel simultaneously in every horizontal scanning, a second signal line drive circuit for applying the first scanning pulse from one end of the lower signal line to each pixel simultaneously in every horizontal scanning, a first scanning line drive circuit for applying a second scanning pulse from each one end of the scanning lines to each pixel sequentially in every horizontal scanning, a second scanning line drive circuit for applying the second scanning pulse from each other end of the scanning lines to each pixel sequentially in every horizontal scanning, and a control circuit for instructing generation of the first scanning pulse in synchronism with the second scanning pulse to the first and second signal line drive circuits on the basis of an input image signal.

Still another embodiment of the invention comprises:

a liquid crystal panel having plural signal lines and plural scanning lines disposed in a matrix, dividing the signal lines into plural upper signal lines and lower signal lines in the vertical direction, and disposing pixels at intersections of the upper and lower signal lines and scanning lines, where the optical state of the liquid crystal cells of said pixels is changed by applying a voltage to the scanning lines and signal lines corresponding to the pixels, a first signal line drive circuit for applying a first scanning pulse from each one end of the upper signal line to each pixel simultaneously in every horizontal scanning, a second signal line drive circuit for applying the first scanning pulse from each one end of the lower signal line to each pixel simultaneously in every horizontal scanning, a scanning line drive circuit for applying a second scanning pulse from each one end of the scanning lines to each pixel sequentially in every horizontal scanning, and a control circuit for instructing generation of the first scanning pulse in synchronism with the second scanning pulse to the first and second signal line drive circuits on the basis of an input image signal.

Yet another embodiment of the invention comprises:

a liquid crystal panel having plural signal lines and plural scanning lines disposed in a matrix, and disposing pixels at intersections of the signal lines and scanning lines, where the optical state of the liquid crystal cells of said pixels is changed by applying a voltage to the scanning lines and signal lines corresponding to the pixels, a first signal line drive circuit for applying a first scanning pulse from each one end of the signal lines to each pixel simultaneously in every horizontal scanning, a second signal line drive circuit for applying the first scanning pulse from each other end of the signal lines to each pixel simultaneously in every horizontal scanning, a scanning line drive circuit for applying a second scanning pulse from each one end of the scanning lines to each pixel sequentially in every horizontal scanning, and a control circuit for instructing generation of the first scanning pulse in synchronism with the second scanning pulse to the first and second signal line drive circuits on the basis of an input image signal.

Still another embodiment of the invention comprises:

a liquid crystal panel having plural signal lines and plural scanning lines disposed in a matrix, and disposing pixels at intersections of the signal lines and scanning lines, where the optical state of the liquid crystal cells of said pixels is changed by applying a voltage to the scanning lines and signal lines corresponding to the pixels, a first signal line drive circuit for applying a first scanning pulse from each one end of the signal lines to each pixel simultaneously in every horizontal scanning, a second signal line drive circuit for applying the first scanning pulse from each other end of the signal lines to each pixel simultaneously in every horizontal scanning, a first scanning line drive circuit for applying a second scanning pulse from each one end of the scanning lines to each pixel sequentially in every horizontal scanning, a second scanning line drive circuit for applying the second scanning pulse from each other end of the scanning lines to each pixel sequentially in every horizontal scanning, and a control circuit for instructing generation of the first scanning pulse in synchronism with the second scanning pulse to the first and second signal line drive circuits on the basis of an input image signal.

Another embodiment of the invention comprises:

a liquid crystal panel having plural signal lines and plural scanning lines disposed in a matrix, dividing the scanning lines into plural left scanning line and right scanning line in the horizontal direction, and disposing pixels at intersections of the signal lines and right and left scanning lines, where the optical state of the liquid crystal cells of said pixels is changed by applying a voltage to the scanning lines and signal lines corresponding to the pixels, a signal line drive circuit for applying a first scanning pulse from each one end of the signal lines to each pixel simultaneously in every horizontal scanning, a first scanning line drive circuit for applying a second scanning pulse from each one end of the left scanning line to each pixel sequentially in every horizontal scanning, a second scanning line drive circuit for applying the second scanning pulse from each one end of the right scanning line to each pixel sequentially in every horizontal scanning, and a control circuit for instructing generation of the first scanning pulse in synchronism with the second scanning pulse to the signal line drive circuit on the basis of an input image signal.

Yet another embodiment of the invention comprises:

a liquid crystal panel having plural signal lines and plural scanning lines disposed in a matrix, dividing the scanning lines into plural left scanning lines and right scanning lines in the horizontal direction, and disposing pixels at intersections of the signal lines and right and left scanning lines, where the optical state of the liquid crystal cells of said pixels is changed by applying a voltage to the scanning lines and signal lines corresponding to the liquid crystal cells of pixels, a first signal line drive circuit for applying a first scanning pulse from each one end of the signal lines to each pixel simultaneously in every horizontal scanning, a second signal line drive circuit for applying the first scanning pulse from each one end of the signal lines to each pixel simultaneously in every horizontal scanning, a first scanning line drive circuit for applying a second scanning pulse from each one end of the left scanning line to each pixel sequentially in every horizontal scanning, a second scanning line drive circuit for applying the second scanning pulse from each one end of the right scanning line to each pixel sequentially in every horizontal scanning, and a control circuit for instructing generation of the first scanning pulse in synchronism with the second scanning pulse to the first and second signal line drive circuits on the basis of an input image signal.

Still another embodiment of the invention comprises:

a liquid crystal panel having plural signal lines and plural scanning lines disposed in a matrix, dividing the signal lines into plural upper signal lines and lower signal lines in the vertical direction, dividing the scanning lines into plural left scanning lines and right scanning lines in the horizontal direction, and disposing pixels at intersections of the upper and lower signal lines and right and left scanning lines, where the optical state of liquid crystal cells of said pixels is changed by applying a voltage to the scanning lines and signal lines corresponding to the pixels, a first signal line drive circuit for applying a first scanning pulse from each one end of the upper signal lines to each pixel simultaneously in every horizontal scanning, a second signal line drive circuit for applying the first scanning pulse from each one end of the lower signal line to each pixel simultaneously in every horizontal scanning, a first scanning line drive circuit for applying a second scanning pulse from each one end of the left scanning line to each pixel sequentially in every horizontal scanning, a second scanning line drive circuit for applying the second scanning pulse from each one end of the right scanning line to each pixel sequentially in every horizontal scanning, and a control circuit for instructing generation of the first scanning pulse in synchronism with the second scanning pulse to the first and second signal line drive circuits on the basis of an input image signal.

In an aspect of the invention the first and second scanning line drive circuits and signal line drive circuit are driven so that the value of the effective voltage applied to each pixel may be within a specified range, supposing the number of scanning lines in the horizontal direction of the liquid crystal panel to be 2N, the number of signal lines in the vertical direction to be M, the wiring resistance per pixel of the scanning lines to be r, and the pixel capacitance per pixel of the scanning lines including the liquid crystal cell to be c, regarding each scanning line of 2N scanning lines to be M/2 stages of ladder form distributed rc circuit, and assuming the equivalent circuit of scanning lines as seen from the first and second scanning line drive circuits to be an RC series circuit composed of resistance R of $M \cdot r/\pi$ and capacitance C of $M \cdot c/\pi$, or supposing the wiring resistance per pixel of the signal lines to be rs, and the pixel capacitance per pixel of the signal lines including the liquid crystal cell to be cs, regarding each signal line out of M signal lines to be 2N stages of ladder form distributed rscs circuit, and supposing the equivalent circuit of scanning lines as seen from the signal line drive circuit to be an RC series circuit composed of resistance R of $4N \cdot rs/\pi$ and capacitance C of $4N \cdot cs/\pi$.

In another aspect of the invention the first and second scanning line drive circuits and first and second signal line drive circuit are driven so that the value of the effective voltage applied to each pixel may be within a specified range, supposing the number of scanning lines in the horizontal direction of the liquid crystal panel to be 2N, the number of signal lines in the vertical direction to be M, the wiring resistance per pixel of the scanning lines to be r, and the pixel capacitance per pixel of the scanning lines including the liquid crystal cell to be c, regarding each scanning line of 2N scanning lines to be M/2 stages of ladder form distributed rc circuit, and assuming the equivalent circuit of scanning lines as seen from the first and second scanning line drive circuits to be an RC series circuit composed of resistance R of $M \cdot r/\pi$ and capacitance C of $M \cdot c/\pi$, or supposing the wiring resistance per pixel of upper and lower signal lines to be rs, and the pixel capacitance per pixel of the upper and lower signal lines including the liquid crystal cell to be cs, regarding each one of upper and lower signal lines out of M upper and lower signal lines to be N stages of ladder form distributed rscs circuit, and supposing the equivalent circuit of scanning lines as seen from the first and second signal line drive circuits to be an RC series circuit composed of resistance R of $2N \cdot rs/\pi$ and capacitance C of $2N \cdot cs/\pi$.

In still another aspect of the invention the scanning line drive circuit and first and second signal line drive circuit are driven so that the value of the effective voltage applied to each pixel may be within a specified range, supposing the number of scanning lines in the horizontal direction of the liquid crystal panel to be 2N, the number of signal lines in the vertical direction to be M, the wiring resistance per pixel of the scanning lines to be r, the pixel capacitance per pixel of the scanning lines including the liquid crystal cell to be c, and the number of pixels formed in one scanning line to be M, regarding the scanning lines to be M stages of ladder form distributed rc circuit, and assuming the equivalent circuit of scanning lines as seen from the scanning line drive circuits to be an RC series circuit composed of resistance R of $2M \cdot r/\pi$ and capacitance C of $2M \cdot c/\pi$, or supposing the wiring resistance per pixel of signal lines to be rs, the pixel capacitance per pixel of the signal lines including the liquid crystal cell to be cs, and the number of pixels formed in one upper and lower signal line to be N, regarding the upper and lower signal lines to be N stages of ladder form distributed rscs circuit, and supposing the equivalent circuit of upper and lower signal lines as seen from the first and second signal line drive circuits to be an RC series circuit composed of resistance R of $2N \cdot rs/\pi$ and capacitance C of $2N \cdot cs/\pi$.

Another embodiment of the invention comprises:

a liquid crystal panel having plural signal lines and plural scanning lines disposed in a matrix, and disposing pixels at intersections of the signal lines and scanning lines, where the optical state of liquid crystal cells of said pixels is changed by applying a voltage to the scanning lines and signal lines corresponding to the pixels, a signal line drive circuit for applying a first scanning pulse from each one end of the signal lines to each pixel simultaneously in every horizontal scanning, a scanning line drive circuit for applying a second scanning pulse from each one end of the scanning lines to each pixel sequentially in every horizontal scanning, and a control circuit for instructing generation of the first scanning pulse in synchronism with the second scanning pulse to the signal line drive circuit on the basis of an input image signal, said liquid crystal panel being driven by the scanning line drive circuit and signal line drive circuit so that the value of the effective voltage applied to each pixel may be within a specified range, supposing the number of the scanning lines in the horizontal direction of the liquid crystal panel to be 2N, the number of the signal lines in the vertical direction to be M, the wiring resistance per pixel of the scanning lines to be r, the pixel capacitance per pixel of the scanning lines including the liquid crystal cell to be c, and the number of pixels formed in one scanning line to be M, regarding the scanning lines to be M stages of ladder form distributed rc circuit, and supposing the equivalent circuit of scanning lines as seen from the scanning line drive circuits to be an RC series circuit composed of resistance R of $2M \cdot r/\pi$ and capacitance C of $2M \cdot c/\pi$, or supposing the wiring resistance per pixel of the signal lines to be rs, the pixel capacitance per pixel of the signal lines including the liquid crystal cell to be cs, and the number of pixels formed in one signal line to be 2N, regarding the signal lines to be 2N stages of ladder form distributed rscs circuit, and supposing the equivalent circuit of signal lines as seen from the signal line drive circuit to be an RC series circuit composed of resistance R of $4N \cdot rs/\pi$ and capacitance C of $4N \cdot cs/\pi$.

Another embodiment of the invention relates to a driving method of liquid crystal display device for driving a liquid crystal panel having plural signal lines and plural scanning lines disposed in a matrix, dividing virtually, or dividing, said signal lines into plural upper signal line and lower signal line at the virtual terminal end, dividing virtually, or dividing, the scanning lines into plural left scanning line and right scanning line at the virtual terminal end, and disposing pixels at intersections of the upper and lower signal lines and right and left scanning lines, where the optical state of liquid crystal cells of said pixels is changed by applying a voltage to the scanning lines and signal lines corresponding to the pixels, comprising:

a first signal line drive circuit for applying a first scanning pulse from one end of the upper signal line to each pixel simultaneously in every horizontal scanning, a second signal line drive circuit for applying the first scanning pulse from one end of the lower signal line to each pixel simultaneously in every horizontal scanning, a first scanning line drive circuit for applying a second scanning pulse from each one end of the left scanning line to each pixel sequentially in every horizontal scanning, a second scanning line drive circuit for applying the second scanning pulse from each one end of the right scanning line to each pixel sequentially in every horizontal scanning, and a control circuit for instructing generation of the first scanning pulse in synchronism with the second scanning pulse to the first and second signal line drive circuits on the basis of an input image signal, in which supposing the number of the scanning lines in the horizontal direction of the liquid crystal cell to be 2N, the number of the signal lines in the vertical direction to be M, and the point intersecting with the x-th signal line from the drive end of the right and left scanning lines to be a virtual terminal end, or a divided terminal end, the voltage Vgw (x, t) of the second scanning pulse applied to the pixel positioned at the virtual terminal end or terminal end is, supposing the wiring resistance per pixel of the scanning lines to be r, the pixel capacitance per pixel of the scanning lines including the liquid crystal cell to be c, the voltage of the second scanning pulse at the drive end of right and left scanning lines to be changed from Vgn to Vgn+1 at time t=0, the operation reference voltage at this time to be Vref, the output resistance of the first and second scanning line drive circuits to be Rgw, and setting x=M/2, given as $$Vgw(x,t) = (Vgn - Vgn + 1)\exp\{-\pi^2 \cdot t / (4r \cdot c \cdot x^2 + 2\pi \cdot c \cdot x \cdot Rgw)\} + Vgn + 1 - Vref$$

or further supposing the point intersecting with the y-th scanning line from the drive end of the upper and lower signal lines to be virtual terminal end or divided terminal end, the voltage Vsw (y, t) of the first scanning pulse applied to the pixel positioned at the virtual terminal end or terminal end is, supposing the wiring resistance per pixel of the upper and lower signal lines to be rs, the pixel capacitance per pixel of the signal line including the liquid crystal cell to be cs, the operation reference voltage of VH and VL to be Vref1 and Vref2, respectively, the voltage of the first scanning pulse at drive end of upper and lower signal lines to be VH and VL alternately repeated at every TH, the output resistance of the first and second signal line drive circuits to be R sw, and setting y=N, given, if changing over to VH at t=0, as $$Vsw(y, t) = (VH - Vref1)[1 - 2\exp\{-\pi^2 \cdot t / (4rs \cdot cs \cdot y^2 + 2\pi \cdot y \cdot cs \cdot Rsw)\}]$$

or, if changing over to VL at t=0, as $$Vsw(y, t) = (VL - Vref2)[1 - 2\exp\{-\pi^2 \cdot t / (4rs \cdot cs \cdot y^2 + 2\pi \cdot y \cdot cs \cdot Rsw)\}]$$

Still another embodiment of the invention relates to a driving method of liquid crystal display device for driving a liquid crystal panel having plural signal lines and plural scanning lines disposed in a matrix, dividing virtually, or dividing, into plural left scanning line and right scanning line at the virtual terminal end of the scanning lines, and disposing pixels at intersections of the signal lines and right and left scanning lines, where the optical state of the liquid crystal cells of said pixels is changed by applying a voltage to the scanning lines and signal lines corresponding to the pixels, comprising:

a signal line drive circuit for applying a first scanning pulse from each one end of the signal lines to each pixel simultaneously in every horizontal scanning, a first scanning line drive circuit for applying a second scanning pulse from each one end of the left scanning line to each pixel sequentially in every horizontal scanning, a second scanning line drive circuit for applying the second scanning pulse from each one end of the right scanning line to each pixel sequentially in every horizontal scanning, and a control circuit for instructing generation of the first scanning pulse in synchronism with the second scanning pulse to the signal line drive circuits on the basis of an input image signal, in which supposing the number of the scanning lines in the horizontal direction of the liquid crystal cell to be 2N, the number of the signal lines in the vertical direction to be M, and the point intersecting with the x-th signal line from the drive end of the scanning lines to be a virtual terminal end, or a divided terminal end, the voltage Vgw (x, t) of the second scanning pulse applied to the pixel positioned at the virtual terminal end or terminal end is, supposing the wiring resistance per pixel of the scanning lines to be r, the pixel capacitance per pixel of the scanning lines including the liquid crystal cell to be c, the voltage of the second scanning pulse at the drive end of right and left scanning lines to be changed from Vgn to Vgn+1 at time t=0, the operation reference voltage at this time to be Vref, the output resistance of the first and second scanning line drive circuits to be Rgw, and setting x=M/2, given as $$Vgw(x, t) = (Vgn - Vgn + 1)\exp\{-\pi^2 \cdot t / (4r \cdot c \cdot x^2 + 2\pi \cdot c \cdot x \cdot Rgw)\} + Vgn + 1 - Vref$$

or further supposing the point intersecting with the y-th scanning line from the drive end of the signal lines to be terminal end, the voltage Vss (y, t) of the first scanning pulse applied to the pixel positioned at the terminal end is, supposing the wiring resistance per pixel of the signal lines to be rs, the pixel capacitance per pixel of the signal line including the liquid crystal cell to be cs, the operation reference voltage of VH and VL to be Vref1 and Vref2 respectively, the voltage of the first scanning pulse at drive end of signal lines to be VH and VL alternately repeated at every TH, the output resistance of the signal line drive circuits to be Rss, and setting y=2N, given, if changing over to VH at t=0, as $$Vss(y, t) = (VH - Vref1)[1 - 2\exp\{-\pi^2 \cdot t / (4rs \cdot cs \cdot y^2 + 2\pi \cdot y \cdot cs \cdot Rss)\}]$$

or, if changing over to VL at t=0, as $$Vss(y, t) = (VL - Vref2)[1 - 2\exp\{-\pi^2 \cdot t / (4rs \cdot cs \cdot y^2 + 2\pi \cdot y \cdot cs \cdot Rss)\}]$$

Yet another embodiment of the invention relates to a driving method of liquid crystal display device for driving a liquid crystal panel having plural signal lines and plural scanning lines disposed in a matrix, dividing virtually, or dividing, into plural upper signal lines and lower signal lines at the virtual terminal end of the signal lines, disposing pixels at intersections of the upper and lower signal lines and the scanning lines, and disposing a liquid crystal cell between electrodes of the pixels, comprising:

a first signal line drive circuit for applying a first scanning pulse from each one end of the upper signal line to each pixel simultaneously in every horizontal scanning, a second signal line drive circuit for applying the first scanning pulse from each one end of the lower signal line to each pixel simultaneously in every horizontal scanning, a scanning line drive circuit for applying a second scanning pulse from each one end of the scanning line to each pixel sequentially in every horizontal scanning, and a control circuit for instructing generation of the first scanning pulse in synchronism with the second scanning pulse to the first and second signal line drive circuits on the basis of an input image signal, in which supposing the number of the scanning lines in the horizontal direction of the liquid crystal cell to be 2N, the number of the signal lines in the vertical direction to be M, and the point intersecting with the x-th signal line from the drive end of the scanning lines to be a terminal end, the voltage Vgs (x, t) of the second scanning pulse applied to the pixel positioned at the terminal end is, supposing the wiring resistance per pixel of the scanning lines to be r, the pixel capacitance per pixel of the scanning lines including the liquid crystal cell to be c, the voltage of the second scanning pulse at the drive end of the right and left scanning lines to be changed from Vgn to Vgn+1 at time t=0, the operation reference voltage at this time to be Vref, the output resistance of the first and second scanning line drive circuits to be Rgs, and setting x=M, given as $$Vgs(x, t) = (Vgn - Vgn + 1)\exp\{-\pi^2 \cdot t / (4r \cdot c \cdot x^2 + 2\pi \cdot c \cdot x \cdot Rgs)\} + Vgn + 1 - Vref$$

or further supposing the point intersecting with the y-th scanning line from the drive end of the upper and lower signal lines to be virtual terminal end, or divided terminal end, the voltage Vsw (y, t) of the first scanning pulse applied to the pixel positioned at the virtual terminal, end or terminal end is, supposing the wiring resistance per pixel of the signal lines to be rs, the pixel capacitance per pixel of the signal line including the liquid crystal cell to be cs, the operation reference voltage of VH and VL to be Vref1 and Vref2 respectively, the voltage of the first scanning pulse at drive end of the upper and lower signal lines to be VH and VL alternately repeated at every TH, the output resistance of the first and second signal line drive circuits to be Rsw, and setting y=N, given, if changing over to VH at t=0, as $$Vsw(y, t) = (VH - Vref1)\,[1 - 2\exp\{-\pi^2 \cdot t/(4rs \cdot cs \cdot y^2 + 2\pi \cdot y \cdot cs \cdot Rsw)\}]$$

or, if changing over to VL at t=0, as $$Vsw(y, t) = (VL - Vref2)[1 - 2\exp\{-\pi^2 \cdot t/(4rs \cdot cs \cdot y^2 + 2\pi \cdot y \cdot cs \cdot Rsw)\}]$$

Another embodiment of the invention relates to a driving method of liquid crystal display device for driving a liquid crystal panel having plural signal lines and plural scanning lines disposed in a matrix, and disposing pixels at intersections of the signal lines and scanning lines, where the optical state of the liquid crystal cells of said pixels is changed by applying a voltage to the scanning lines and signal lines corresponding to the pixels, comprising:

a signal line drive circuit for applying a first scanning pulse from each one end of the signal lines to each pixel simultaneously in every horizontal scanning, a scanning line drive circuit for applying a second scanning pulse from each one end of the scanning line to each pixel sequentially in every horizontal scanning, and a control circuit for instructing generation of the first scanning pulse in synchronism with the second scanning pulse to the signal line drive circuits on the basis of an input image signal, in which supposing the number of the scanning lines in the horizontal direction of the liquid crystal cell to be 2N, the number of the signal lines in the vertical direction to be M, and the point intersecting with the x-th signal line from the drive end of the scanning lines to be a terminal end, the voltage Vgs (x, t) of the second scanning pulse applied to the pixel positioned at the terminal end is, supposing the wiring resistance per pixel of the scanning lines to be r, the pixel capacitance per pixel of the scanning lines including the liquid crystal cell to be c, the voltage of the second scanning pulse at the drive end of right and left scanning lines to be changed from Vgn to Vgn+1 at time t=0, the operation reference voltage at this time to be Vref, the output resistance of the first and second scanning line drive circuits to be Rgs, and setting x=M, given as $$Vgs(x, t) = (Vgn - Vgn + 1)\exp\{-\pi^2 \cdot t/(4r \cdot c \cdot x^2 + 2\pi \cdot c \cdot x \cdot Rgs)\} + Vgn + 1 - Vref$$

or further supposing the point intersecting with the y-th scanning line from the drive end of the signal lines to be terminal end, the voltage Vss(y, t) of the first scanning pulse applied to the pixel positioned at the terminal end is, supposing the wiring resistance per pixel of the signal lines to be rs, the pixel capacitance per pixel of the signal line including the liquid crystal cell to be cs, the operation reference voltage of VH and VL to be Vref1 and Vref2 respectively, the voltage of the first scanning pulse at drive end of signal lines to be VH and VL alternately repeated at every TH, the output resistance of the signal line drive circuits to be Rss, and setting y=2N, given, if changing over to VH at t=0, as $$Vss(y, t) = (VH - Vref1)\,[1 - 2\exp\{-\pi^2 \cdot t/(4rs \cdot cs \cdot y^2 + 2\pi \cdot y \cdot cs \cdot Rss)\}]$$

or, if changing over to VL at t=0, as $$Vss(y, t) = (VL - Vref2)\,[1 - 2\exp\{-\pi^2 \cdot t/(4rs \cdot cs \cdot y^2 + 2\pi \cdot y \cdot cs \cdot Rss)\}]$$

In accordance with an aspect of the invention the output resistance Rgw of the first and second scanning line drive circuits is, supposing the number of the scanning lines in the horizontal direction of the liquid crystal panel to be 2N, the number of the signal lines in the vertical direction to be M, the wiring resistance per pixel of the scanning lines to be r, the pixel capacitance per pixel of the scanning lines including the liquid crystal cell to be c, the pulse width of the second scanning pulse to be TH, the ratio of effective voltage of pixel at virtual terminal end or divided terminal end of the scanning lines to effective voltage of pixel at drive end of the scanning lines to be γ1, the ON voltage of the liquid crystal panel at drive end of scanning lines to be Vgon, the OFF voltage of the liquid crystal panel to be Vgoff, the delay time of the liquid crystal panel to be Tdpw, the operation reference voltage to be Vref, the threshold voltage of the liquid crystal panel to be Vpthw, and the ratio of amplitude of scanning line driving voltage to amplitude of signal line driving voltage to be a, to satisfy either $$Rgw \leqq \{1-(\gamma 1)^2\}\cdot\{\pi \cdot TH/(1.5M \cdot c)\}\cdot\{(a^2+N-1)/(a^2)\}-M \cdot r/\pi$$

or $$Rgw \leqq -\pi \cdot Tdp\ w/(M \cdot c \cdot \ln\beta w)-M \cdot r/\pi\beta w=(Vpth\ w-Vgon+Vref)/(Vgoff-Vgon)$$

In another aspect of the invention the output resistance Rgs of the scanning line drive circuits is, supposing the number of the scanning lines in the horizontal direction of the liquid crystal panel to be 2N, the number of the signal lines to be M, the wiring resistance per pixel of the scanning lines to be r, the pixel capacitance per pixel of the scanning lines including the liquid crystal cell to be c, the pulse width of the second scanning pulse to be TH, the ratio of effective voltage of pixel at terminal end of the scanning lines to effective voltage of pixel at drive end of the scanning lines to be γ2, the ON voltage of the liquid crystal panel at drive end of scanning lines to be Vgon, the OFF voltage of the liquid crystal panel to be Vgoff, the delay time of the liquid crystal panel to be Tdps, the operation reference voltage to be Vref, the threshold voltage of the liquid crystal panel to be Vpths, and the ratio of amplitude of scanning line driving voltage to amplitude of signal line driving voltage to be a, to satisfy either $$Rgs \leqq \{1-(\gamma 2)^2\}\cdot\{\pi\cdot TH/(3M\cdot c)\}\cdot\{(a^2+N-1)/(a^2)\}-2M\cdot r/\pi$$

or $$Rgs \leqq -\pi\cdot Tdps/(2M\cdot c\cdot \ln\beta s)-2M\cdot r/\pi$$

where, $$\beta s=(Vpths-Vgon+Vref)/(Vgoff-Vgon)$$

In another aspect of the invention the output resistance Rsw of the first and second signal line drive circuits is, supposing the number of the scanning lines in the horizontal direction of the liquid crystal panel to be 2N, the number of the signal lines in the vertical direction to be M, the ratio of effective voltage of pixel at virtual terminal end or divided terminal end of the signal lines to effective voltage of pixel at drive end to be γ1s, the wiring resistance per pixel of the signal lines to be rs, the pixel capacitance to be cs, the width of the first scanning pulse to be TH, the number of scanning lines to be 2N, and the ratio of amplitude of scanning line driving voltage to amplitude of signal line driving voltage to be a, to satisfy either $$Rsw \leqq \{1-(\gamma 1s)^2\}\cdot\{\pi\cdot TH/(4N\cdot cs)\}\cdot\{(a^2+N-1)/N\}-2N\cdot rs/\pi$$

or $$Rsw \leqq -2N\cdot rs/\pi-\pi\cdot TH/[2N\cdot cs\cdot \ln\{(1-\gamma ls)/2\}]$$

In another aspect of the invention the output resistance Rss of the signal line drive circuits is, supposing the number of the scanning lines in the horizontal direction of the liquid crystal panel to be 2N, the number of the signal lines in the vertical direction to be M, the ratio of effective voltage of pixel at terminal end of the signal lines to effective voltage of pixel at drive end to be γ2s, the wiring resistance per pixel of the signal lines to be rs, the pixel capacitance to be cs, the width of the first scanning pulse to be TH, the number of scanning lines to be 2N, and the ratio of amplitude of scanning line driving voltage to amplitude of signal line driving voltage to be a, to satisfy either $$Rss \leqq \{1-(\gamma 2)^2\}\cdot\{\pi\cdot TH/(8N\cdot cs)\}\cdot\{(a^2+N-1)/N\}-4N\cdot rs/\pi$$

or $$Rss \leqq -4N\cdot rs/\pi-\pi\cdot TH/[4N\cdot cs\cdot \ln\{(1-\gamma 2s)/2\}]$$

In another aspect of the invention supposing the number of the scanning lines in the horizontal direction of the liquid crystal cell to be 2N, the number of the signal lines in the vertical direction to be M, the wiring resistance per pixel of the scanning lines to be r, the pixel capacitance per pixel of the scanning lines including the liquid crystal cell to be c, the pulse width of the second scanning pulse to be TH, and its repeating period TV to be 2N·TH, and assuming the first and second scanning line drive circuits to apply the scanning line driving voltages V(+), V(−) alternately in every period TV to the selected scanning line, to apply the operation reference voltage Vref to the non-selected scanning lines, and to apply VL to the signal lines when the V(+) is applied or VH when the V(−) is applied, the individual scanning line driving currents of the first and second scanning line drive circuits is $$2N\cdot Mc(V(+)-VL)/(\pi\cdot TV) \text{ when } V(+) \text{ is applied,}$$

or $$2N\cdot Mc(V(-)-VH)/(\pi\cdot TV) \text{ when } V(-) \text{ is applied.}$$

In yet another aspect of the invention supposing the number of the scanning lines in the horizontal direction of the liquid crystal cell to be 2N, the number of the signal lines in the vertical direction to be M, the wiring resistance per pixel of the scanning lines to be r, the pixel capacitance per pixel of the scanning lines including the liquid crystal cell to be c, the pulse width of the second scanning pulse to be TH, and its repeating period TV to be 2N·TH, and assuming the scanning line drive circuit to apply V(+), V(−) alternately in every period TV to the selected scanning line, to apply the operation reference voltage Vref to the non-selected scanning lines, and to apply VL to the signal lines when the V(+) is applied or VH when the V(−) is applied, the scanning line driving current of the scanning line drive circuit is $$4N\cdot M\cdot c(V(+)-VL)/(\pi\cdot TV) \text{ when } V(+) \text{ is applied,}$$

or $$4N\cdot M\cdot c(V(-)-VH)/(\pi\cdot TV) \text{ when } V(-) \text{ is applied.}$$

In still another aspect of the invention supposing the number of the scanning lines in the horizontal direction of the liquid crystal cell to be 2N, the number of the signal lines in the vertical direction to be M, the wiring resistance per pixel of the scanning lines to be r, the pixel capacitance per pixel of the scanning lines including the liquid crystal cell to be c, the pulse width of the second scanning pulse to be TH, and its repeating period TV to be 2N·TH, and assuming to apply the scanning line driving voltage Vgon in every period TV to the selected scanning line, to apply Vg(+) and Vg(−) alternately, and to apply Vgoff to the non-selected scanning lines, the individual scanning line driving currents of the first and second scanning line drive circuits are $$2N\cdot Mc(Vgon-Vgoff)/(\pi\cdot TV) \text{ when } Vgon \text{ is applied,}$$

$$N\cdot Mc(Vg(+)-Vgoff)/(\pi\cdot TV) \text{ when } Vg(+) \text{ is applied,}$$

or $$N\cdot Mc(Vg(-)-Vgoff)/(\pi\cdot TV) \text{ when } Vg(-) \text{ is applied.}$$

In another aspect of the invention supposing the number of the scanning lines in the horizontal direction of the liquid crystal cell to be 2N, the number of the signal lines in the vertical direction to be M, the wiring resistance per pixel of the scanning lines to be r, the pixel capacitance per pixel of the scanning lines including the liquid crystal cell to be c, the pulse width of the second scanning pulse to be TH, and its repeating period TV to be 2N·TH, and assuming to apply the scanning line driving voltage Vgon in every period TV to the selected scanning line, to apply Vg(+) and Vg(−) alternately, and to apply Vgoff to the non-selected scanning lines, the scanning line driving current of the scanning line drive circuit is $$4N\cdot Mc(Vgon-Vgoff)/(\pi\cdot TV) \text{ when } Vgon \text{ is applied,}$$

$$2N\cdot Mc(Vg(+)-Vgoff)/(\pi\cdot TV) \text{ when } Vg(+) \text{ is applied,}$$

or $$2N\cdot Mc(Vg(-)-Vgoff)/(\pi\cdot TV) \text{ when } Vg(-) \text{ is applied.}$$

According to another aspect of the invention supposing the number of the scanning lines in the horizontal direction of the liquid crystal cell to be 2N, the number of the signal lines in the vertical direction to be M, the wiring resistance per pixel of the signal lines to be rs, the pixel capacitance per pixel of the signal lines including the liquid crystal cell to be cs, the operation reference voltage of VH to be Vref1, the operation reference voltage of VL to be Vref2 the width of the first scanning pulse to be TH, and the repeating period TV of the second scanning pulse to be 2N·TH, the first and second signal line drive circuits apply signal line driving voltages VH, VL alternately in every pulse width TH of the first scanning pulse to the signal lines, and the individual signal line driving currents of the first and second signal line drive circuits is $$8(VH-Vref\mathbf{1})N_2 \cdot M \cdot cs/(\pi \cdot TV) \text{ when } VH \text{ is applied,}$$

or $$8(VL-Vref\mathbf{2})N_2 \cdot M \cdot cs/(\pi \cdot TV) \text{ when } VL \text{ is applied.}$$

In another aspect of the invention supposing the number of the scanning lines in the horizontal direction of the liquid crystal cell to be 2N, the number of the signal lines in the vertical direction to be M, the wiring resistance per pixel of the signal lines to be rs, the pixel capacitance per pixel of the signal lines including the liquid crystal cell to be cs, the width of the first scanning pulse to be TH, the operation reference voltage of VH to be Vref1, the operation reference voltage of VL to be Vref2 and the repeating period TV of the second scanning pulse to be 2N·TH, the signal line drive circuit applies signal line driving voltages VH, VL alternately in every pulse width TH of the first scanning pulse to the signal lines, and the signal line driving current of the signal line drive circuit is $$16(VH-Vref\mathbf{1})N^2 \cdot M \cdot cs/(\pi \cdot TV) \text{ when } VH \text{ is applied,}$$

or $$16(VL-Vref\mathbf{2})N^2 \cdot M \cdot cs/(\pi \cdot TV) \text{ when } VL \text{ is applied.}$$

In still another aspect of the invention the delay time of the second scanning pulse of the central pixel of the scanning line by both-end driving for driving simultaneously from the right and left scanning lines is ¼ or less of the delay time of the second pulse of the terminal end pixel in one-end driving by either first or second scanning line drive circuit only, when the output resistance of the scanning line drive circuit used in both-end driving is ½ or less of the output resistance of the scanning line drive circuit used in one-end driving.

In yet another aspect of the invention the delay time of the first scanning pulse of the central pixel of the signal line by both-end driving for driving simultaneously from the upper and lower signal lines is ¼ or less of the delay time of the first pulse of the terminal end pixel in one-end driving by either first or second signal line drive circuit only, and the output resistance of the signal line drive circuit used in both-end driving is ½ or less of the output resistance of the signal line drive circuit used in one-end driving.

In another aspect of the invention the liquid crystal panel is characterized by forming drive terminals at both ends of each scanning line, or forming or disposing a drive circuit outside of the image display region of the liquid crystal panel.

In still another aspect of the invention the liquid crystal panel is characterized by forming drive terminals at both ends of each signal line, or forming or disposing a drive circuit outside of the image display region of the liquid crystal panel.

In another aspect of the invention the liquid crystal panel is characterized by forming drive terminals at both ends of each scanning line and each signal line, or forming or disposing a drive circuit outside of the image display region of the liquid crystal panel.

In another aspect of the invention the ratio γgw(x) of effective voltage of pixels at virtual terminal end or divided terminal end x-th apart from the drive end of the scanning line to effective voltage of pixel at drive end of the scanning line is, supposing the wiring resistance per pixel of the scanning line to be r, the pixel capacitance per pixel of scanning line including the liquid crystal cell to be c, the second scanning pulse at drive end of scanning line to be changed over to selected voltage at time t=0; the operation reference voltage to be Vref, the width of the first scanning pulse to be TH, the output resistance of the first and second scanning line drive circuits to be Rgw, x=M/2, and the ratio of amplitude of scanning line driving voltage to amplitude of signal line driving voltage to be a, given as:

$$\gamma gw(x) = [1 - 1.5(4r \cdot c \cdot x^2 + 2\pi \cdot c \cdot x \cdot Rgw)/(\pi^2 \cdot TH) \cdot (a^2/a^2 + N - 1)\}]^{(1/2)}$$

In still another aspect of the invention the ratio γgs(x) of effective voltage of pixel at terminal end x-th apart from the drive end of the scanning line to effective voltage of pixel at drive end of the scanning line is, supposing the wiring resistance per pixel of the scanning line to be r, the pixel capacitance per pixel of scanning line including the liquid crystal cell to be c, the second scanning pulse at drive end of scanning line to be changed over to selected voltage at time t=0, the operation reference voltage to be Vref, the width of the first scanning pulse to be TH, the output resistance of the scanning line drive circuit to be Rgs, x=M, and the ratio of amplitude of scanning line driving voltage to amplitude of signal line driving voltage to be a, given as:

$$\gamma gs(x) = [1 - 1.5(4r \cdot c \cdot x^2 + 2\pi \cdot c \cdot x \cdot Rgs)/(\pi^2 \cdot TH) \cdot (a^2/a^2 + N - 1)\}]^{(1/2)}$$

In yet another aspect of the invention the ratio γsw(y) of effective voltage of pixel at virtual terminal end or divided terminal end y-th apart from the drive end of the signal line to effective voltage of pixel at drive end of the signal line is, supposing the wiring resistance per pixel of the signal line to be rs, the pixel capacitance per pixel of signal line including the liquid crystal cell to be cs, the width of the first scanning pulse to be TH, the voltage of the first scanning pulse at drive end of signal line to be changed between VH and VL at every TH, the operation reference voltage at VH and VL to be Vref1 and Vref2 respectively, the output resistance of the first and second signal line drive circuits to be Rsw, y=N, and the ratio of amplitude of scanning line driving voltage to amplitude of signal line driving voltage to be a, given as:

$$\gamma sw(y) = [1 - 2(4rs \cdot cs \cdot y^2 + 2\pi \cdot cs \cdot y \cdot Rsw)/(\pi^2 \cdot TH) \cdot \{N/(a^2 + N - 1)\}]^{(1/2)}$$

or $$\gamma sw(y) = [1 - 2\exp(-\pi_2 \cdot TH/(4y^2 \cdot rs \cdot cs + 2\pi \cdot y \cdot cs \cdot Rsw)\}]$$

In another aspect of the invention the ratio γss(y) of effective voltage of pixel at terminal end y-th apart from the drive end of the signal line to effective voltage of pixel at drive end of the signal line is, supposing the wiring resistance per pixel of the signal line to be rs, the pixel capacitance per pixel of signal line including the liquid crystal cell to be cs, the width of the first scanning pulse to be TH, the voltage of the first scanning pulse at drive end of signal line to be changed between VH and VL at every TH, the operation reference voltage at VH and VL to be Vref1 and Vref2, respectively, the output resistance of the signal line drive circuit to be Rss, y=2N, and the ratio of amplitude of scanning line driving voltage to amplitude of signal line driving voltage to be a, given as:

$$\gamma ss(y) = [1 - 2(4rs \cdot cs \cdot y^2 + 2\pi \cdot cs \cdot y \cdot Rss) / (\pi^2 \cdot TH) \cdot \{N / (a^2 + N - 1)\}]^{(1/2)}$$

or $$\gamma ss(y) = [1 - 2\exp(-\pi^2 \cdot TH / (4y^2 \cdot rs \cdot cs + 2\pi \cdot y \cdot cs \cdot Rss)\}]$$

In another aspect of the invention the threshold voltage Vpthw of the liquid crystal panel in the scanning line both-end driving is, supposing the delay time of the liquid crystal panel to be Tdpw, the ON voltage and OFF voltage of the liquid crystal panel to be Vgon and Vgoff, respectively, the x-th position from the drive end of the scanning lines to be virtual terminal end or divided terminal end, the wiring resistance per pixel of the scanning lines to be r, the pixel capacitance per pixel of scanning lines including the liquid crystal cell to be c, the second scanning pulse at the drive end of scanning lines to be changed over from Vgoff to Vgon at time t=0, the operation reference voltage at this time to be Vref, the output resistance of the first and second scanning line drive circuits to be Rgw, and x=M/2, given as:

$$Vpthw=(Vgoff-Vgon)\exp\{-\pi^2 \cdot Tdpw/(4x^2 \cdot r \cdot c+2\pi \cdot x \cdot c \cdot Rgw)\}+Vgon-Vref$$

In still another aspect of the invention the threshold voltage Vpths of the liquid crystal panel in the scanning line one-end driving is, supposing the delay time of the liquid crystal panel to be Tdps, the ON voltage and OFF voltage of the liquid crystal panel to be Vgon and Vgoff, respectively, the x-th position from the drive end of the scanning lines to be virtual terminal end or divided terminal end, the wiring resistance per pixel of the scanning lines to be r, the pixel capacitance per pixel of scanning lines including the liquid crystal cell to be c, the second scanning pulse at the drive end of scanning lines to be changed over from Vgoff to Vgon at time t=0, the operation reference voltage at this time to be Vref, the output resistance of the scanning line drive circuit to be Rgs, and x =M/2, given as:

$$Vpths = (Vgoff - Vgon)\exp\{-\pi^2 \cdot Tdpw / (4x^2 \cdot r \cdot c + 2\pi \cdot x \cdot c \cdot Rgs)\} + Vgon - Vref$$

Thus, according to the constitution and method of the present invention in scanning line both-end simultaneous driving, even in the condition of same driving current, the delay time of the scanning line driving voltage can be set smaller as compared with scanning line one-end driving. At the same time, in signal line both-end simultaneous driving, even in the condition of same driving current, the delay time of the signal line driving voltage can be set smaller as compared with signal line one-end driving. Therefore, the lateral luminance error, longitudinal luminance error, and crosstalk are extremely small, and display unevenness is less obvious. Moreover, by drive analysis on the basis of a simple equivalent circuit, design parameters such as lateral luminance error, longitudinal luminance error, pixel driving voltage, scanning line driving voltage, driving current of scanning line drive circuit can be obtained, an optimum design of drive circuit is obtained efficiently and at low cost, and the picture quality of the liquid crystal display device can be enhanced dramatically.

In particular, according to certain aspect of the liquid crystal display device of the present invention, scanning lines and signal lines in scanning line both-end simultaneous driving or signal line both-end simultaneous driving can be expressed in an extremely simple equivalent circuit. Therefore, development of drive circuit and design of drive circuit are very easy.

According to the driving method of the present invention, in scanning line both-end simultaneous driving and signal line one-end driving, or scanning line one-end driving and signal line both-end simultaneous driving, or scanning line both-end simultaneous driving and signal line both-end simultaneous driving, the scanning line driving voltage and signal line driving voltage at arbitrary pixels in the liquid crystal panel can be obtained accurately.

According to aspects of the liquid crystal display device, in scanning line both-end simultaneous driving and signal line both-end simultaneous driving, the optimum range of output resistance of the drive circuit can be obtained accurately.

According to other aspects of the liquid crystal display device, in scanning line both-end simultaneous driving and signal line both-end simultaneous driving, the driving current of the drive circuit of scanning lines and signal lines can be obtained accurately.

According to the driving method of the present invention, in scanning line both-end simultaneous driving and signal line one-end driving, or scanning line one-end driving and signal line both-end simultaneous driving, or scanning line both-end simultaneous driving and signal line both-end simultaneous driving, the ratio of effective voltage of an arbitrary pixel in the liquid crystal panel to effective voltage of pixel at drive end of scanning lines, or the ratio of effective value of signal line driving voltage of an arbitrary pixel of the liquid crystal panel to effective value of signal line driving voltage of pixel at drive end of signal lines can be determined.

Further according to the driving method of the invention, the range of threshold voltage of the liquid crystal panel in scanning line both-end simultaneous driving can be determined.

Also according to the driving method of the invention, the range of threshold voltage of the liquid crystal panel in scanning line one-end driving can be determined.

Further still according to the constitution and method of the present invention in scanning line one-end driving or signal line one-end driving, the output resistance of drive circuit, driving current of drive circuit, threshold voltage of liquid crystal panel, and driving voltage of arbitrary pixel can be obtained accurately.

DESCRIPTION OF THE PREFERRED EMBODIMENTS

Figure 1:
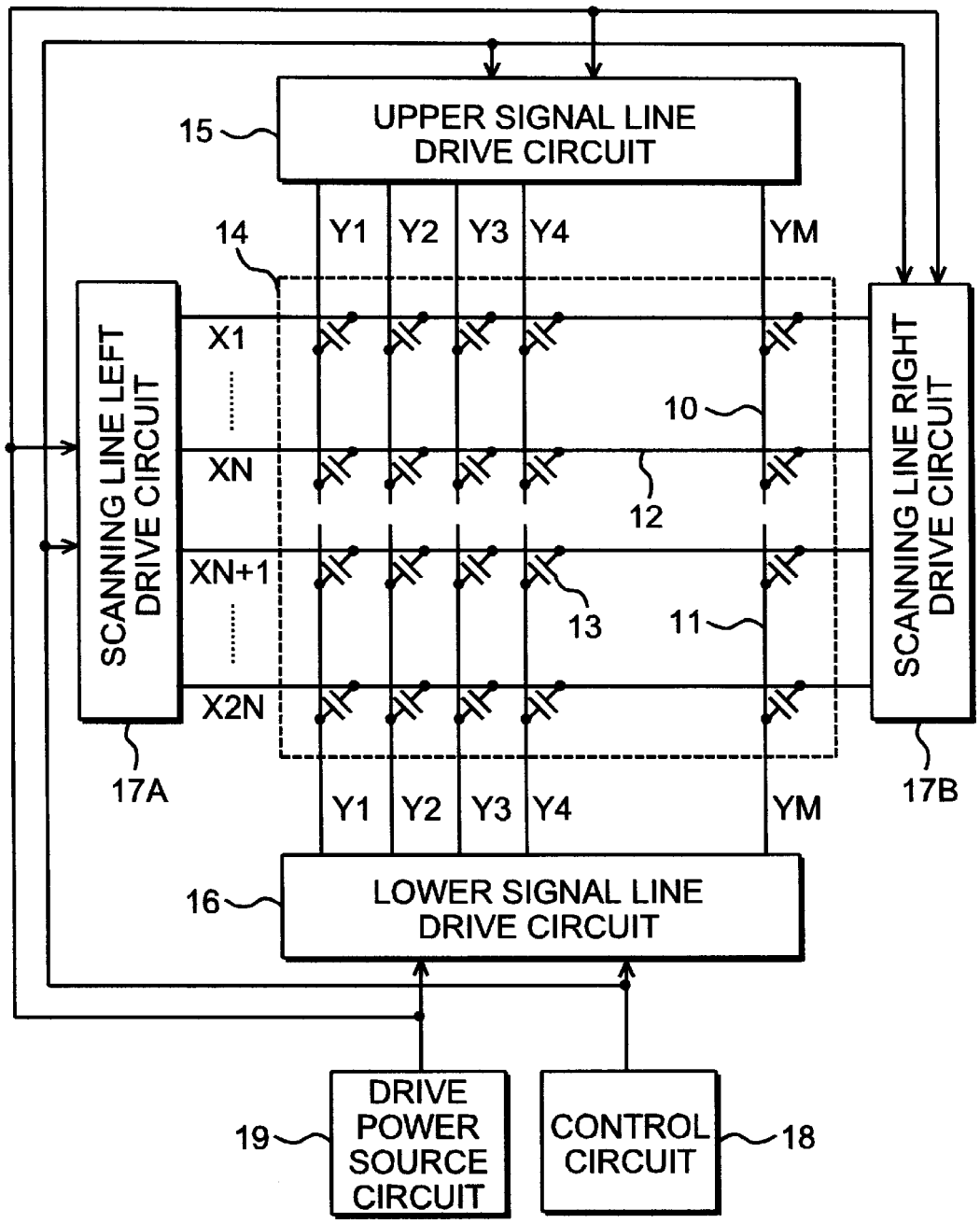
FIG. 1 is a block diagram of a liquid crystal display device in embodiment 1 of the invention.
Figure 2:
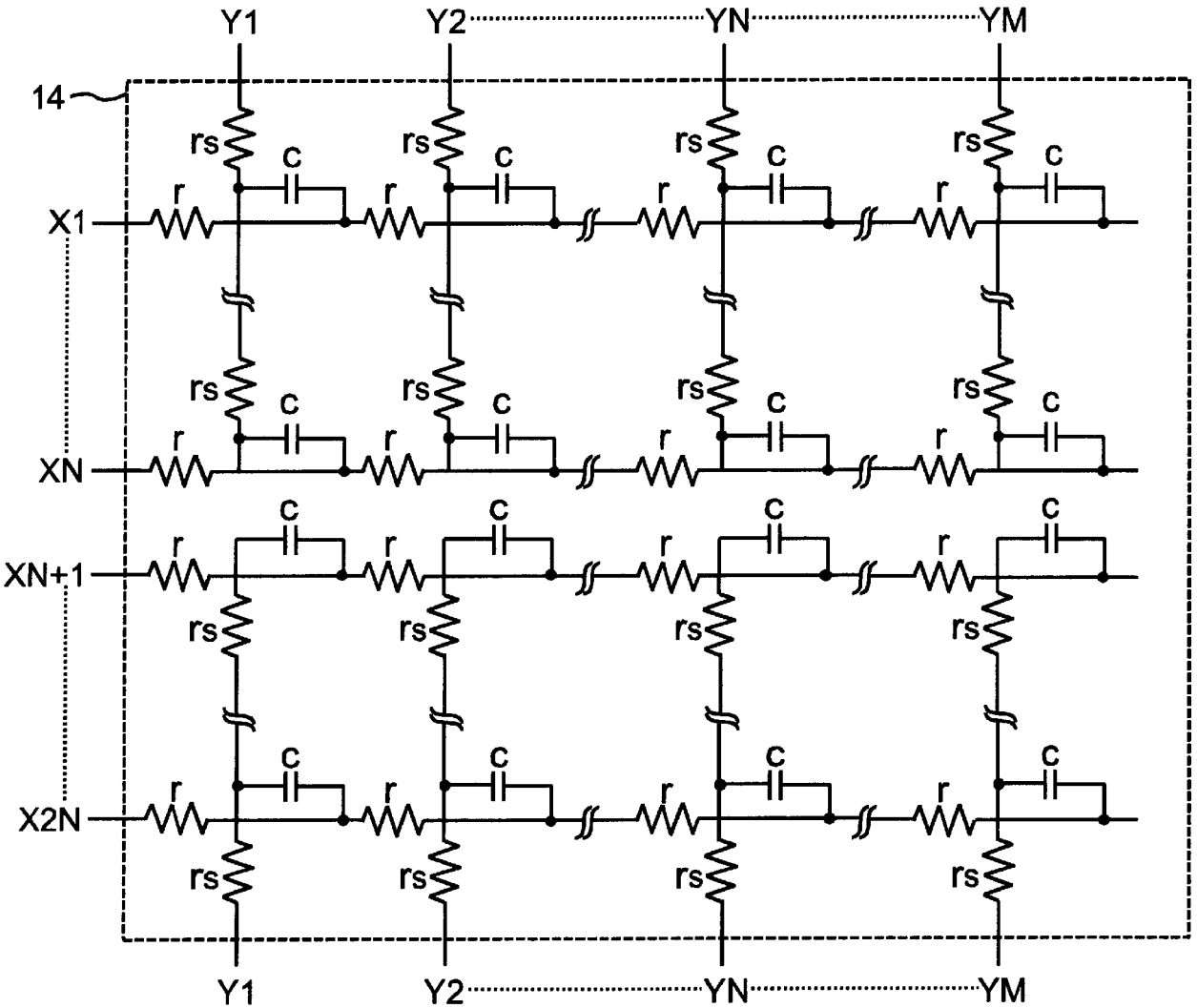
FIG. 2 is an equivalent circuit diagram of a liquid crystal panel in embodiment 1 of the invention.

Referring now to the drawings, the liquid crystal display device and its driving method in the preferred embodiments of the invention are described in detail below. The same parts as in the constitution of the conventional liquid crystal display device are identified with same reference numerals and their description is omitted.

(Embodiment 1)

A liquid crystal display device in embodiment 1 of the invention is described below while referring to the block diagram in FIG. 1. This liquid crystal display device comprises a liquid crystal panel 14, an upper signal line drive circuit 15, a lower signal line drive circuit 16, a scanning line left drive circuit 17A, a control circuit 18, and a drive power source circuit 19, and also contains a scanning line right drive circuit 17B.

In this liquid crystal panel 14, a second scanning pulse is supplied sequentially from both ends of the scanning line 12 simultaneously through the scanning line left drive circuit 17A and scanning line right drive circuit 17B. In the explanation to follow, the liquid crystal panel 14 is explained as a simple matrix type liquid crystal panel.

Figures 3A, 3B, 3C:
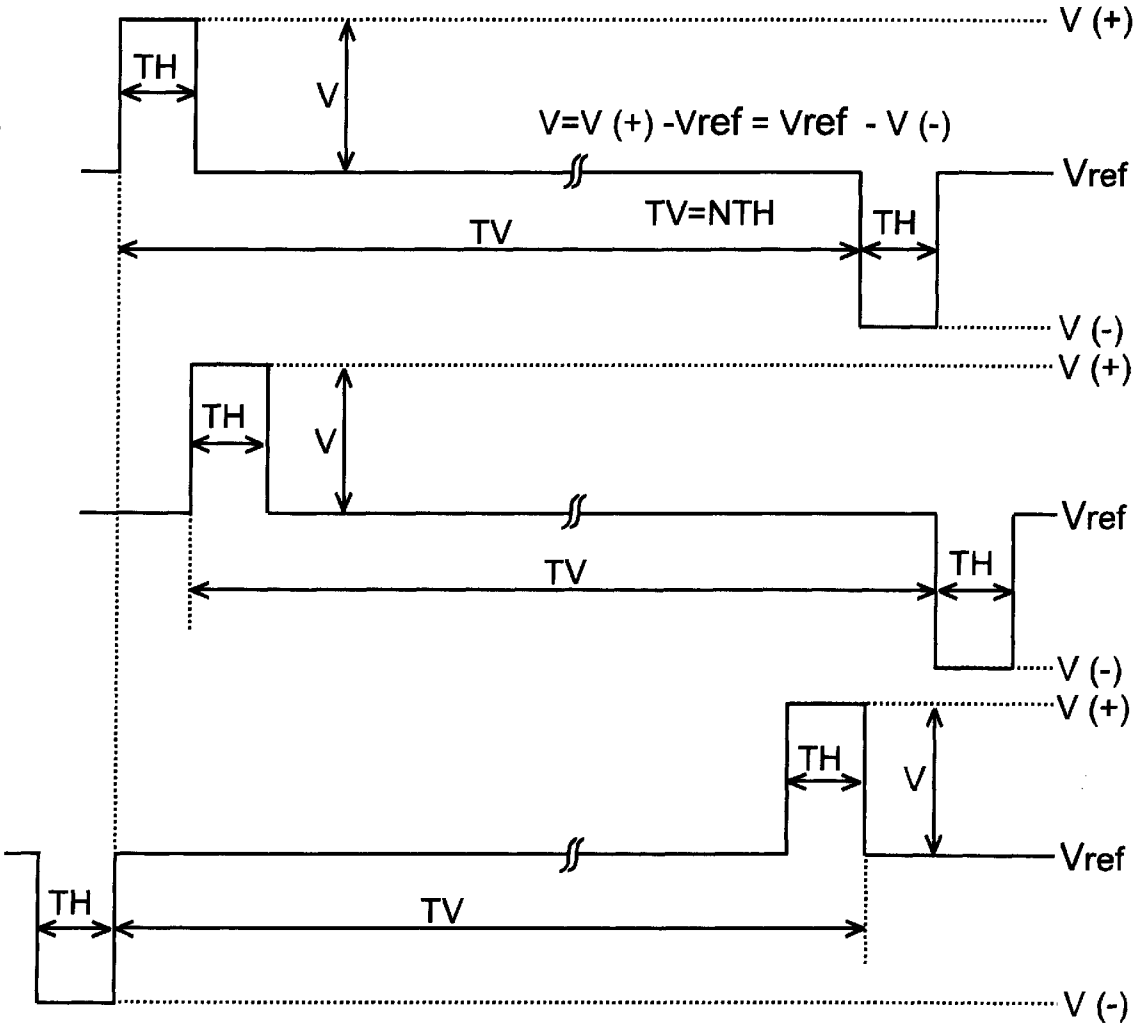
FIG. 3 is an output waveform and its timing chart in scanning line both-end simultaneous driving method in the liquid crystal display device in embodiment 1 of the invention.
Figures 27A, 27B, 27C:
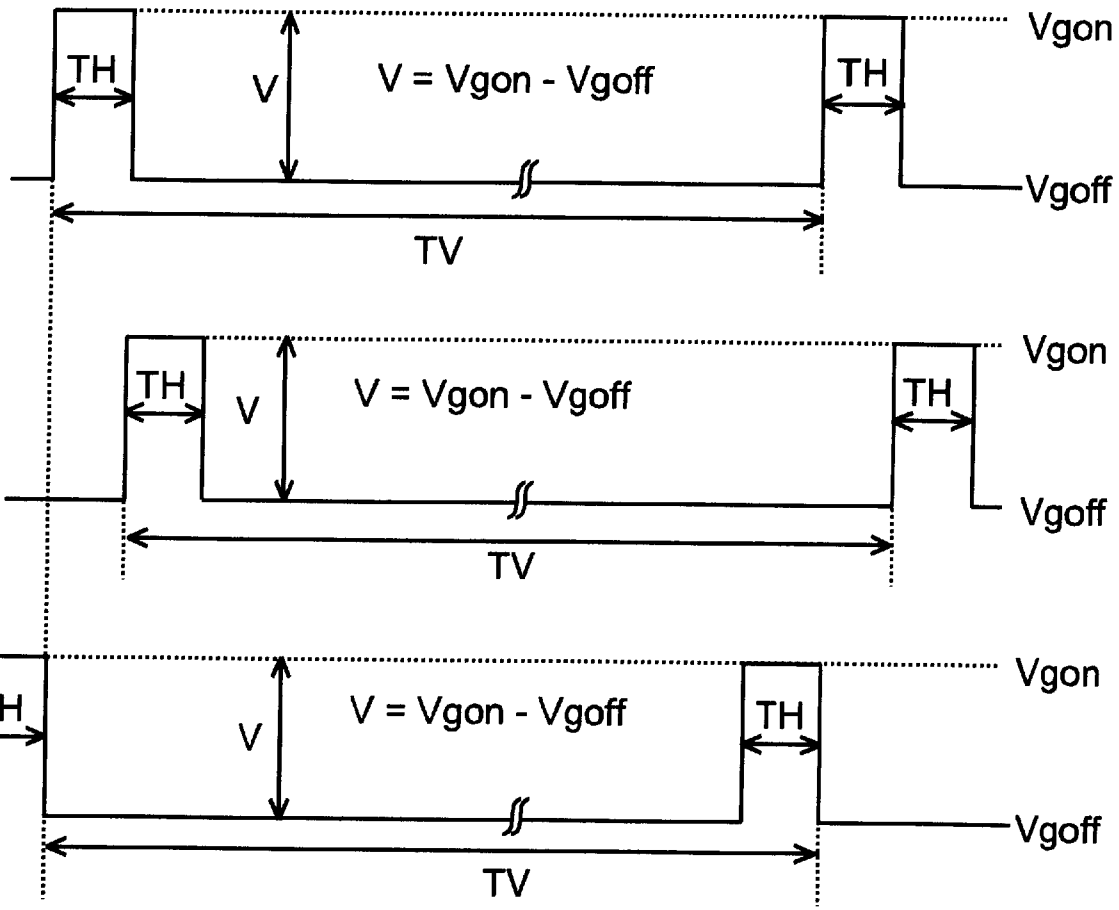
FIG. 27 is a driving voltage waveform and timing chart of scanning lines in embodiment 6.

The driving voltage is generated by combination of voltages V(+), V(−), VH, VL, and Vref in formula (1). FIG. 3 is an output waveform diagram in the case of simultaneous driving of both ends of scanning line by the scanning line left drive circuit 17A and scanning line right drive circuit 17B. The output sections of the right and left scanning line drive circuits 17A and 17B are composed of three analog switches. The output resistance of the three analog switches is supposed to be Ro. The driving voltages V(+), V(−) of the scanning line left drive circuit 17A and scanning line right drive circuit 17B, and the operation reference voltage Vref are exactly same as shown in FIG. 27, and are issued at the same timing, but the scanning directions of the scanning line left drive circuit 17A and scanning line right drive circuit 17B are opposite to each other.

To eliminate this problem, the scanning line left drive circuit 17A scans sequentially from address X1 to XN and from address XN+1 to X2N, and scanning line right drive circuit 17B scans in the reverse direction, from address XN to X1 and from address X2N to XN+1. For this purpose, the control circuit 18 issues a control signal, and controls the scanning in the forward direction of the scanning line left drive circuit 17A and the scanning in the reverse direction of the scanning line right drive circuit 17B, so that the above function is achieved.

This function is realized by providing the shift register in the scanning line drive circuit with a bidirectional property. This function is provided in the majority of available LSIs for scanning line drive circuits. Therefore, for the purpose of scanning line both-end simultaneous driving of the invention, it is not necessary to develop a new LSI exclusively for the scanning line drive circuit. That is, in FIG. 1, the scanning line left drive circuit 17A and scanning line right drive circuit 17B are distinguished, but identical LSIs for scanning line drive circuit can be used.

Figure 7:
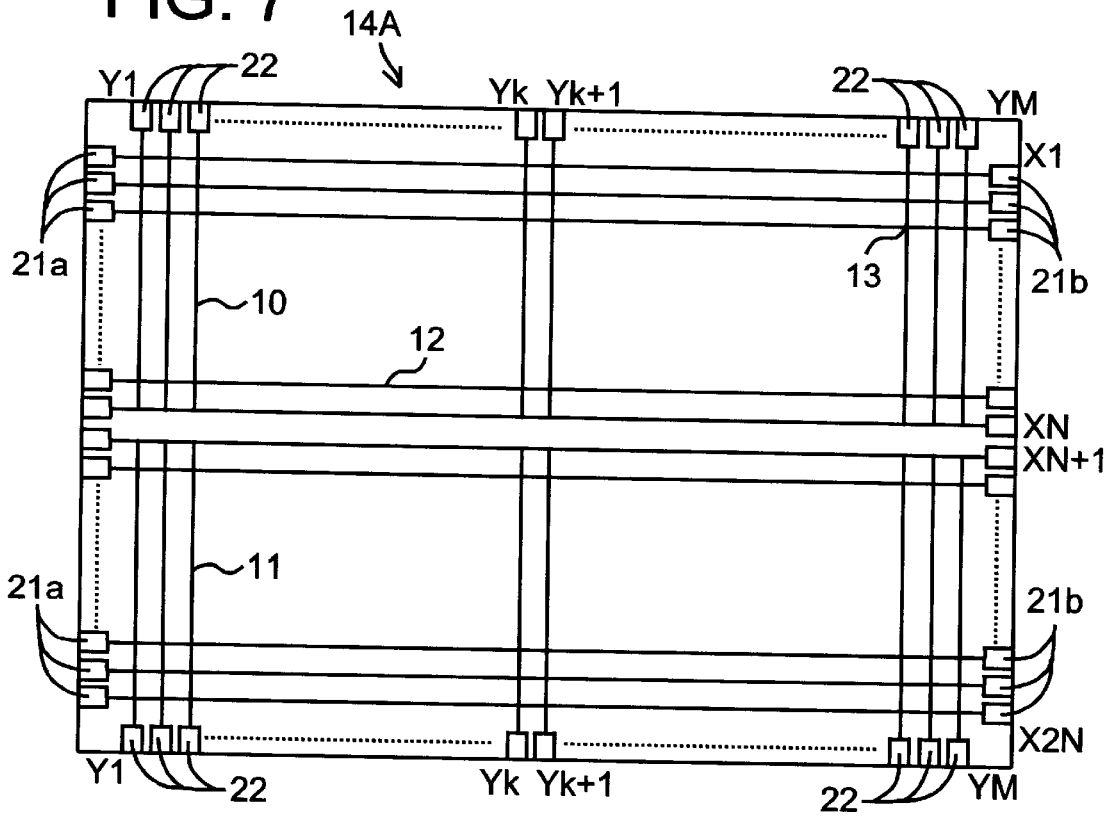
FIG. 7 is a general block diagram of a liquid crystal panel dividing signal lines into upper and lower halves.
Figure 8:
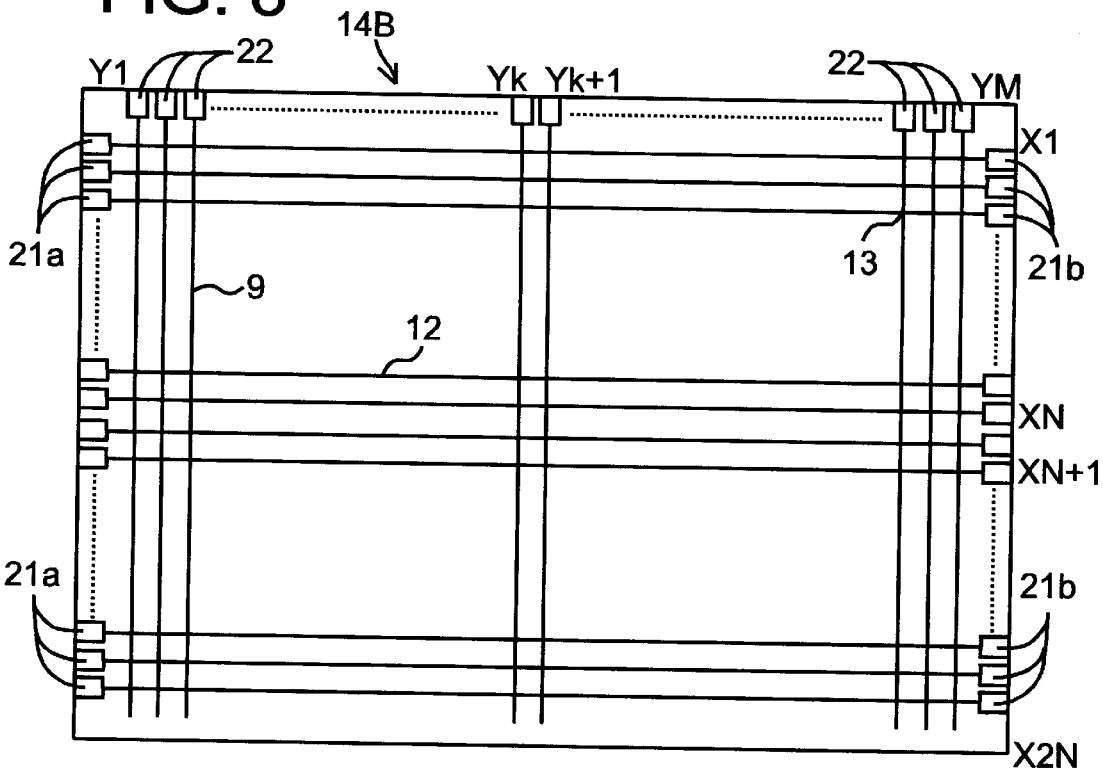
FIG. 8 is a general block diagram of a liquid crystal panel having scanning line both-end driving terminals, with signal line driving terminals disposed at the upper end.
Figure 9:
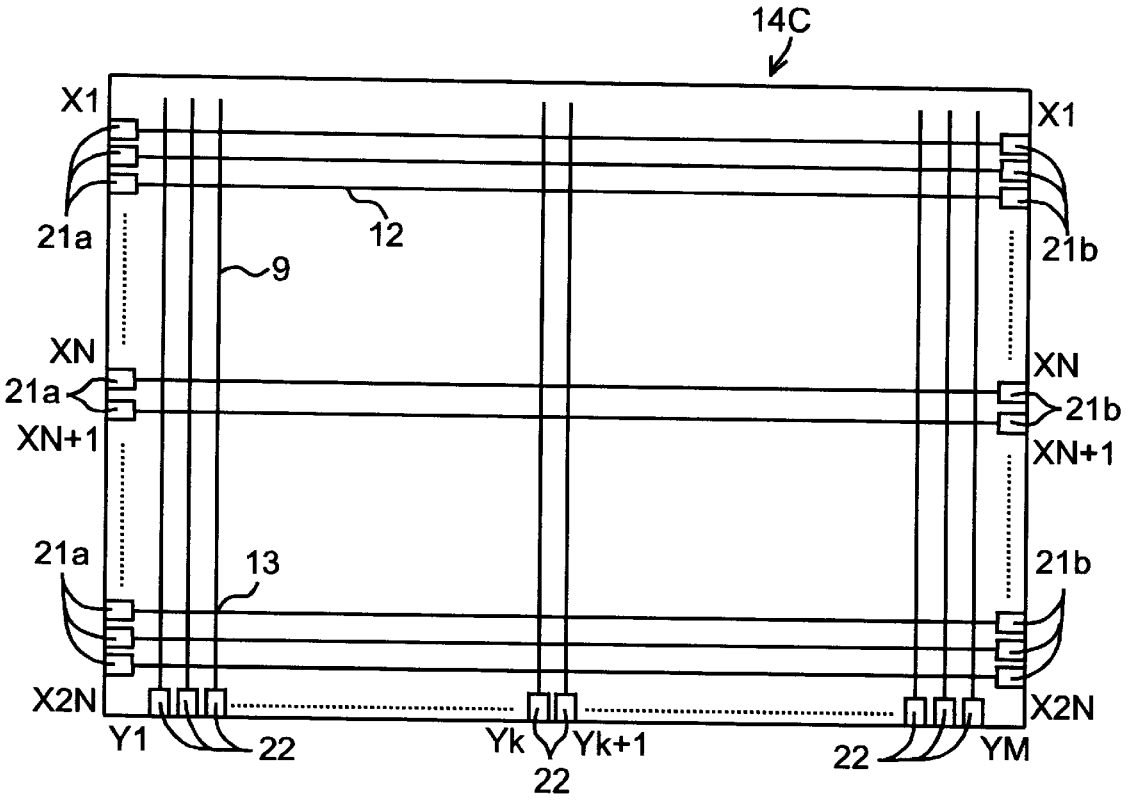
FIG. 9 is a general block diagram of a liquid crystal panel having scanning line both-end driving terminals, with signal line driving terminals disposed at the lower end.

Terminal block diagrams of the liquid crystal panel 14 of the embodiment having terminals for scanning line both-end simultaneous driving are shown in FIGS. 7, 8 and 9. FIG. 7 shows the liquid crystal panel 14A of upper and lower divided driving, and FIGS. 8 and 9 show the patterns of scanning lines and signal lines of the liquid crystal panel not divided into upper and lower halves. The liquid crystal panel 14C in FIG. 9 is a configuration of signal line drive terminals turning upside down the liquid crystal panel 14B. The left side scanning line drive terminal 21*a* and the right side scanning line drive terminal 21*b* mutually have mirror symmetrical patterns. Therefore, the mask pattern of the drive terminal of the liquid crystal panel for scanning line one-end driving may be inverted and added to the terminal end of the scanning line 12, and the mask pattern can be changed easily. The lateral length of the liquid crystal panel is slightly extended as the drive terminal is added, but it is not a problem substantially in the large-screen liquid crystal panel with a diagonal length of 17 inches or the like. The liquid crystal panels 14A, 14B in FIGS. 7, 8, 9 can be manufactured nearly at the same cost as the conventional liquid crystal panel with scanning line one-end driving.

Figure 4A:
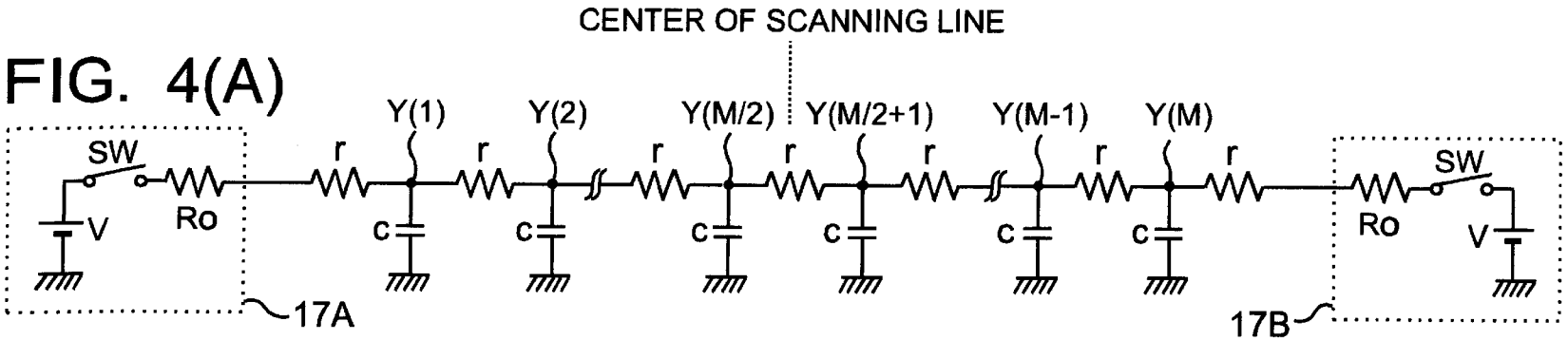
FIGS. 4A–C are distributed parameter circuit diagrams of scanning lines of liquid crystal panel in scanning line both-end simultaneous driving.
Figure 4B:
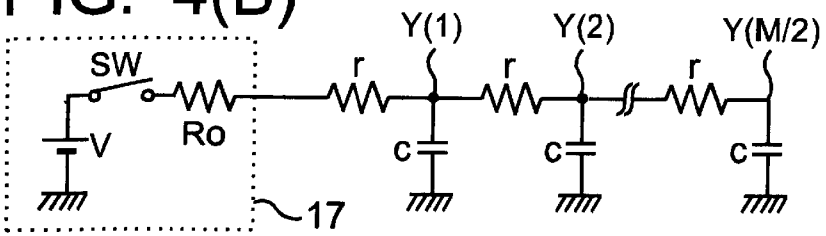
Figure 4C:
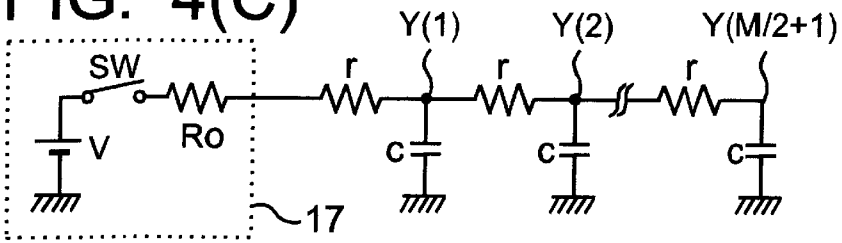

The output waveform and timing of the scanning line drive circuit in scanning line both-end driving are shown in FIG. 3. By upper and lower divided driving, scanning is started simultaneously from scanning lines of address X1 and address XN+1. As shown in FIG. 3, by the scanning line left drive circuit 17A and scanning line right drive circuit 17B, the scanning lines 12 are driven at same driving voltage simultaneously from both ends in every horizontal scanning. Accordingly, the scanning line both-end simultaneous driving can be expressed by the distributed parameter circuit composed of wiring resistance r and pixel capacitance c of scanning lines 12 as shown in FIG. 4(A). In FIG. 4(A), the analog switch incorporated in the right and left scanning line drive circuits is SW, the output resistance is Ro, and the equivalent circuit of the right and left scanning line drive circuits is enclosed by dotted lines. In FIG. 4, notation of Y(1), . . . , Y(M/2) denotes the intersection of an arbitrary scanning line 12 and upper and lower signal lines 10, 11, and, for example, Y(1) represents the intersection of scanning line 12 and signal line 10 of address Y1.

The distributed parameter circuit shown in FIG. 4(A) is symmetrical on both sides of the middle (center) of the scanning line. Therefore, in scanning line both-end simultaneous driving, the terminal voltage of the pixel capacitance c is symmetrical on both sides of the middle as shown in FIG. 4(A), and the capacitor of the pixel capacitance c is charged so that Y(1) and Y(M) may be at the same potential, and that Y(2) and Y(M−1) may be at the same potential, being symmetrical on both sides of the center of the scanning line 12 sequentially from both ends.

In this way, on the basis of the middle of the scanning line 12, the potentials of pixel capacitance c at right and left sides of the scanning line 12 are symmetrical, and therefore the potentials of Y(M/2) and Y(M/2+1) in FIG. 4(A) are exactly identical, and whether these two terminals are short-circuited or separated, no change occurs in the electric characteristic, and hence it may be regarded as an independent circuit. That is, as shown in FIGS. 4(B), (C), separating the scanning line both-end simultaneous driving by dividing the scanning line 12 into two from the center, it may be regarded as one-side driving by the scanning line left drive circuit 17A and scanning line right drive circuit 17B.

In this embodiment, the middle of the scanning line is defined as the virtual terminal end. That is, in FIG. 4(A), Y(M/Y2) and Y(M/2+1) are virtual terminal ends. For two terminals with identical potential electrical characteristics are not changed if they are separated or short-circuited, and hence they may be handled as being independent electrically. Electrically, FIGS. 4(B) and (C) are completely identical with circuit diagrams of one-end driving.

Figure 5:
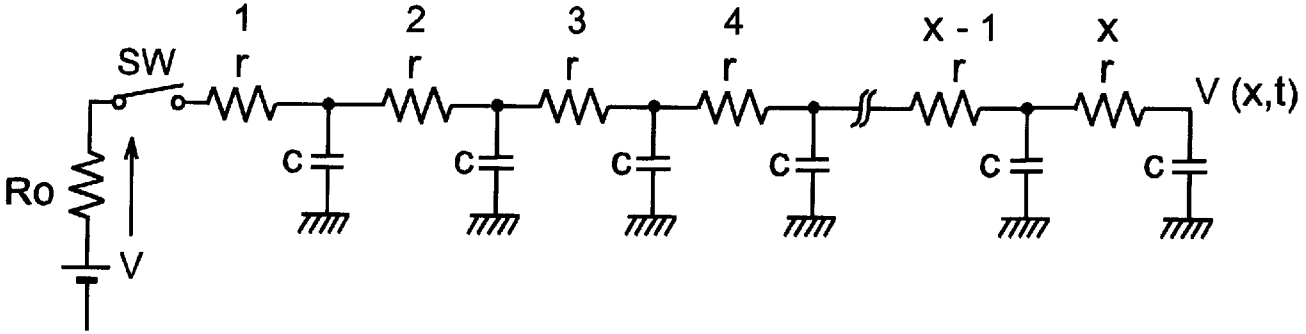
FIG. 5 is a distributed parameter circuit diagram for analyzing transient response of driving voltage of scanning lines of liquid crystal panel.

When the driving voltage at terminal end can be determined accurately, great effects are expected in optimum design of drive circuit, development of new driving method, and improvement of picture quality in liquid crystal display device. In the embodiment, as shown in FIGS. 4(B), (C), by analyzing the scanning line drive as transient phenomenon in the distributed parameter circuit, a driving voltage at virtual terminal end may be obtained. FIG. 5 is a distributed parameter circuit diagram composed of x sets of resistance r and capacitor with capacitance c. In this distributed parameter circuit, when the voltage V (x, t) at terminal end is determined in the condition of open circuit at terminal end and output resistance Ro=0 of drive circuit, formula (8) is obtained. The deriving method of this formula (8) is mentioned in a college lecture course "Elementary electric circuit: transient nonlinear formulas" edited by Japan Society of Telecommunications (pp. 82–90).

$$V(x, t) = V - 4V/\pi \cdot \sum_{k=1}^{\infty} 1(2k-1) \cdot \exp[-\pi^2 \cdot (2k-1)^2 \cdot t/(4r \cdot c \cdot x^2)] \cdot \sin[(2k-1) \cdot \pi/2] \quad (8)$$

where the term of sin function is sin $\{(2k-1)\cdot\pi/2\}$, which is +1 or −1 depending on the value of k. In this condition, when the degree of k increases, the value of cumulative sum of second and larger degree is a smaller value than the value of the first degree. Therefore, the operation of cumulative sum is small in error if determined only at k=1. Hence, concerning the driving voltage of terminal end of scanning line 12, the value of formula (8) is determined assuming k=1. That is, it is approximated by $$V(x, t)=V-[(4V/\pi)\cdot\exp\{-\pi^2\cdot t/(4r\cdot c\cdot x^2)\}]\cdot\alpha$$

(where $\alpha$ is a constant).

By putting the initial condition in this formula, $\alpha$ is obtained. That is, if t=0, then V (M, 0)=0, and hence from $$V(M, 0)=V-(4V/\pi)\alpha=0$$

$\alpha=\pi/4$ is obtained. The formula is transformed into formula (9).

$$V(x, t)=V[1-\exp\{-\pi^2\cdot t/(4r\cdot c\cdot x^2)\}] \text{ where, } x=M \quad (9)$$

Figure 6:
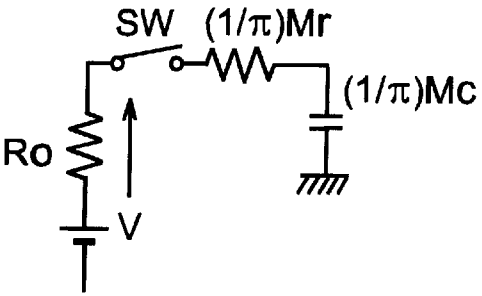
FIG. 6 is a circuit diagram of replacing the distributed parameter circuit of scanning lines of liquid crystal panel with a lumped parameter circuit.

From this formula (9), the equivalent circuit of scanning line 12 in this embodiment is derived. That is, formula (9) expresses an applied voltage of the capacitor in a series circuit composed of resistance of $(2/\pi)\cdot r\cdot x$ and capacitance of $(2/\pi)\cdot c\cdot x$. Therefore, the distributed parameter circuit in FIG. 4(A) can be approximated by a lumped parameter circuit, and the scanning lines 12 can be expressed in an RC series circuit. To apply the distributed parameter circuit in scanning line both-end simultaneous driving in FIG. 4 into formula (9), it is enough to suppose x=M/2. Accordingly, as shown in FIG. 6, scanning line both-end simultaneous driving can be expressed by an equivalent circuit composed of resistance of $M\cdot r/\pi$ and capacitance of $M\cdot c/\pi$.

Incidentally, it can be also expressed in formula (9) if separating the virtual terminal end point of the scanning line is separated physically into right scanning line and left scanning line, and driving the right and left scanning lines simultaneously. That is, in electrical characteristics, it is regarded the same to the scanning line physically divided into two and drive each one end simultaneously at a same driving voltage and to drive simultaneously from both ends of one scanning line, and therefore the scanning line both-end driving includes these two cases hereinafter. It is same for the signal lines.

Now we determine the voltage at the terminal end of the scanning line, when the scanning line driving voltage is changed from Vgn to Vgn+1. Supposing the operation reference voltage to be Vref, in an equivalent circuit composed of resistance of $M\cdot r/\pi$ and capacitance of $M\cdot c/\pi$ in FIG. 6, capacitance of $M\cdot c/\pi$ is not grounded, but is connected to Vref. Assuming the scanning line driving voltage to be changed from Vgn to Vgn+1 at t=0, the terminal end voltage, that is, the voltage V (x, t) at both ends of the capacitor is as shown in formula (9A).

Supposing x=M/2 in the case of scanning line both-end simultaneous driving, or x=M in the case of scanning line one-end driving, $$V(x, t)=(Vgn-Vgn+1)\exp\{-\pi^2\cdot t/(4r\cdot c\cdot x^2+2\pi\cdot Ro\cdot x\cdot c\}+Vgn+1-Vref \quad (9A)$$

Herein, using the symbols shown in FIG. 3, in the case of V(+), since Vgn+1=V(+), Vgn=Vref, V(+)−Vref=V, hence formula (10) is obtained.

Supposing x=M/2 in the case of scanning line both-end simultaneous driving, or x=M in the case of scanning line one-end driving, $$V(x, t)=V[1-\exp\{-\pi^2 t/(4r\cdot c\cdot x^2+2\pi\cdot Ro\cdot x\cdot c\}) \quad (10)$$

Similarly, it is also obtained as for V(−). Actually, V(+) and V(−) do not satisfy formula (1), and there is an error of V(+)+V(−)−2 Vref=Δ, but it is ignored because it is very small as compared with V (0.1 V or less). Formula (9A) is applied when generalizing including the scanning line drive voltage of the TFT liquid crystal panel. Formula (10) is applied in the case of simple matrix type.

Figure 51A:
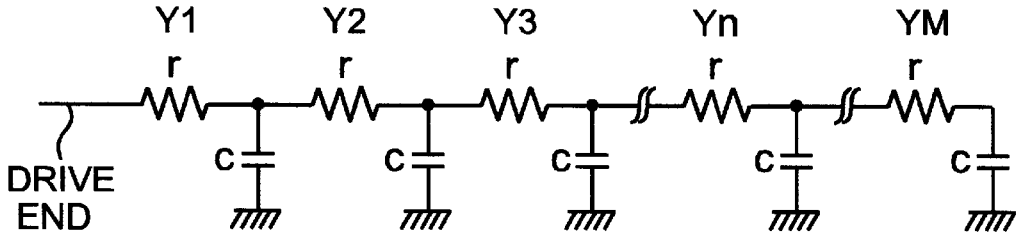
FIGS. 51A–B are equivalent circuit diagrams of scanning line driving in the liquid crystal display device in the prior art.
Figure 51B:
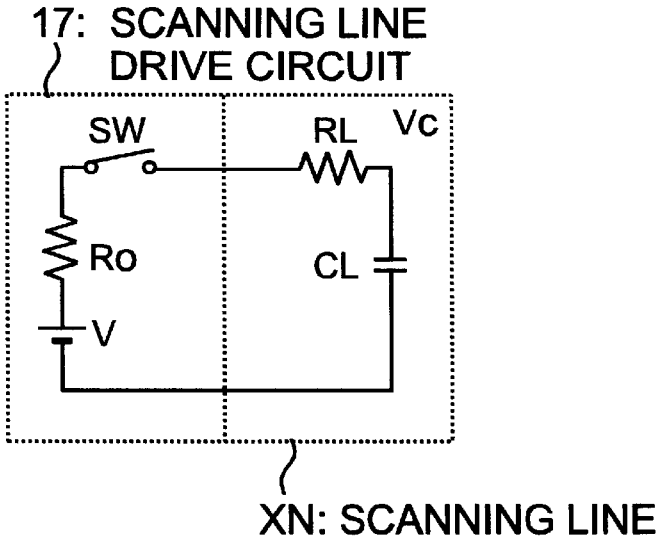

As for the conventional scanning line one-end driving, the driving voltage is obtained from formulas (9), (10), supposing x=M in formula (8), and the scanning line 12 can be expressed by the RC series circuit composed of resistance of $(2/\pi)\cdot M\cdot r$ and capacitance of $(2/\pi)\cdot M\cdot c$. The capacitance value and resistance value of the conventional equivalent circuit of scanning lines shown in FIG. 51(B) are $(\pi/2)$ times as shown in the equivalent circuit in FIG. 6, and it is understood why the result of the conventional analysis does not coincide with the measured value.

In scanning line one-end driving, the time constant of the 17-inch liquid crystal panel obtained from measurement of rise time of driving voltage at terminal end is 2.0 $\mu$s. The time constant of the 17-inch liquid crystal panel calculated from formula (10) is 1.99 $\mu$s. Considering the measuring error, the result of calculation by the equivalent circuit in FIG. 6 and the measured value coincide very well with each other.

Figure 10:
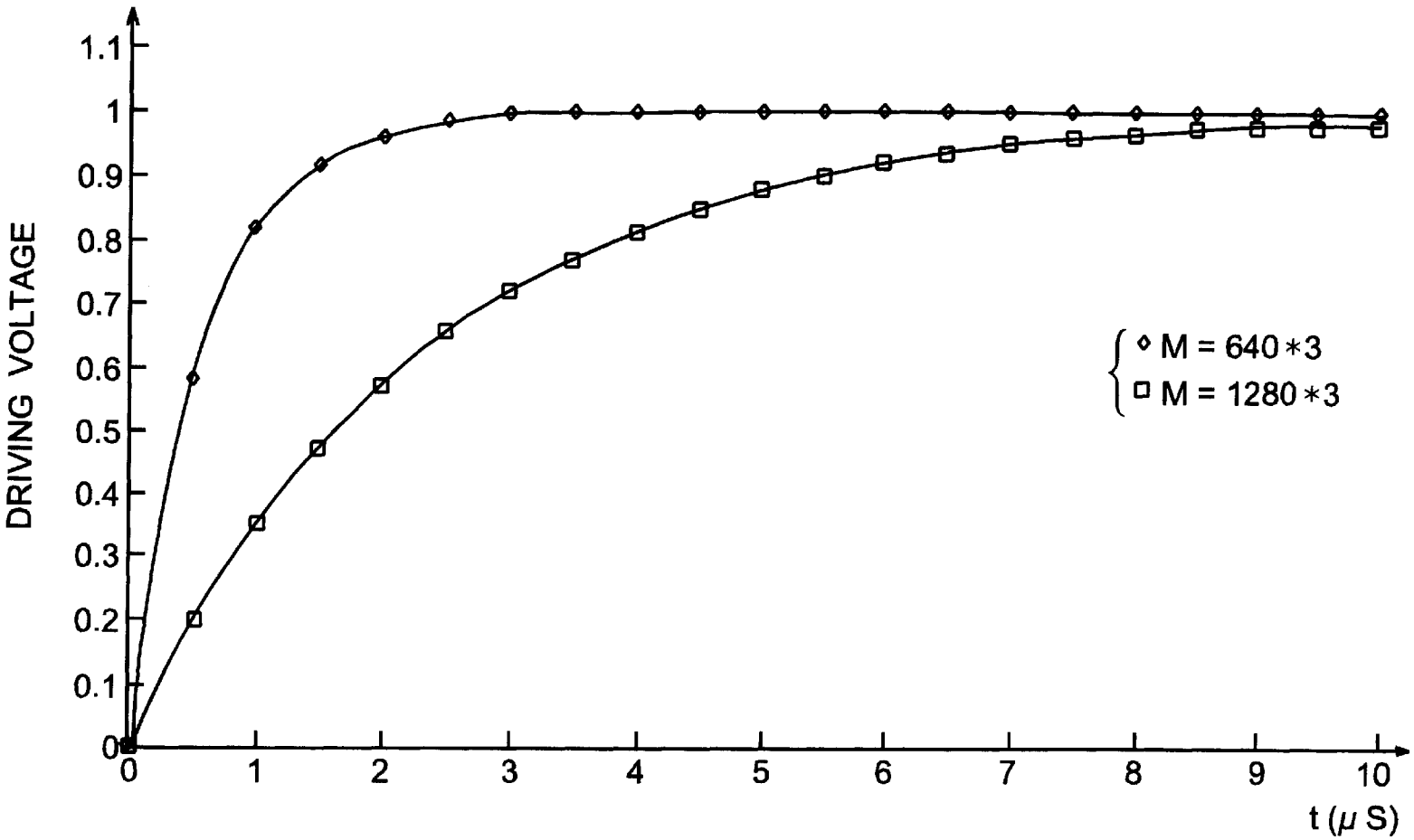
FIG. 10 is an explanatory diagram showing transient response of scanning line driving voltage of a 17-inch liquid crystal panel.

In this embodiment, at the pixel 13 at terminal end or virtual terminal end of scanning line 12, the scanning line driving voltage is approximately shown in formula (10). At the same time, the scanning line driving voltage of the 17-inch liquid crystal panel at an arbitrary address x of the signal line obtained from formula (8) is determined by numerical calculation. In this case, the number of k of cumulative addition of formula (8) should be as large as possible, and the change of the term of sin function in a range of −1 to +1 depending on the value of k must be incorporated into the operation. The result is shown in FIG. 10. In FIG. 10, the curve of M=640×3 denotes the delay time of scanning line both-end driving (rise characteristic of scanning pulse), and the curve of M=1280×3 expresses the delay time of driving voltage at terminal end of scanning line one-end driving. At the scanning lines 12 identical in the number of pixels, it is known that the delay time is smaller in both-end driving.

Thus, the time constant $\tau$1 in scanning line both-end simultaneous driving of an arbitrary scanning line 12 is $(M\cdot r/\pi)\cdot(M\cdot c/\pi)$, and the time constant $\tau$2 in scanning line one-end driving is $[(2M\cdot r/\pi)\cdot(2M\cdot c/\pi)]$. Approximately, $\tau$2/$\tau$1 is 4, and the delay time of scanning line both-end simultaneous driving is found to be ¼ that of scanning line one-end driving. This is extremely important in scanning line driving. The wiring resistance r of the liquid crystal panel 14 is always present, and the picture quality of the liquid crystal display device deteriorates due to occurrence of lateral luminance error. The larger the screen, the bigger the lateral luminance error. In the liquid crystal panel 14 of matrix composition, it is impossible to nullify the wiring resistance of scanning lines, and in this sense the scanning line driving method in the embodiment capable of decreasing the lateral luminance error is important.

Referring now to the equivalent circuit in FIG. 6, driving current in scanning line both-end simultaneous driving is analyzed. First, the scanning line driving current is determined. From formula (7), the individual scanning line driving currents of scanning line left drive circuit 17A and scanning line right drive circuit 17B in scanning line both-end simultaneous driving are as follows.

$$\text{As for } V(+),\ 2N\cdot M\cdot c(V(+)-VL)/(\pi\cdot TV)$$

$$\text{As for } V(-),\ 2N\cdot M\cdot c(V(-)-VH)/(\pi\cdot TV) \tag{11}$$

Similarly, the driving current of scanning line one-end driving can be determined, and the same value as in scanning line both-end simultaneous driving is obtained. However, the driving current of right and left scanning line drive circuits in scanning line both-end simultaneous driving is half that of scanning line one-end driving.

As mentioned above, the scanning line left drive circuit 17A and scanning line right drive circuit 17B are composed of same LSI, but the leak current of output circuit is extremely small. Accordingly, the driving current can be determined by measuring the current at input terminal of driving voltage of scanning line left drive circuit 17A and scanning line right drive circuit 17B. The current measured at the input terminal when driven at one side by detaching either one of scanning line left drive circuit 17A and scanning line right drive circuit 17B in FIG. 1, and the current measured at the input terminal when driven by scanning line both-end simultaneous driving were proved to be nearly equal. This is evidence that the equivalent circuit used in this embodiment is adequate. Results of calculation of scanning line driving current in formula (11) are mentioned later a By the equivalent circuit in FIG. 6, the effective voltage Vecl of pixel 13 at drive end of scanning line 12, effective voltage Vecn of pixel 13 at virtual terminal end, and effective voltage Vecm of pixel 13 at terminal end in scanning line one-end driving are obtained in the same deriving method as in formulas (5) and (6), of which results are expressed in formula (12).

Vecl $$[\{V^2\cdot(1+1/a)^2N\}\{(1-1.5Ro\cdot c/(2\pi\cdot TH)\}+\{(N-1)/N\}(V/a)^2]^{(1/2)}$$

Vecn $$[\{V^2\cdot(1+1/a)^2N\}\times\{1-1.5(M\cdot r+\pi\cdot Ro)\cdot M\cdot c/(\pi^2\cdot TH)+\{(N-1)/N\}\cdot(V/a)^2\}]^{(1/2)}$$

Vecm $$[\{V^2\cdot(1+1/a)^2/N\}\times\{1-3(2M\cdot r+\pi\cdot Ro)\cdot M\cdot c/(\pi^2\cdot TH)\}+\{(N-1)/N\}\cdot(V/a)^2\}]^{(1/2)} \tag{12}$$

The effective voltage ratio γ1 at virtual terminal end and at drive end, and effective voltage ratio γ2 at terminal end and at drive end in scanning line one-end driving are expressed in formula (13)

$$\gamma\mathbf{1}=Vecn/Vecl\ [1-1.5(M\cdot r+\pi\cdot Ro)\cdot M\cdot c/(\pi^2\cdot TH)\cdot a^2/(a^2+N-1)]^{(1/2)}$$

$$\gamma\mathbf{2}=Vecm/Vecl\ [1-3(2M\cdot r+\pi\cdot Ro)\cdot M\cdot c/(\pi^2TH)\cdot a^2/(a^2+N-1)]^{(1/2)} \tag{13}$$

From formulas (12) and (13), the lateral luminance error in scanning line both-end simultaneous driving is known to be about ¼ that of scanning line one-side driving, and the scanning line both-end driving method of the embodiment is proved to be excellent.

The lateral luminance error (expressed by effective voltage difference), effective voltage Ve, and voltage ratio γ determined in the condition of Ro=0 from formulas (12) and (13), and the scanning line driving current determined in the condition of VH=−VL=2.1 V from formula (11) are explained below in the cases of scanning line both-end simultaneous driving and scanning line one-end driving.

In this case, the liquid crystal display device was calculated at the diagonal length of 12.1, 17, 20, and 24.2 inches.

(Calculation 2)

Hereinafter, figures in parentheses refer to the lateral luminance error in scanning line one-end driving.

(1) 12.1-inch Liquid Crystal Display Device
Lateral luminance error=(30.7 mV)
One-end driving voltage ratio γ2=0.9899
Drive end voltage Vecl=2.82V
Scanning line driving current=0.9 mA (measured value=1.0 mA)
Condition
(Mr/π)(Mc/π)=0.23 μS, TH=27.8 μS
TV=8.34 mS, N=300, M=800×3, a=14.5
V=30.5V, c=0.26 pF, r=1.5Ω, rs=4.5Ω

(2) 17-inch Liquid Crystal Display Device
Lateral luminance error=9.6 mV (38.7 mV)
Both-end driving voltage ratio γ1=0.9963
Drive end voltage Vecl=2.60V
One-end driving voltage ratio γ2=0.9851
Scanning line driving current=1.11 mA (measured value=1.0 mA)
Condition
(Mr/π)(Mc/π)=0.426 μS, TH=28 μS
TV=14.34 mS, N=512, M=1280×3, a=15.5
V=32.5V, c=0.19 pF, r=1.5Ω, rs=4.50Ω

(3) 20-inch Liquid Crystal Display Device
Lateral luminance error=17.7 mV (71.5 mV)
Both-end driving voltage ratio γ1=0.9932
Drive end voltage Vecl=2.60V
One-end driving voltage ratio γ2=0.9725
Scanning line driving current=1.91 mA
Condition
(Mr/π)(Mc/π)=0.753 μS, TH=23.8 μS
TV=14.34 mS, N=600, M=1600×3, a=15.5
V=32.5V, c=0.215 pF, r=1.5Ω, rs=4.50Ω

(4) 24.2-inch Liquid Crystal Display Device
Lateral luminance error =21.6 mV (87.4 mV)
Both-end driving voltage ratio γ1=0.9917
Drive end voltage Vecl=2.60V
One-end driving voltage ratio γ1=0.9664
Scanning line driving current=2.31 mA
Condition
(Mr/π)(Mc/π)=0.911 μS, TH=23.8 μS
TV=14.34 mS, N=600, M=1600×3, a=15.5
V=32.5V, c=0.26 pF, r=1.5Ω, rs=4.5Ω

It is shown from the calculation that the lateral luminance error can be ignored in the 17-inch liquid crystal display device. In the 17-inch liquid crystal display device in scanning line both-end simultaneous driving method, since the lateral luminance error cannot be distinguished visually, the result of calculation coincides very well with the measured value. In the 20- and 24.2-inch liquid crystal display devices, the lateral luminance error can be visually distinguished, but practically it may be considered to be free from problems. Thus, considering from the coincidence between the calculated value and visual observation, the equivalent circuit in FIG. 6 is known to be suited for analysis of scanning line drive. Moreover, in the 17-inch liquid crystal display device, lateral crosstalk in scanning line both-end simultaneous driving is confirmed to be extremely small as compared with scanning line one-end driving. Since the lateral crosstalk is caused by waveform distortion due to delay in scanning line driving voltage, the both-end driving of which delay time is about ¼ of one-end driving is an extremely excellent method also for reducing the lateral crosstalk.

Figure 11:
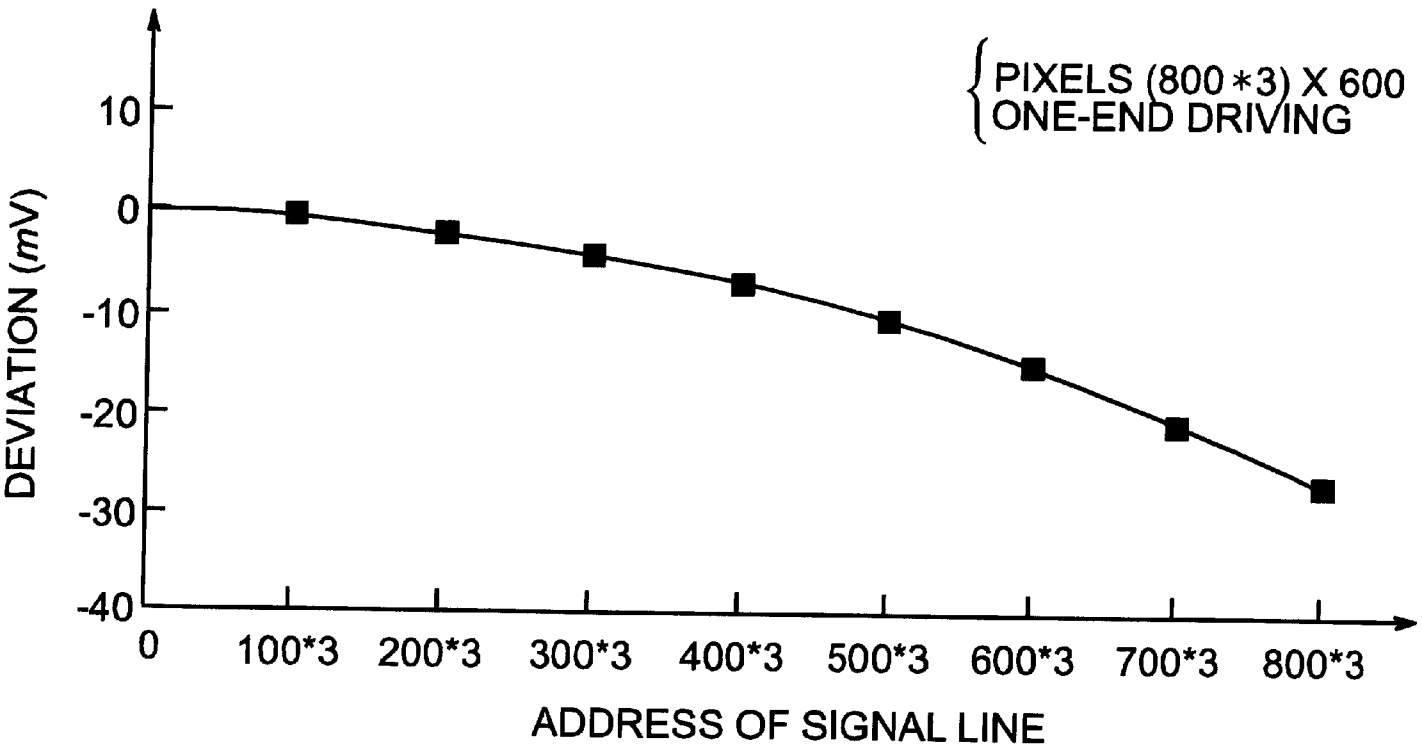
FIG. 11 is an explanatory diagram showing lateral luminance error in one-end driving in a 12.1-inch liquid crystal display device.
Figure 12:
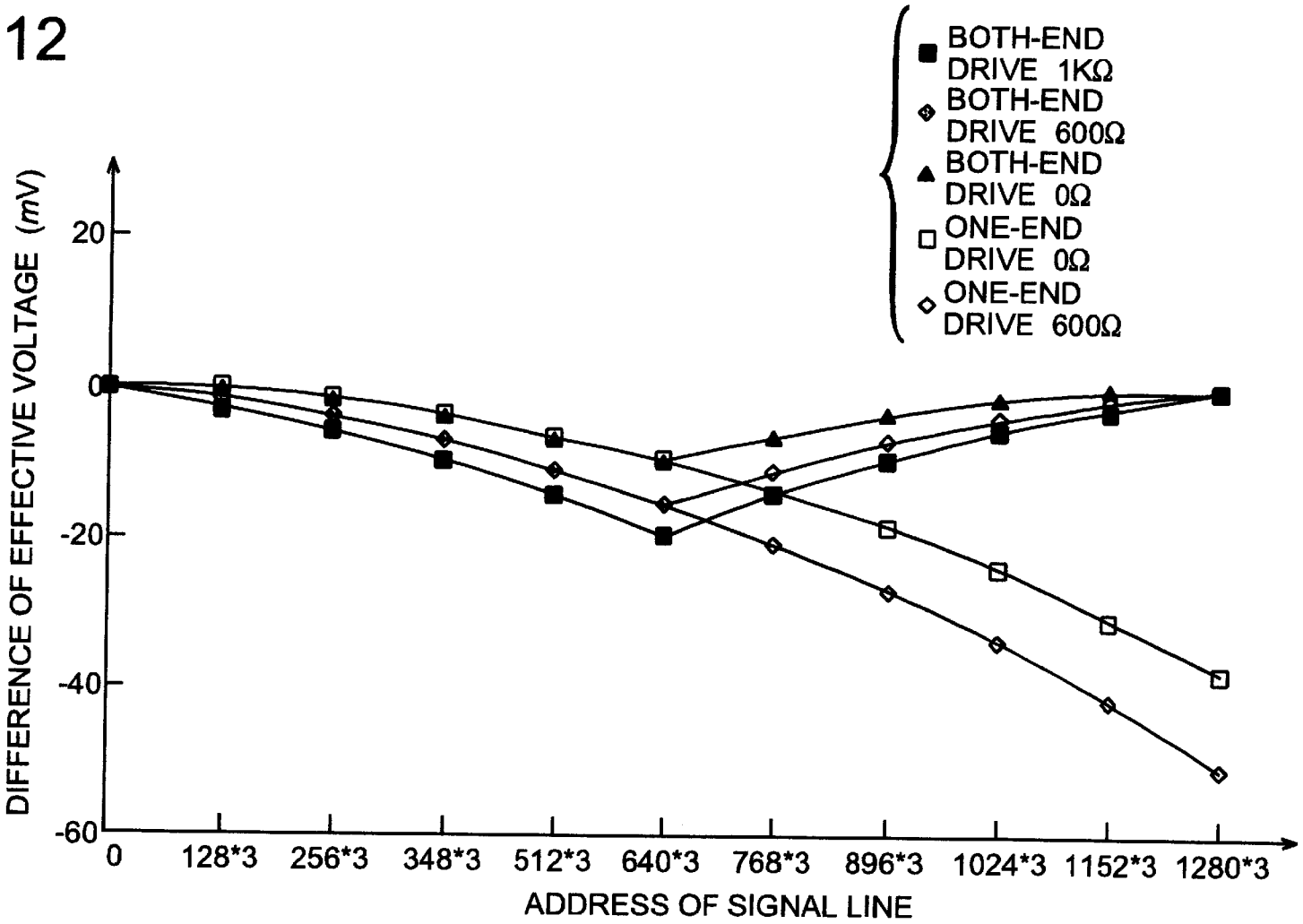
FIG. 12 is an explanatory diagram showing lateral luminance error in a 17-inch liquid crystal display device.
Figure 13:
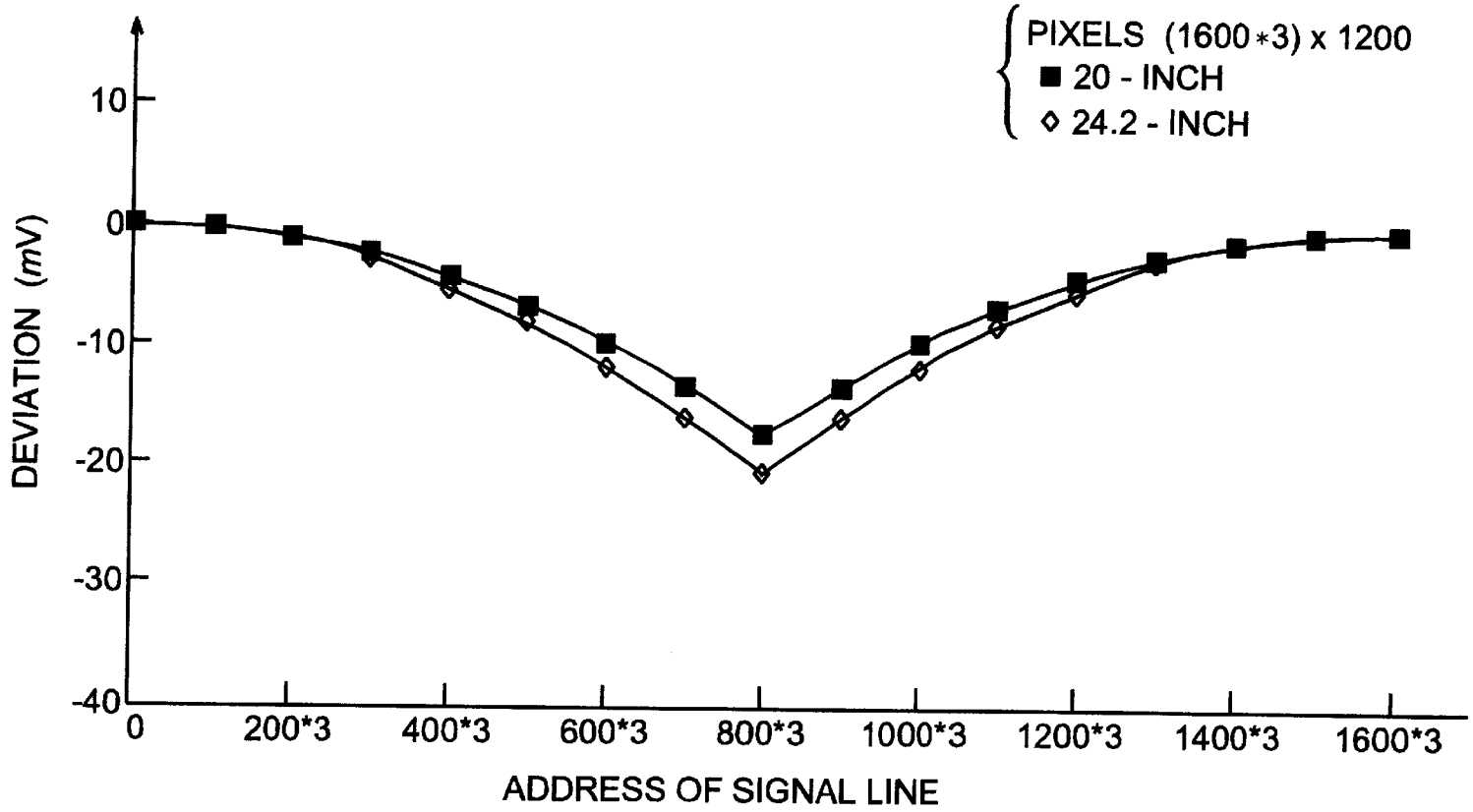
FIG. 13 is an explanatory diagram showing lateral luminance error in a 20- or 24.4-inch liquid crystal display device.

The lateral luminance error along the address of signal line calculated by formula (8) is shown in FIGS. 11, 12 and 13. FIG. 11 shows the lateral luminance error in scanning line one-end driving determined in the condition of Ro=0 ohm in the 12.1-inch liquid crystal display device. FIG. 12, relating to the 17-inch liquid crystal display device, shows the lateral luminance error in scanning line both-end simultaneous driving determined in the condition of Ro=0 ohm, 600 ohms, and 1 kohm, and the lateral luminance error in scanning line one-end driving determined in the condition of Ro=0 ohm and 600 ohms. FIG. 13, relating to the 20- and 24.2-inch liquid crystal display devices, shows the lateral luminance error in scanning line both-end simultaneous driving determined in the condition of Ro=0 ohm. Herein, the output resistance Ro refers to the output resistance of an analog switch delivering an output of V(+) or V(−).

FIG. 12 more clearly proves the superiority of scanning line both-end simultaneous driving. Results of visual observation and results of driving analysis in FIGS. 11 to 13 coincide very well with each other. In particular, in the case of a large liquid crystal panel such as 20 or 24.2 inches, it is obviously shows that the practical problem of lateral luminance error can be solved by employing the scanning line both-end simultaneous driving. Moreover, formula (8) agrees with the visual observation as the formula for expressing the driving voltage of an arbitrary pixel from the drive end to the terminal end or virtual terminal end, and hence the conformity of this formula is supported. Thus, accurate simulation of scanning line driving is realized.

In the above calculation 2, the output resistance Ro of the scanning line drive circuit was assumed to be 0. This is for the sake of simplicity of calculation, and the actual output resistance is not Ro=0. By formula (14) derived from formula (13), appropriate output resistance Rgw of both-end driving of scanning line drive circuit and output resistance Rgs of one-end driving can be determined.

$$Rgw \leqq \{1-(\gamma\mathbf{1})^2\}\cdot(\pi\cdot TH)/(1.5M\cdot c)\cdot(a^2+N-1)/a^2-M\cdot r/\pi$$
$$Rgs \leqq \{1-(\gamma\mathbf{2})^2\}\cdot(\pi\cdot TH)/(3M\cdot c)\cdot(a^2+N-1)/a^2-2M\cdot r/\pi \quad (14)$$

By using formula (14), an appropriate output resistance required in the scanning line drive circuit can be easily obtained. According to formula (14), in scanning line both-end simultaneous driving, in the condition of $\gamma\mathbf{1}=\gamma\mathbf{2}$, the output resistance of scanning line drive circuit can be about 2 times that of scanning line one-end driving. Furthermore, ITO is often used to connect the drive circuit with the scanning line drive terminal. Since the ITO is high in specific resistance, the wiring resistance cannot be ignored. In formula (14) of the invention, the output resistance may be regarded as sum of the wiring resistance of ITO and output resistance of the drive circuit. Therefore, once the output resistance of the drive circuit is determined, an appropriate range of wiring resistance of ITO is obtained, so that the pattern design of liquid crystal panel may be appropriate and easy. Thus, the invention may be applied in a wide range.

Since the output resistance of the scanning line drive circuit can be increased, the chip size of the LSI for composing the scanning line drive circuit can be reduced, and the LSI cost can be lowered. The chip size of LSI is determined by the demanded output resistance, and the smaller the demanded output resistance, the larger is the chip size. Thus, in scanning line both-end simultaneous driving, since the chip size of the LSI for composing the scanning line drive circuit is reduced, the LSI cost is lower.

(Embodiment 2)

Figure 14:
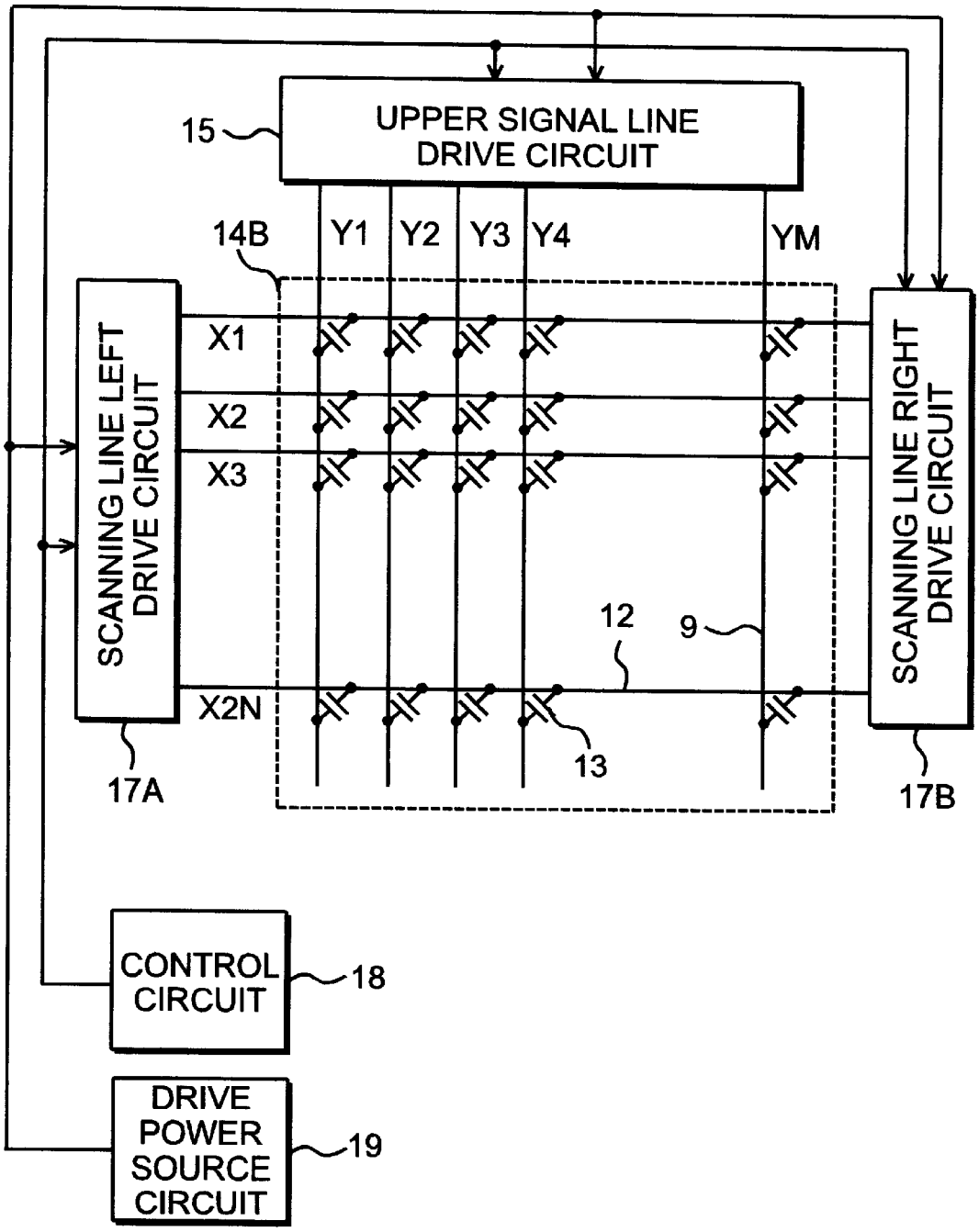
FIG. 14 is a block diagram of a liquid crystal display device in embodiment 2 of the invention.

A liquid crystal display device in embodiment 2 of the invention is briefly described below. FIG. 14 is a block diagram of the liquid crystal display device of this embodiment. Same parts as in the liquid crystal display device in FIG. 1 are identified with same reference numerals, and their explanation is omitted. In this liquid crystal display device, the signal line 9 of the liquid crystal display panel 14B is not divided into upper and lower halves, but the scanning line of the liquid crystal panel 14B is driven simultaneously at both ends. In such constitution, too, the same effects as in embodiment 1 are obtained.

(Embodiment 3)

Figure 15:
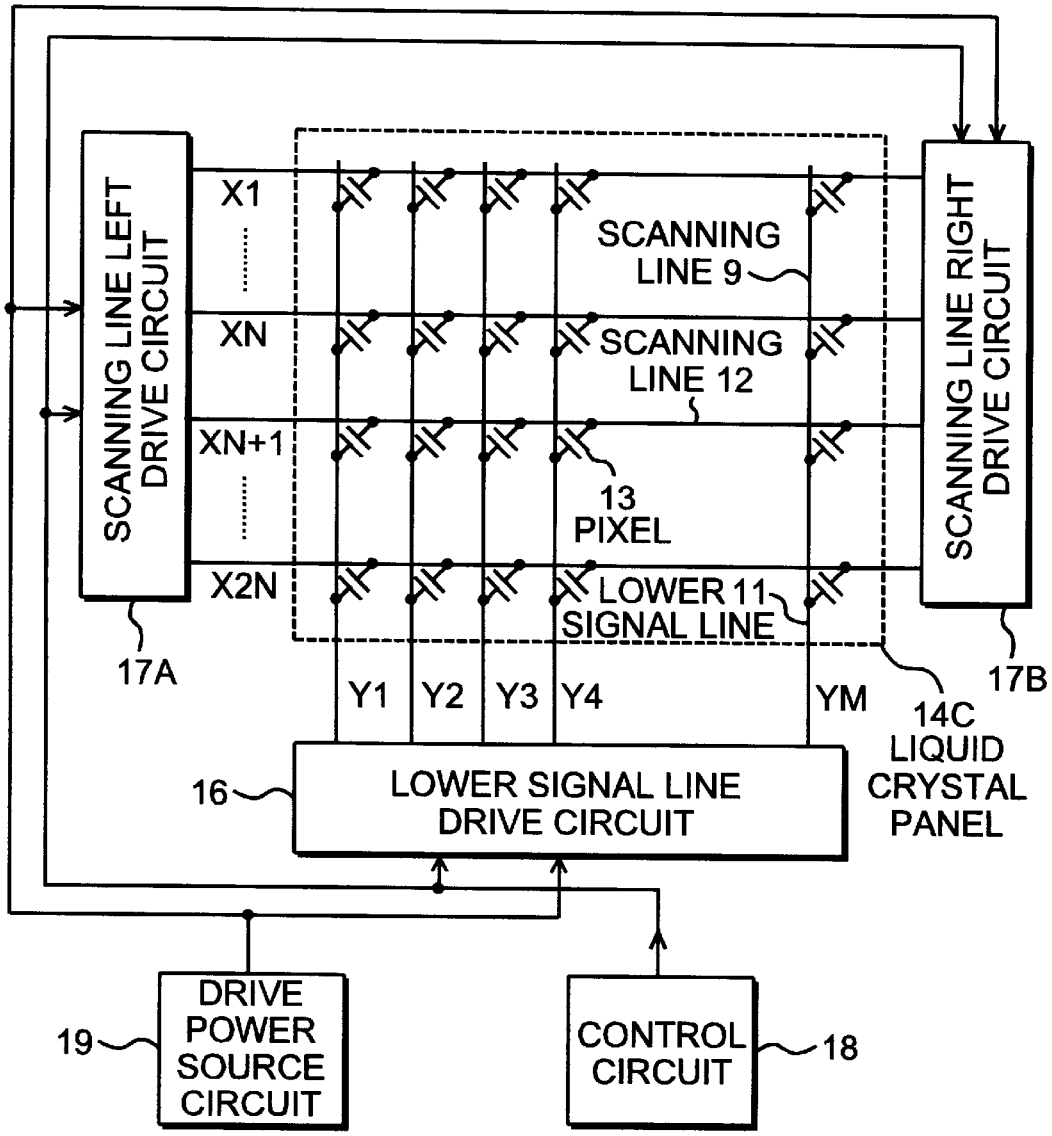
FIG. 15 is a block diagram of a liquid crystal display device in embodiment 3 of the invention.

A liquid crystal display device in embodiment 3 of the invention is briefly described below. FIG. 15 is a block diagram of the liquid crystal display device of this embodiment. Same parts as in the liquid crystal display device in FIG. 1 are identified with same reference numerals, and their explanation is omitted. In this liquid crystal display device, the signal line drive terminal of the liquid crystal panel 14 in FIG. 14 is disposed upside down, and the scanning line of the liquid crystal panel 14C is driven simultaneously at both ends. In such constitution, too, the same effects as in embodiment 1 are obtained.

(Embodiment 4)

Figure 16:
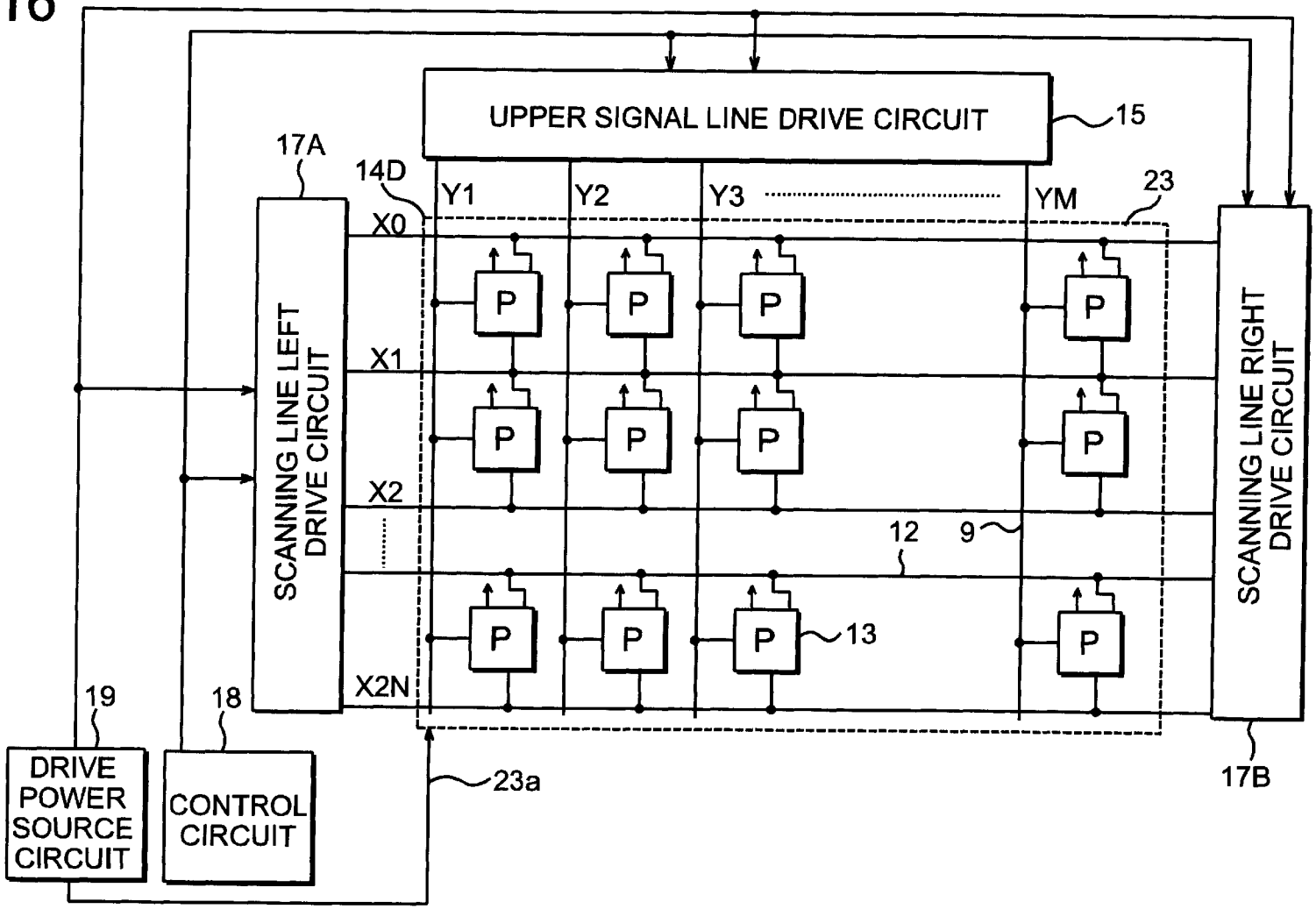
FIG. 16 is a block diagram of a liquid crystal display device in embodiment 4 of the invention.

A liquid crystal display device in embodiment 4 of the invention is briefly described below. FIG. 16 is a block diagram of the liquid crystal display device of this embodiment. Same parts as in the liquid crystal display device in FIG. 1 are identified with same reference numerals, and their explanation is omitted. Each pixel 13 of the liquid crystal panel 14D in this embodiment is composed of a switching element of thin film transistor (TFT), and a liquid crystal cell. This liquid crystal panel 14D has undivided signal lines 9 and (2N+1) scanning lines 12, and both ends of the scanning lines 12 are driven simultaneously.

In FIG. 16, an element P at the intersection of a signal line 9 and a scanning line 12 includes a TFT which drives the liquid crystal cell. A counter electrode 23 indicated by broken line is an electrode for applying an operation reference voltage of the TFT type liquid crystal panel 14D, and a terminal 23*a* is provided in a part thereof. From a drive power source circuit 19B, a voltage Vcom is applied to the counter electrode 23 through the terminal 23*a*.

Figure 17:
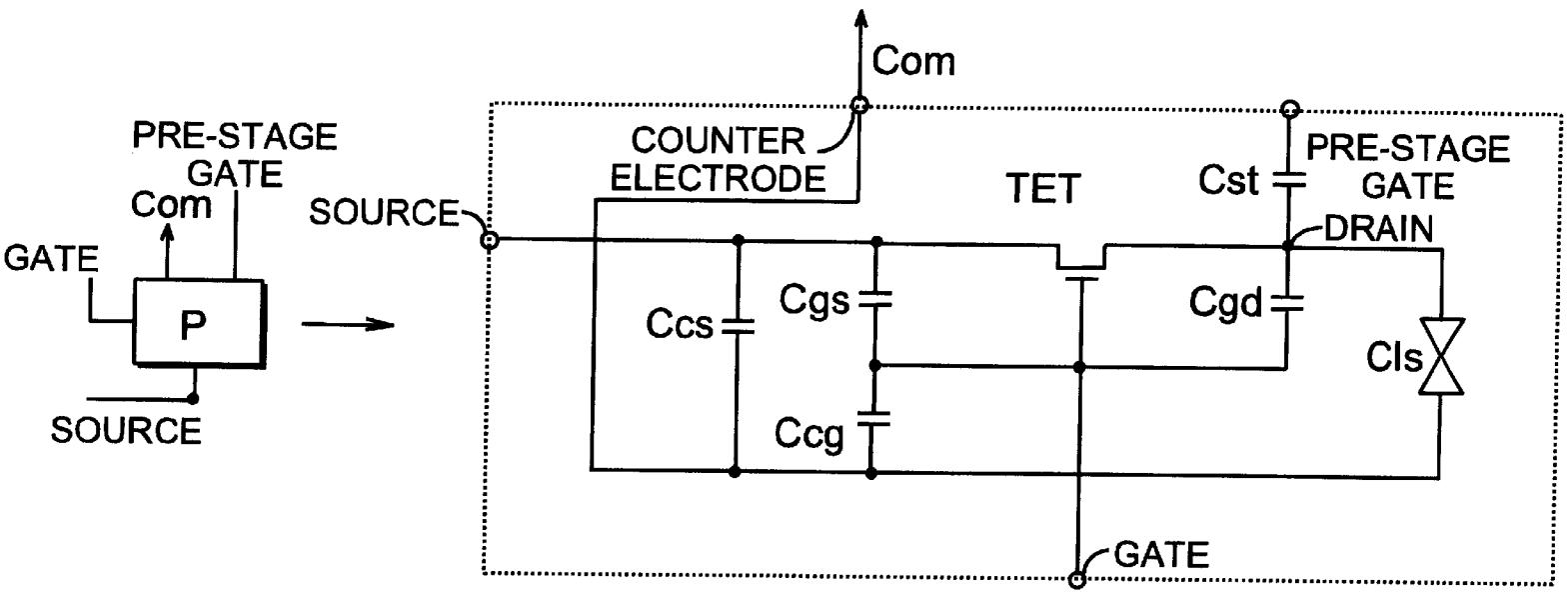
FIG. 17 is a block diagram of pixels in a TFT liquid crystal panel in embodiment 4.

The element P (also called pixel 13) is expressed in an equivalent circuit including a TFT as shown in FIG. 17. The pixel 13 is expressed by circuit element, such as TFT, liquid crystal cell (capacitance Cls), capacitance Cgd between drain and gate of TFT, capacitance Ccs between TFT source and liquid crystal cell, capacitance Cgs between source and gate of TFT, capacitance Ccg between TFT gate and liquid crystal cell, and capacitance Cst between TFT drain and pre-stage gate.

The capacitance Cls is a capacitance of the liquid crystal cell formed between the TFT drain electrode and counter electrode. The source electrode is connected to the signal line 9, and the gate electrode is connected to the scanning line 12. In thus constituted pixel 13, supposing the capacitance between the scanning line 12 and counter electrode 23 to be c, the capacitance c is expressed in formula (17).

$$c=Ccg+Cst\cdot Cls/(Cst+Cls)+Cgd\cdot Cls/(Cgd+Cls)+CGS\cdot Ccs/(Cgd+Cls) \quad (17)$$

In FIG. 16, the pixel 13 at the intersection of XN scanning line 12 and YN signal line 9 is expressed as (XN, YN). The drain of the TFT at (XN, YN) is coupled to the gate of the TFT at (XN−1, YN) capacitance Cst. The TFT thus constituted is called the TFT of pre-stage capacitive coupling type. FIG. 16 shows the constitution of the TFT type liquid crystal panel 14C of this pre-stage capacitive coupling type. In other TFT, the drain of the TFT at (XN, YN) is coupled to the gate of the TFT at (XN+1, YN) capacitance Cst. This is called the TFT of post-stage capacitive coupling type.

Figures 18A, 18B, 18C:
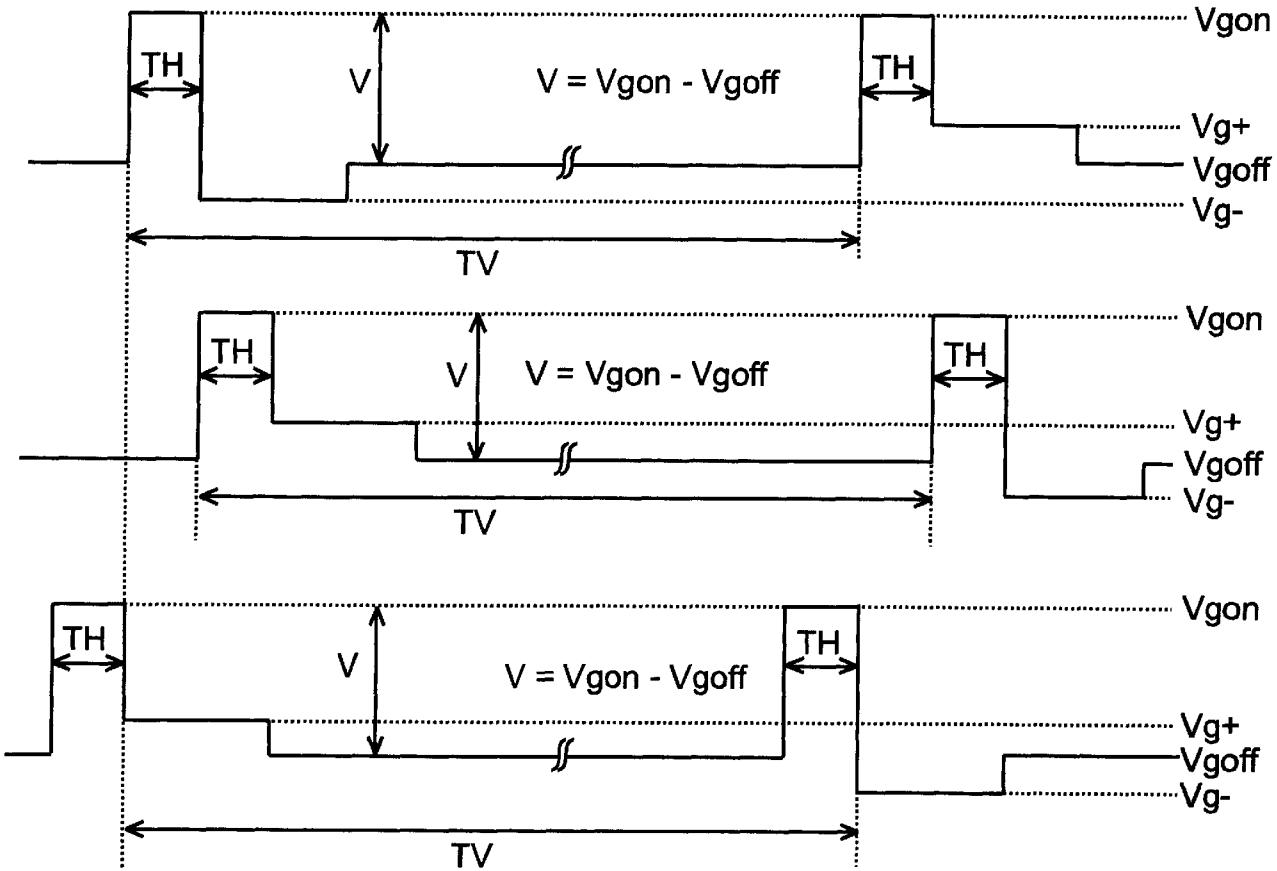
FIG. 18 is a driving voltage waveform and timing chart of scanning lines in embodiment 4.

In such TFT type liquid crystal panel of pre-stage capacitive coupling type, the scanning line driving voltage waveform and its timing are shown in FIG. 18. In the diagram, Vgon is the driving voltage for turning on the TFT, and Vgoff is the driving voltage for turning off the TFT. Meanwhile, Vg+ and Vg− are compensation voltages. The scanning line left drive circuit 17A scans sequentially from scanning line 12 of address X1 to address X2N, and simultaneously the scanning line right drive circuit 17B scans sequentially from address X2N to address X1. As explained in embodiment 1, since the cofiguration of the scanning line drive circuit is reverse, the driving voltage is delivered in the same direction from upper to lower side in FIG. 18.

Figure 19:
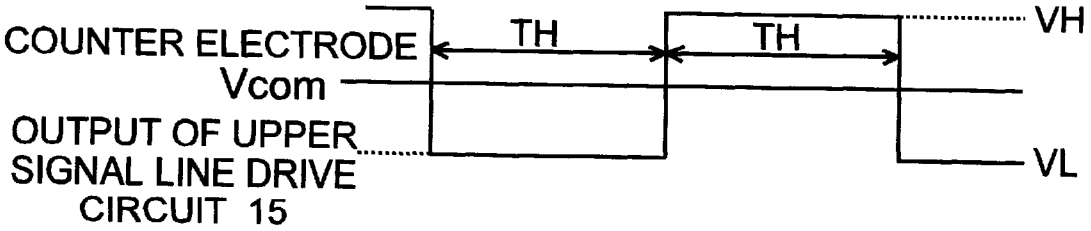
FIG. 19 is an explanatory diagram showing the relation of counter electrode voltage and signal line driving voltage in embodiment 4.
Figure 49:
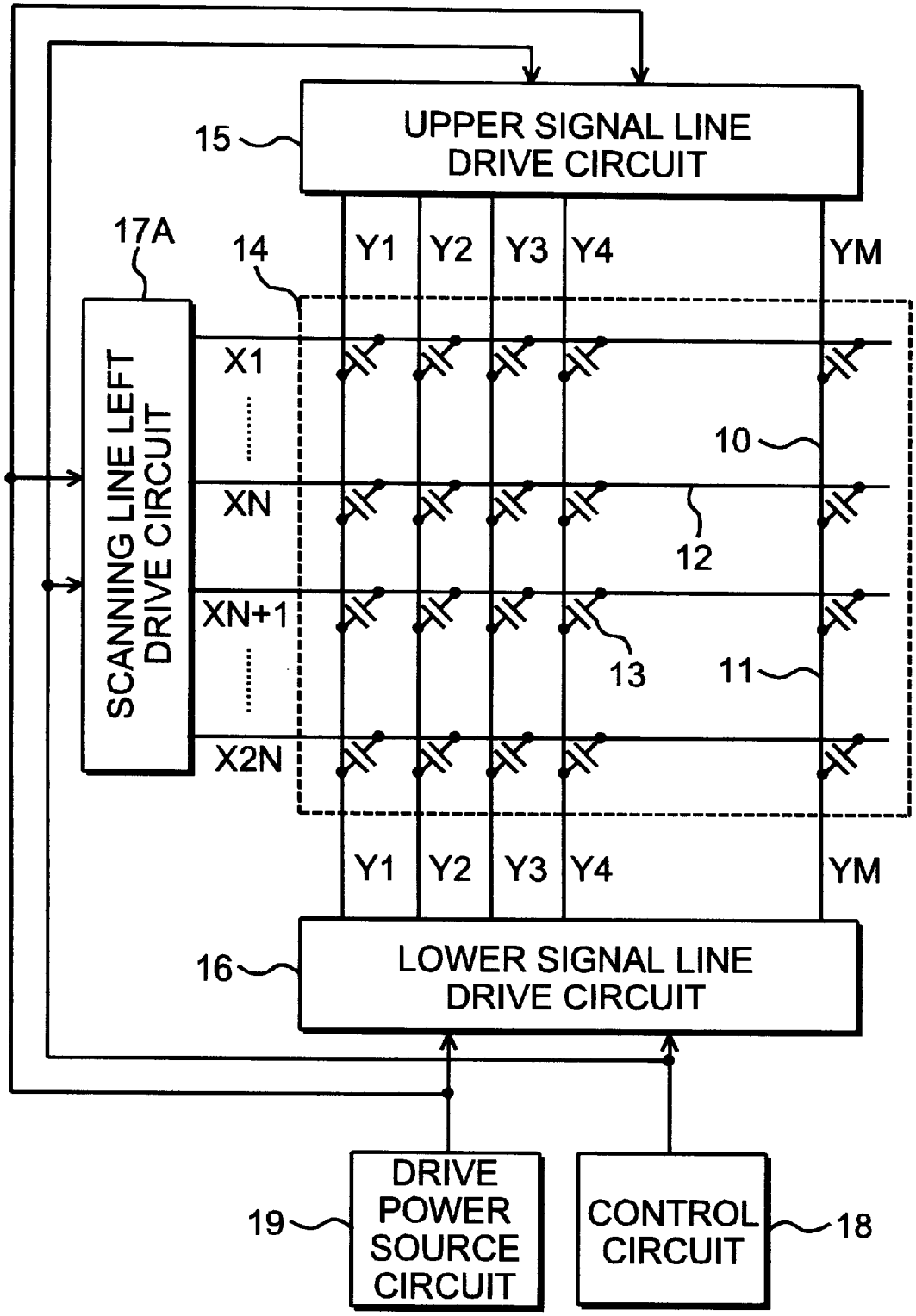
FIG. 49 is a block diagram of a liquid crystal display device in a prior art.
Figure 50A:
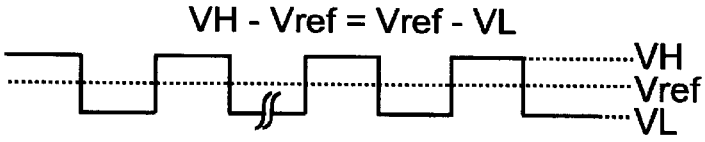
FIGS. 50A–D are driving waveform diagrams of pixels in the liquid crystal display device in the prior art.
Figure 50B:
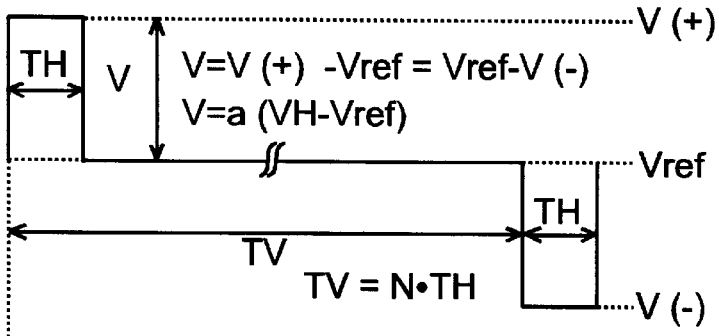
Figure 50C:
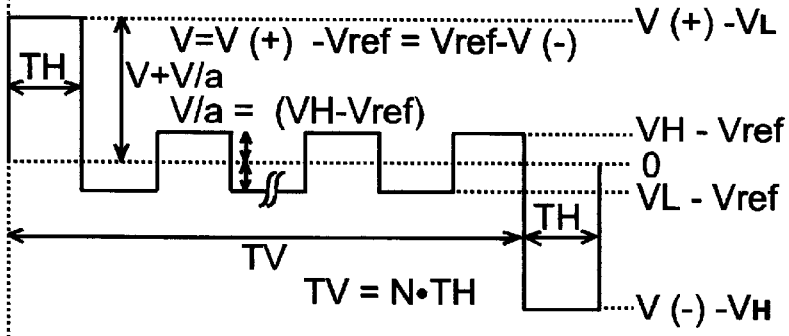
Figure 50D:
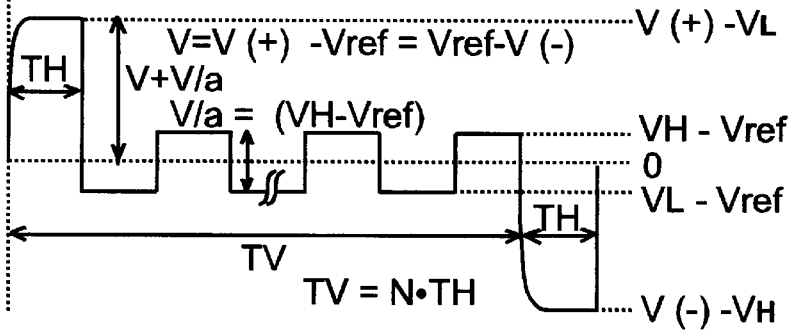

FIG. 19 shows an example of relation between voltage Vcom of the counter electrode 23 (hereinafter called Vref) and the output of the upper signal line drive circuit 15. As shown in the diagram, the output of the upper signal line drive circuit 15 is inverted in polarity in every time of one horizontal scanning line on the basis of Vref. Herein, since the upper signal line driving voltage is VH and VL, the relation of VH−Vref=Vref−VL is established. To simplify the explanation, the upper signal line drive circuit 15 in FIG. 16 is identical with reference numeral 15 in FIG. 49. Actually, a DA (digital-to-analog) converter is often built in the signal line circuit of the TFT type liquid crystal panel, and the output circuit is regarded as an analog amplifier. Since it is indifferent to explanation of the invention, it is assumed to be a signal line drive circuit of binary output.

Signal lines 9 and scanning lines 12 are coupled by distributed capacitance Ccs, Cgs, Ccg. Since the average of the driving voltage of the signal lines 9 can be regarded as Vref as shown in FIG. 19, the equivalent circuit for the scanning line driving of the liquid crystal panel 14D in FIG. 16 can be shown as FIG. 20 with the capacitance c of the pixel 13 formed between the scanning line and counter electrode as indicated in formula (18).

Figure 20:
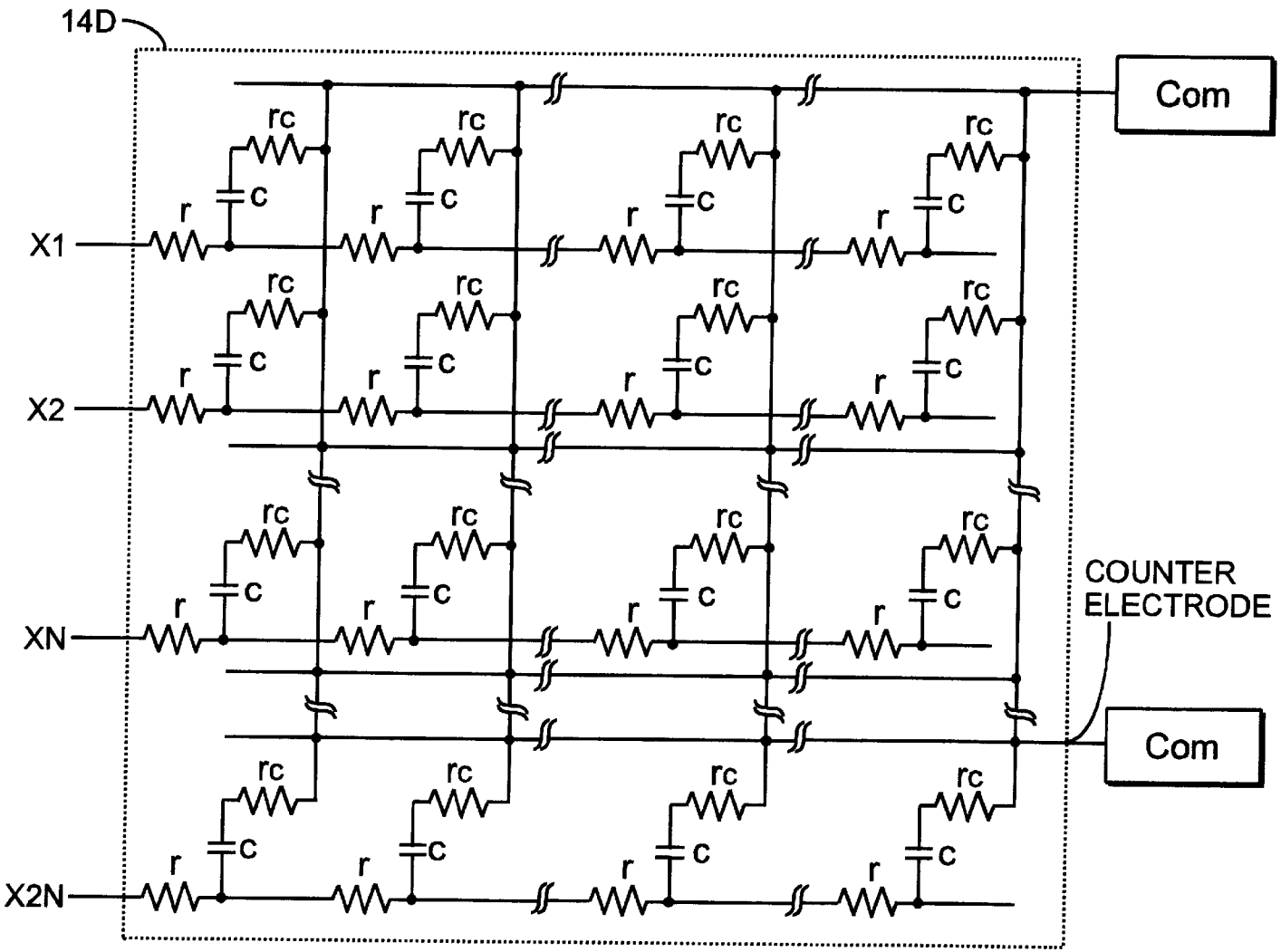
FIG. 20 is an equivalent circuit diagram of a liquid crystal panel in embodiment 4.

As shown in the equivalent circuit in FIG. 20, since the liquid crystal panel 14D can be expressed by the distributed parameter circuit in which an arbitrary scanning line 12 is composed of element capacitance c and wiring resistance r of scanning line, as shown in FIG. 4 relating to embodiment 1, by dividing into two sections from the virtual terminal end, it can be expressed by the distributed parameter circuit for driving each at one end. This is shown in FIG. 21.

Figure 21:
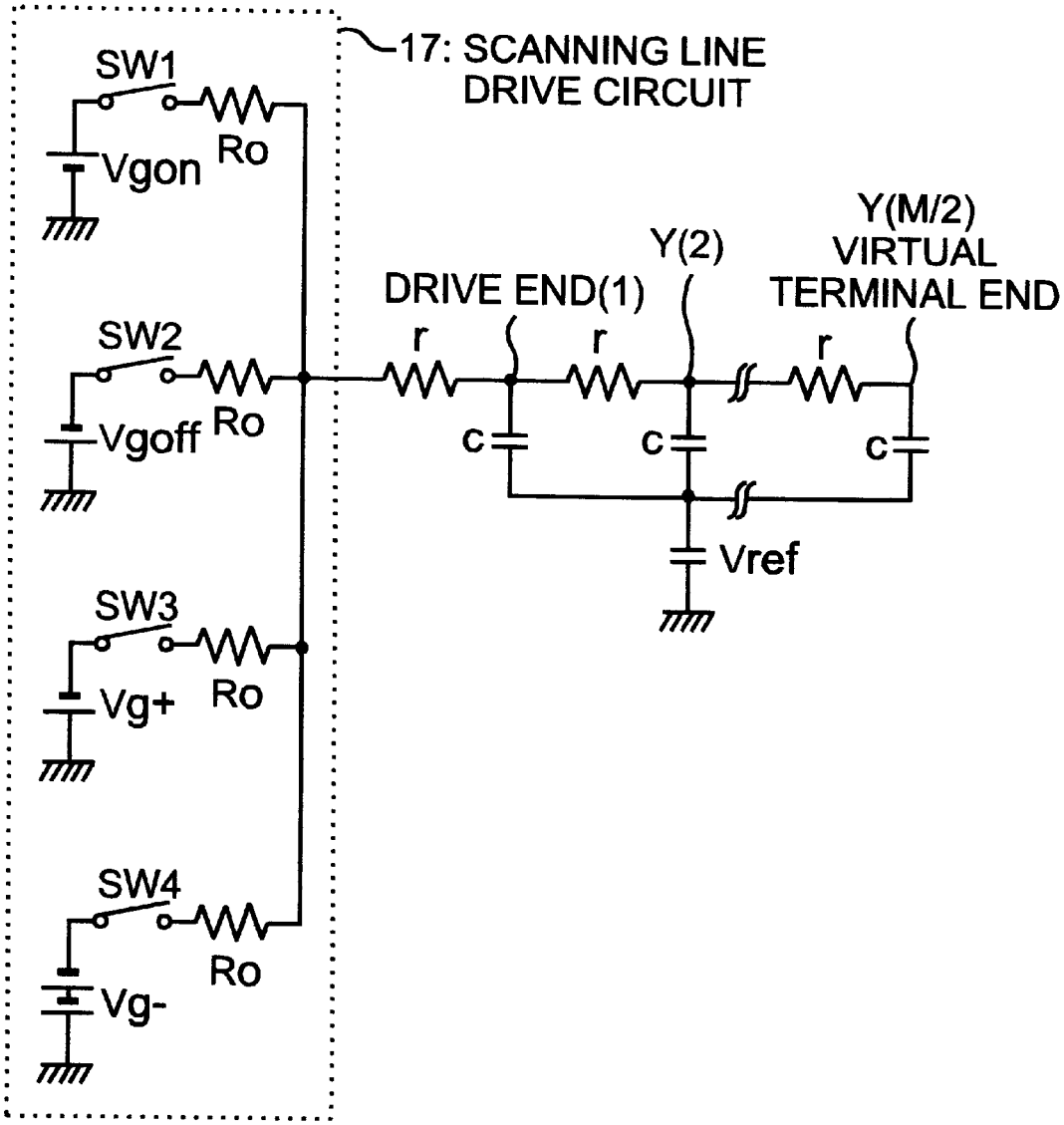
FIG. 21 is a distributed parameter circuit diagram in scanning line driving in embodiment 4.

In FIG. 21, the output resistances of right and left scanning line drive circuits 17, 20 can be expressed by SWI to SW4 and the resistance Ro connected in series to each SW. Herein, SW1 to SW4 are analog switches, the resistance Ro is the output resistance of the scanning line drive circuit, and Vref is the operation reference voltage. Vref is a voltage applied to the counter electrode. From FIG. 21, in scanning line driving of the capacitive coupled TFT liquid crystal panel 14D, too, the scanning line 12 can be expressed as a series circuit of resistance $M\cdot r/\pi$ and capacitance $M\cdot c/\pi$. That is, the output circuits of scanning line drive circuits 17 and 20 are composed of four analog switches, and all output resistances are supposed to be Ro.

Figure 22:
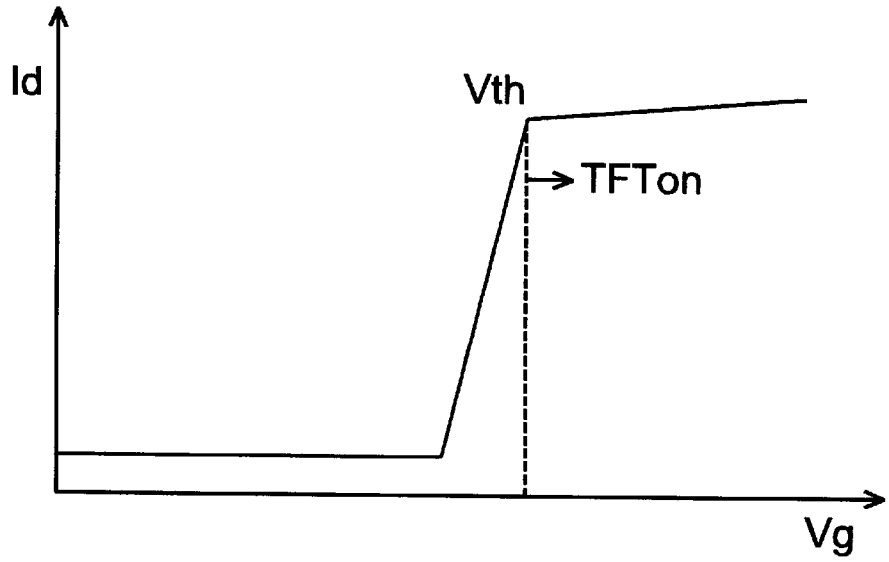
FIG. 22 is a characteristic diagram of relation of gate voltage and drain current of TFT.

The switching characteristic of the TFT is shown in FIG. 22. The switching characteristic can be expressed by the relation of gate voltage Vg and drain current Id. Although the TFT operates as a switching element, its switching characteristic is considerably inferior to an ideal switch. As shown in FIG. 22, the gate voltage at which the TFT is completely turned on is supposed to be the threshold voltage Vth. When the scanning line driving voltage exceeds Vth, the TFT is turned on, and the signal line driving voltage is applied to the liquid crystal cell of capacitance Cls.

Figure 23:
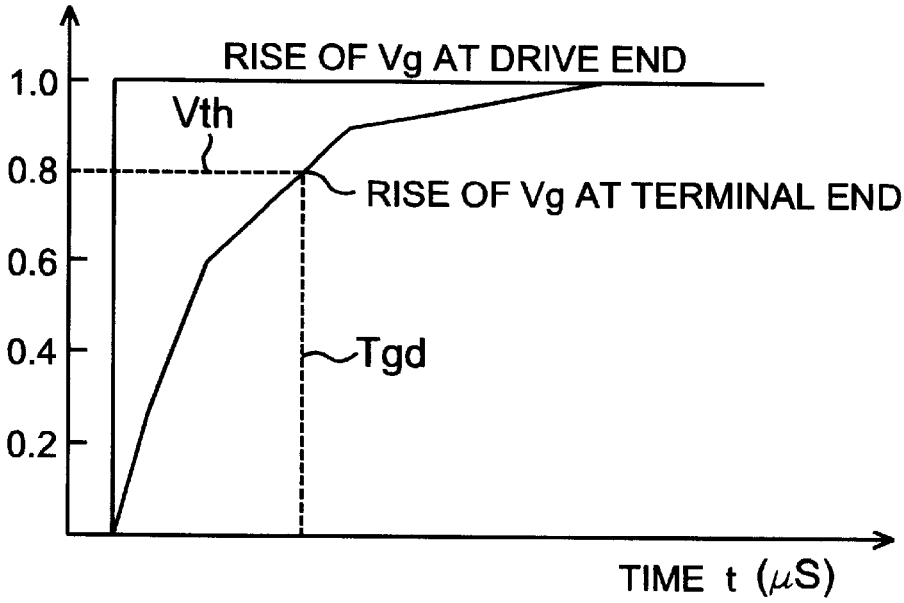
FIG. 23 is an explanatory diagram of switching characteristic of TFT at scanning line driving voltage.

Therefore, at terminal end of the scanning line 12, due to delay by the wiring resistance r from the drive end and pixel capacitance c, the ON time of the TFT becomes shorter, and between the drive end and terminal end, the ON time of the TFT is different as shown in FIG. 23. In FIG. 23, the timing when the scanning line driving voltage at terminal end reaches Vth is expressed as Tgd. This Tgd is the delay time of the gate voltage of the TFT at the terminal end, and is determined from the above formula (9A). At the drive end, for the time of one horizontal scanning period TH the TFT is ON, and the liquid crystal capacitance Cls is charged up to the signal line driving voltage. By contrast, at the terminal end, the liquid crystal capacitance Cls must be charged in the ON time of (TH−Tgd).

When the drain current Id of the TFT is sufficiently large, and the output resistance Rd of the TFT is small, the liquid crystal capacitance can be charged up to the signal line driving voltage within the time of (TH−Tgd). However, when the screen size of the liquid crystal panel is large, and the pixel composition is at high definition such as (1600×3)×1200, the horizontal scanning time TH becomes shorter, and the Tgd is larger. Therefore, in the pixel at the terminal end, as compared with the time constant Cls×Rd determined by the liquid crystal capacitance Cls and output resistance Rd of TFT, the value of (TH−Tgd) is smaller, and the liquid crystal capacitance cannot be charged up to the signal line driving voltage.

Therefore, in the scanning line one-end driving, as described in embodiment 1, the brightness differs slightly from the drive end to the terminal end, and a lateral luminance error occurs. In the TFT type liquid crystal display device by scanning line one-end driving with the screen size of 20 inches in the composition of (1600×3)×1200 pixels, the charging time of the liquid crystal capacitance Cls in the condition of TH=17 μs, Tgd=6 μs is estimated around 14 μs. In this case, a visually distinguishable lateral luminance error occurs, and display unevenness occurs.

However, by employing the scanning line both-end simultaneous driving of the invention, since the delay time becomes ¼, Tgd is 6 μs/4=1.5 μs, and the lateral luminance error is at an ignorable level. In this case, display unevenness does not occur. Moreover, since the delay time is ¼, lateral crosstalk due to waveform distortion is smaller than in scanning line one-end driving. Incidentally, if the liquid crystal display device is composed of post-stage capacitive coupled TFT type liquid crystal panel, exactly the same effects are obtained.

Next, in the capacitive coupled TFT type liquid crystal panel, the scanning line driving voltage, threshold voltage, delay time, and output resistance of scanning line drive circuit are numerically expressed, assuming the operation of the TFT to be an ideal switch.

The scanning line driving voltage is changed over from Vgoff to Vgon at the timing of turning on the TFT disposed in each pixel. The time when the scanning line driving voltage is changed over from Vgoff to Vgon is supposed to be t, and using the pixel capacitance c of the scanning line in formula (17), and supposing the output resistance of the scanning line drive circuit to be Rgw in both-end driving or Rgs in one-end driving, and Vgn=Vgoff, Vgn+1=Vgon, formula (18) can be derived from formula (9A).

In scanning line both-end simultaneous driving, assuming x≦M/2, $$Vgw(x, t) = (Vgoff - Vgon) \cdot \exp\{-\pi^2 \cdot t / (4r \cdot c \cdot x^2 + 2\pi \cdot c \cdot x \cdot Rgw)\}] + Vgon - Vref$$

In scanning line one-end driving, assuming x≦M, $$Vgs(x, t) = (Vgoff - Vgon) \cdot \exp\{-\pi^2 \cdot t / (4r \cdot c \cdot x^2 + 2\pi \cdot c \cdot x \cdot Rgs)\}] + Vgon - Vref \quad (18)$$

Supposing the output resistance to be 0, the delay time of scanning line both-end simultaneous driving is ¼ that of one-end driving, same as in the simple matrix type liquid crystal panel.

In formula (9A), putting Vgn=Vgon, Vgn+1=Vg+, the voltage of Vg+ at virtual terminal end or terminal end can be determined (so is Vg−). Herein, suppose Vg+=Vg(+), and Vg−=Vg(−). Since formula (11) expressing the scanning line driving current cannot be applied to the capacitive coupled TFT type, supposing the scanning line driving currents of the outputs Vgon, Vg(+), Vg(−) of the right and left scanning line drive circuits to be I gw(g), I gw(+), I gw(−), formula (11A) applicable to the TFT type is obtained on the basis of the method of deriving formula (11) as follows.

$$Igw(g)=(2N/TV)(M \cdot c/\pi)(Vgon-Vgoff)$$

$$Igw(+)=(N/TV)(M \cdot c/\pi)(Vg(+)-Vgoff)$$

$$Igw(-)=(N/TV)(M \cdot c/\pi)(Vg(-)-Vgoff) \quad (11A)$$

In scanning line one-end driving, the scanning line driving current of each voltage is 2 times that of formula (11A).

As mentioned above, if the threshold voltage of the TFT of each pixel is identical, the time for the TFT of each pixel to reach the threshold voltage varies due to delay depending on the wiring resistance and pixel capacitance, and therefore the required gate ON voltage of each pixel differs. Therefore, hereinafter, the voltage at which the liquid crystal panel displays the image appropriately is defined to be the ON voltage Vgon of the liquid crystal panel, and the voltage not displaying completely is the OFF voltage Vgoff of the liquid crystal panel. Further, in formula (18), the driving voltage at x=M/2, t=Tdpw is supposed to be threshold voltage Vpthw of the liquid crystal panel and Tdpw to be the delay time of the liquid crystal panel in scanning line both-end simultaneous driving, and the driving voltage at x=M, t=Tdps is supposed to be threshold voltage Vpths of the liquid crystal panel and Tdps to be the delay time of the liquid crystal panel in one-end driving. Hence, it is known that the threshold voltage of the liquid crystal panel should satisfy formula (19). That is, In scanning line both-end simultaneous driving, $$Vpthw=(Vgoff-Vgon)\exp\{-\pi^2 \cdot Tdpw/(M^2 \cdot r \cdot c+\pi \cdot M \cdot c \cdot Rgw)\}+Vgon-Vref$$

In scanning line one-end driving, $$Vpths=(Vgoff-Vgon)\exp\{-\pi^2 \cdot Tdps/(4M^2 \cdot r \cdot c+2\pi \cdot M \cdot c \cdot Rgs)\}+Vgon-Vref \quad (19)$$

If Vgon, Vgoff, Vpths, Vpthw are known, the delay time of the liquid crystal panel can be determined in formula (20).

In scanning line both-end simultaneous driving, $$Tdpw=-1n\beta w \cdot (M^2 \cdot r \cdot c+\pi \cdot M \cdot c \cdot Rgw)/\pi^2\beta w=(Vpthw-Vgon+Vref)/(Vgoff-Vgon)$$

In scanning line one-end driving, $$Tdps=-1n\beta s \cdot (4M_2 \cdot r \cdot c+2\pi \cdot M \cdot c \cdot Rgw)/\pi^2\beta s=(Vpths-Vgon+Vref)/(Vgoff-Vgon) \quad (20)$$

As known from formula (19), in scanning line both-end simultaneous driving, since the margin of threshold voltage of the liquid crystal panel is wider than in scanning line one-end driving, lateral luminance error is less likely to occur. When the ON voltage of the liquid crystal panel is more than the threshold voltage of the liquid crystal panel, no lateral luminance error occurs, and therefore the scanning line both-end simultaneous driving is more effective when used in the TFT type liquid crystal panel than in the simple matrix type.

Moreover, when the delay time of the liquid crystal panel is determined, a more appropriate output resistance range of the scanning line drive circuit can be determined from formula (19) and given by formula (21). Herein, Rgw and Rgs refer to the output resistance of the analog switch for delivering Vgon of the scanning line drive circuit.

$$Rgw \leqq -\pi \cdot Tdpw/(M \cdot c \cdot \ln\beta w)-M \cdot r/\pi$$

$$Rgs \leqq -\pi \cdot Tdps/(2M \cdot c \cdot \ln\beta s)-2M \cdot r/\pi \quad (21)$$

By using the formulas (18) to (21) of the invention, design and driving analysis of the capacitive coupled TFT type liquid crystal display device are accurate and easy, and the margin of the design value can be predicted from the comparison between the measured value and calculated value. Thus, according to the embodiment, same as in the case of FIG. 1, even by using the capacitive coupled TFT type liquid crystal panel, the liquid crystal display device which is small in lateral luminance error and lateral crosstalk, free from display unevenness, and high in display quality is realized. It can be similarly applied to the liquid crystal panel in which the drive circuit of signal lines and scanning lines are formed or disposed outside of the image display region of the liquid crystal panel.

Also, same as in embodiment 1, driving can be analyzed by expressing the scanning line 12 by a series circuit composed of resistance of M·r/π and a capacitance of M·c/π in scanning line both-end simultaneous driving, or expressing the scanning line 12 by a series circuit composed of resistance of 2M·r/π and a capacitance of 2M·c/π in scanning line one-end driving.

(Embodiment 5)

Figure 24:
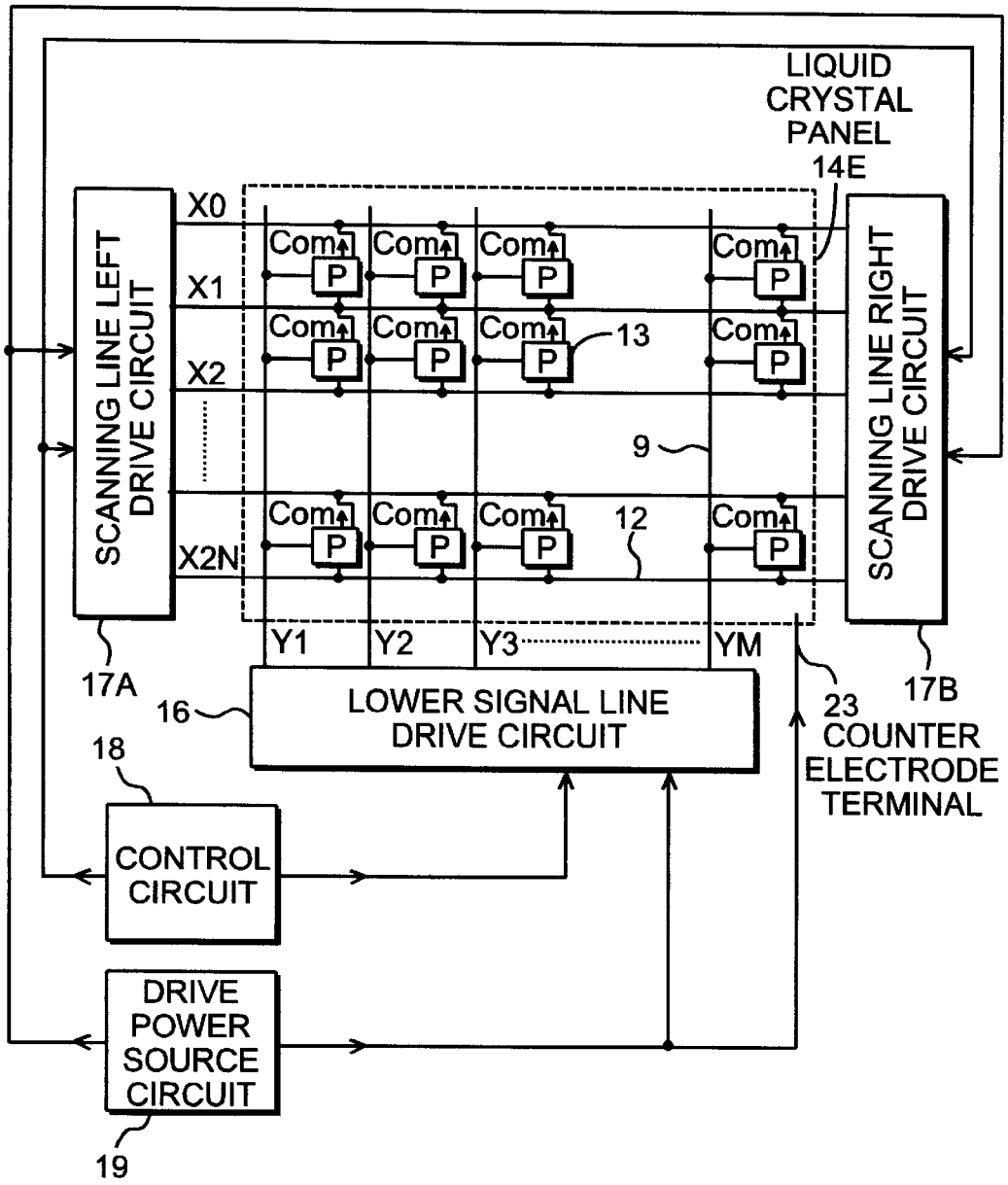
FIG. 24 is a block diagram of pixel in embodiment 5 of the invention.

A liquid crystal display device in embodiment 5 of the invention is described below. FIG. 24 is a block diagram of the liquid crystal display device of this embodiment, and same parts as in the liquid crystal display device in FIG. 1 and FIG. 16 are identified with same reference numerals, and their explanation is omitted. The signal line drive terminal of the liquid crystal panel 14D in FIG. 16 is disposed upside down, and the scanning line of the liquid crystal panel 14E is driven simultaneously at both ends. In such constitution, too, the same effects as in embodiment 4 are obtained.

(Embodiment 6)

Figure 25:
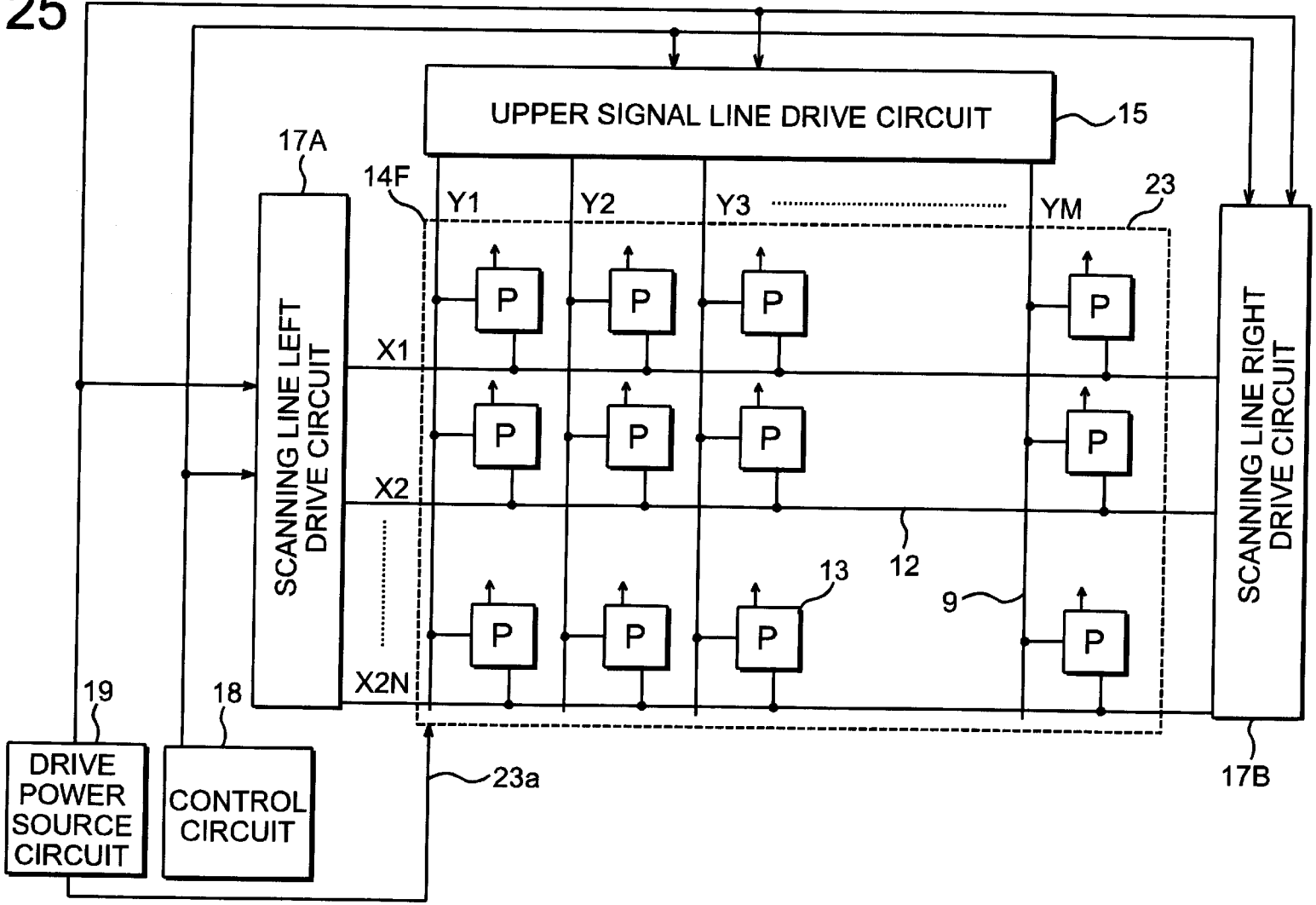
FIG. 25 is a block diagram of pixel in embodiment 6 of the invention.

A liquid crystal display device in embodiment 6 of the invention is briefly described below. FIG. 25 is a block diagram of the liquid crystal display device of this embodiment, and same parts as in the liquid crystal display device in FIG. 1 are identified with same reference numerals, and their explanation is omitted. In the liquid crystal panel 14F in the embodiment, each pixel 13 (element P) is composed of TFT which is not coupled capacitively and liquid crystal cell. The liquid crystal panel 14 has non-divided signal lines 9 and 2N scanning lines 12, and both ends of scanning lines are driven simultaneously.

Figure 26:
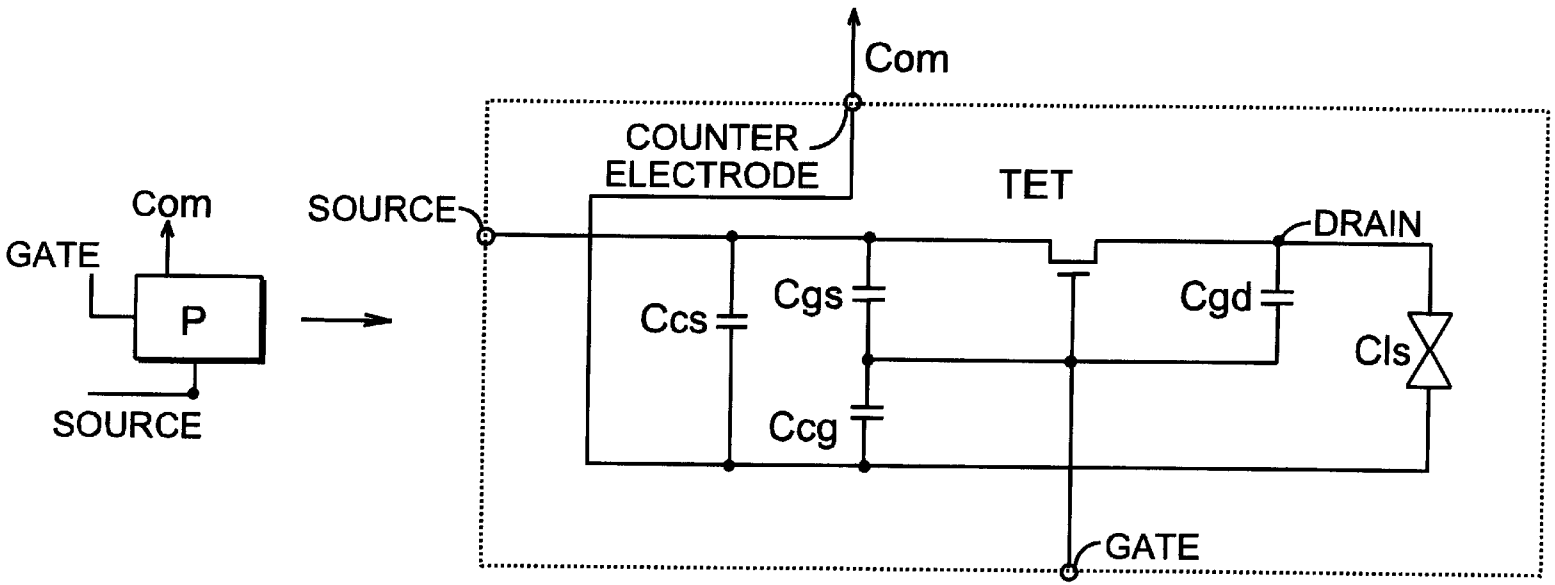
FIG. 26 is a block diagram of pixel in TFT liquid crystal panel in embodiment 6.

The others are same as shown in FIG. 16, and same effects as in embodiment 4 are obtained. An equivalent circuit of pixel 13 is shown in FIG. 26. As shown in the diagram, the TFT is not coupled capacitively, and it is the constitution omitting the coupling capacitance Cst from the composition in FIG. 17. Therefore, the pixel capacitance c is expressed in formula (22).

$$c=Ccg+Cgd\cdot Cls/(Cgd+Cls)+Cgs\cdot Ccs/(Cgs+Ccs) \quad (22)$$

An example of output waveform of scanning line drive circuits 17A, 17B in FIG. 25 is shown in FIG. 27. In the case of TFT type liquid crystal panel not coupled capacitively, too, the scanning line 12 can be expressed by a series circuit composed of resistance of $M\cdot r/\pi$ and a capacitance of $M\cdot c/\pi$ at in scanning line both-end simultaneous driving, and the scanning line 12 can be expressed by a series circuit composed of resistance of $2M\cdot r/\pi$ and a capacitance of $2M\cdot c/\pi$ in scanning line one-end driving. Therefore, driving analysis can be done in the same manner as in embodiment 4, and same effects as in embodiment 4 are obtained, and all of formulas (1.8) to (21) can be applied similarly.

(Embodiment 7)

Figure 28:
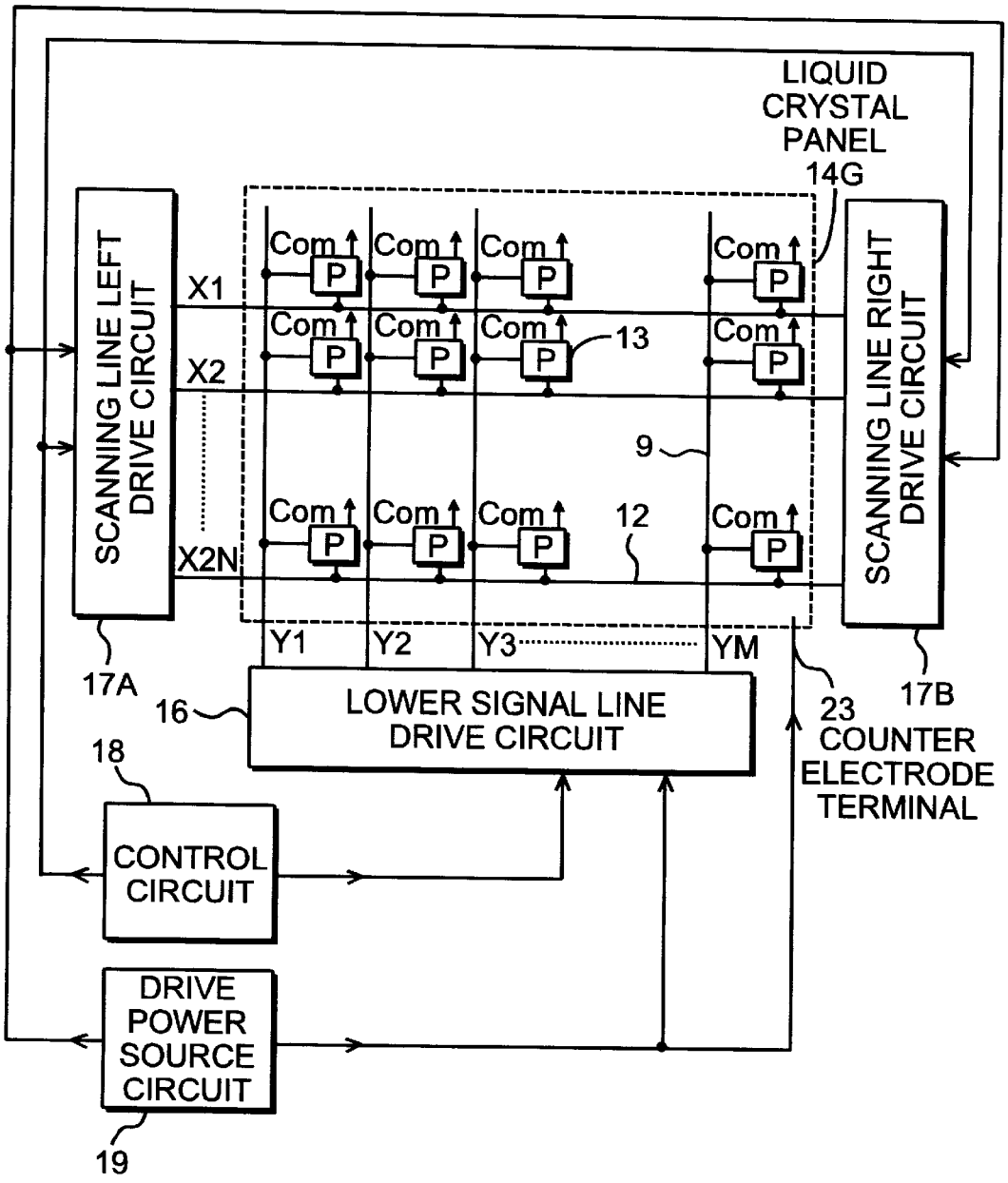
FIG. 28 is a block diagram of a liquid crystal display device in embodiment 7.

A liquid crystal display device in embodiment 7 of the invention is described below. FIG. 28 is a block diagram of the liquid crystal display device of this embodiment, and same parts as in the liquid crystal display device in FIG. 1 and FIG. 25 are identified with same reference numerals, and their explanation is omitted. The signal line drive terminal of the liquid crystal panel 14F in FIG. 25 is disposed upside down, and the scanning line of the liquid crystal panel 14G is driven simultaneously at both ends. In such constitution, too, the same effects as in embodiment 6 are obtained.

(Embodiment 8)

Figure 29:
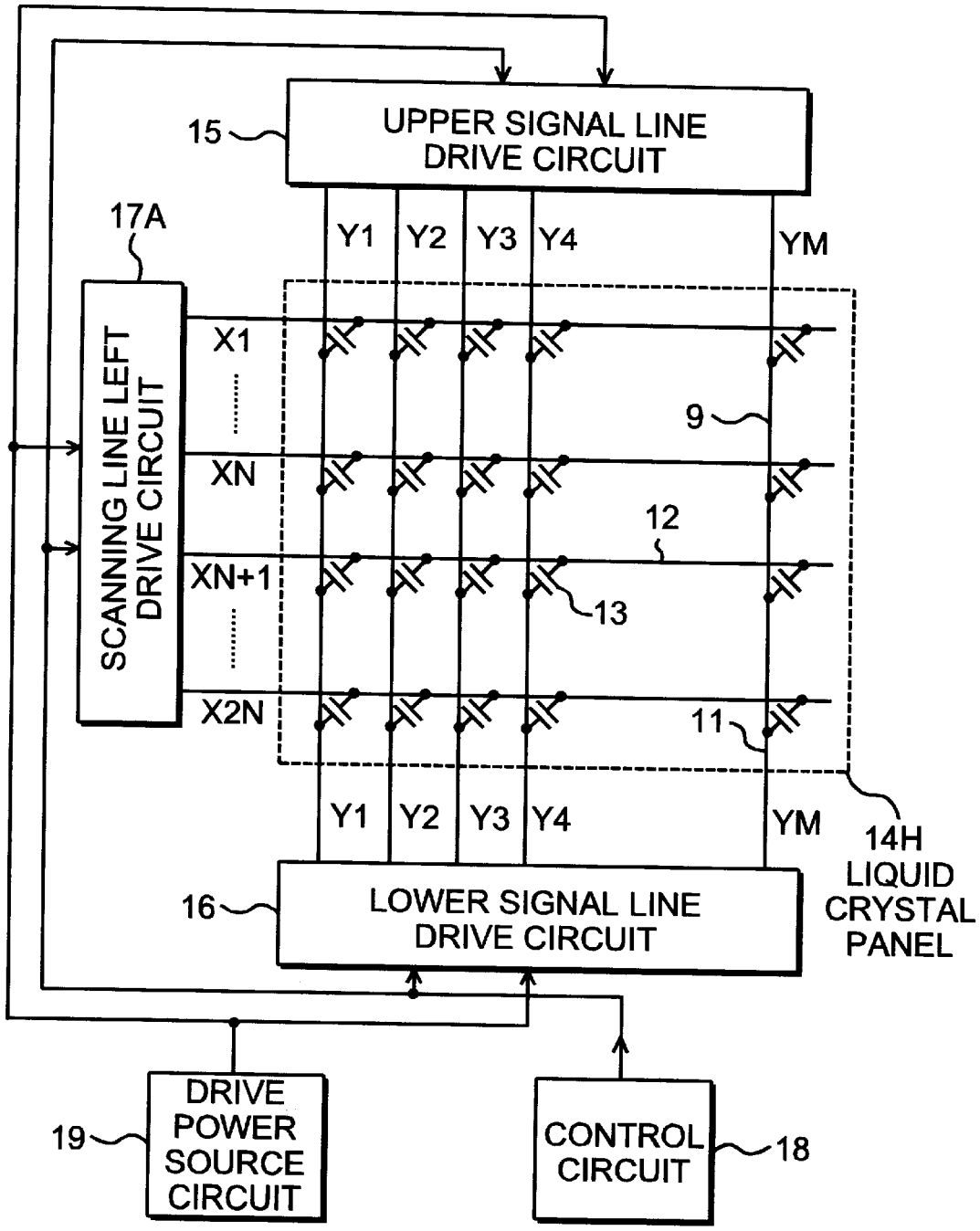
FIG. 29 is a block diagram of a liquid crystal display device in embodiment 8.

A liquid crystal display device in embodiment 8 of the invention is described below. FIG. 29 is a block diagram of the liquid crystal display device of this embodiment, and same parts as in the liquid crystal display device in FIG. 1 are identified with same reference numerals, and their explanation is omitted. In FIG. 29, in the simple matrix type liquid crystal panel 14H, the scanning line 12 is driven at one end, and the signal line 9 is driven simultaneously from both ends without dividing into two. The embodiment is applied to the liquid crystal display device longitudinally long in the screen composition.

Figure 38:
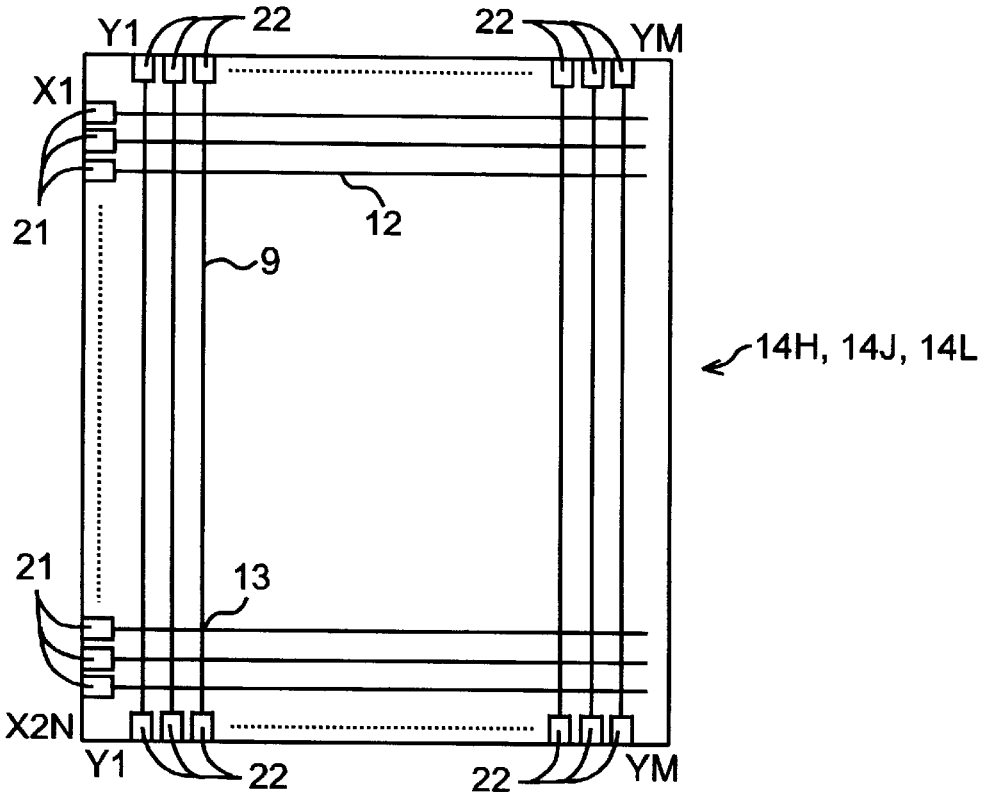
FIG. 38 is a block diagram of a liquid crystal panel having drive terminals at both ends of signal lines, and having drive terminals at left end of scanning lines.
Figure 39:
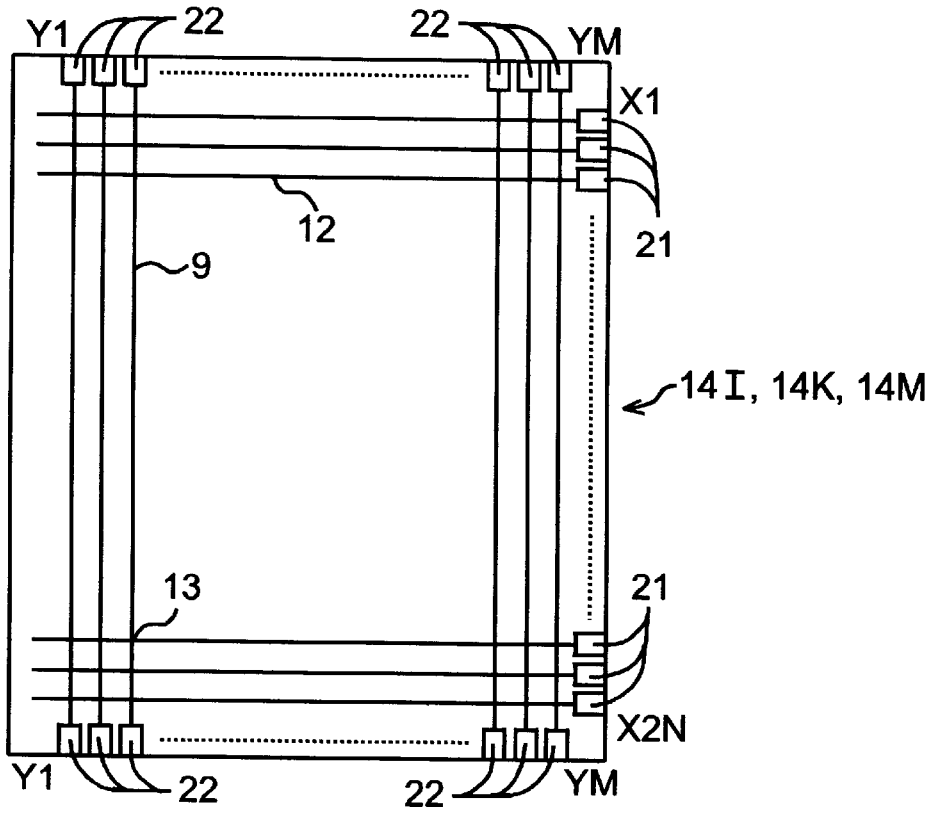
FIG. 39 is a block diagram of a liquid crystal panel having drive terminals at both ends of signal lines, and having drive terminals at right end of scanning lines.

The terminal structure of the liquid crystal panel 14H of the embodiment having terminals for signal line both-end simultaneous driving is shown in FIGS. 38 and 39. Same reference numerals as in FIG. 7 are used, and the explanation is omitted. FIG. 39 shows a terminal structure of the liquid crystal panel 14I in which the scanning line drive terminal is disposed opposite against the liquid crystal panel 14H. The terminal structure of the liquid crystal panels 14J, 14L described later is same as in FIG. 38, and the terminal structure of liquid crystal panels 14K, 14M is same as in FIG. 39. In FIG. 38 and FIG. 39, the block diagrams of drive terminals are shown, but the scanning lines and signal lines may be formed or disposed outside of the image display region of the liquid crystal panel.

The signal line, same as the scanning line, may be regarded as a distributed parameter circuit composed of wiring resistance and pixel capacitance, and in signal line both-end simultaneous driving, the signal line driving voltage can be determined from formula (8). The signal line driving voltage is as shown in FIG. 50, and the signal line driving voltage is supposed to be changed over from VL to VH, or from VH to VL, at drive end at t=0. The operation reference voltage of VH is supposed to be Vref1, and the operation reference voltage of VL to be Vref2. In the simple matrix type liquid crystal panel, the relation is Vref1=Vref2, but in driving of TFT type liquid crystal panel, the operation reference voltage may be changed over at every horizontal scanning time. Supposing the output resistance of the signal line drive circuit to be Rsw, the number of scanning lines to be 2N, the wiring resistance per pixel of signal line to be rs, and the capacitance per pixel of signal line to be cs, the signal line driving voltage of the y-th pixel from the drive end of the signal line in the vertical direction is expressed in formula (23) which is derived from formula (9), assuming the y-th pixel to be virtual terminal end or divided terminal end. Formula (23) is derived from the fact shown in the following. When the voltage +V is applied at t=0 to the RC series circuit previously charged with −V, the charging voltage of C is expressed by $V\cdot[1-2\exp(-t/CR)]$.

In the case of signal line both-end simultaneous driving, up to y=N,

When changed over to VH at t=0, Vsw (y, t) is $$(VH-Vref\mathbf{1})[1-2\exp\{-\pi^2\cdot t/(4y^2\cdot rs\cdot cs+2\pi\cdot y\cdot cs\cdot Rsw)\}]$$

When changed over to VL at t=0, Vsw (y, t) is $$(VL-Vref\mathbf{2})[1-2\exp\{-\pi^2\cdot t/(4y^2\cdot rs\cdot cs+2\pi\cdot y\cdot cs\cdot Rsw)\}] \quad (23)$$

The signal line driving voltage of signal line one-end driving is up to y=2N, and Rsw may be replaced by the output resistance Rss of the signal line drive circuit of signal line one-end driving. Formula (23) may be applied also to signal line both-end simultaneous driving of the TFT type liquid crystal panel. In the case of simple matrix type liquid crystal panel, it is general to keep the relation of Vref1=Vref2.

From formula (23), provided the output resistance is 0, it is known that the signal line can be driven at the delay time of ¼ of signal line one-end driving in the signal line both-end simultaneous driving same as in scanning line both-end simultaneous driving, and the longitudinal luminance error and longitudinal crosstalk can be decreased extremely.

Figure 30:
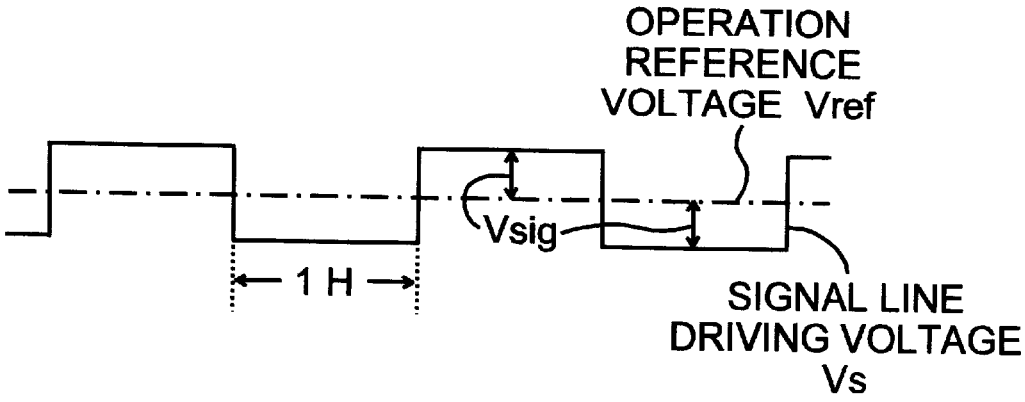
FIG. 30 is a diagram showing waveforms of signal line driving voltage and operation reference voltage.
Figure 31:
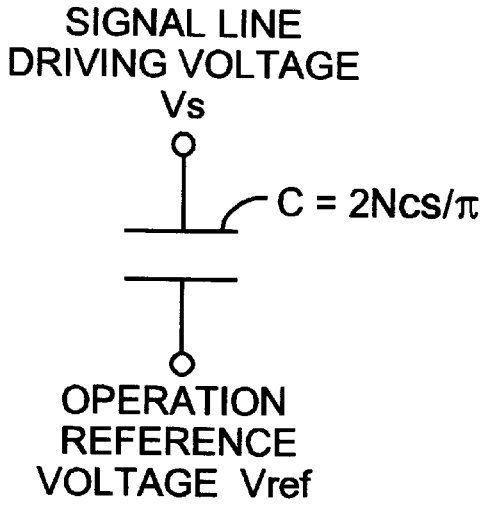
FIG. 31 is an equivalent circuit diagram of signal lines for obtaining a signal line driving current.

An example of waveform of signal line driving voltage and operation reference voltage is shown in FIG. 30. When the pixels at odd-number scanning lines are displayed in white, pixels at even-number scanning lines in black, or vice versa, on the screen, the signal line driving current is nearly maximum, and the waveform of signal line driving voltage and operation reference voltage becomes as shown in FIG. 30 in all signal lines. In this case, the equivalent circuit of the signal line 9 is, as shown in FIG. 31, expressed by applying the signal line driving voltage to one end and operation reference voltage to other end of the capacitor $2N\cdot cs/\pi$, and hence formula (24) is obtained in the upper and lower signal line drive circuits in signal line both-end simultaneous driving.

When VH is applied, the signal line driving current Isw(+) is $$Isw(+) = 2(VH - Vref1)\cdot(2N/TV)(2N\cdot M\cdot cs/\pi)$$
$$= 8(VH - Vref1)\cdot N_2\cdot M\cdot cs/(\pi\cdot TV)$$

When VL is applied, the signal line driving current I ss(−) is $$Isw(-)=-8(VL-Vref2)N^2\cdot M\cdot cs/(\pi\cdot TV) \quad (24)$$

Formulas (23) and (24) can be applied not only to the simple matrix type liquid crystal panel, but also to the TFT type liquid crystal panel. In signal line one-end driving, since the equivalent circuit of signal lines can be expressed by the capacitor of 4N·cs/π, the signal line driving currents Iss (+) and Iss (−) are 2 times that of formula (24). Incidentally, the pixel capacitance cs of signal line is same value as the pixel capacitance c of scanning line in simple matrix type, but in the liquid crystal panel of active matrix type such as TFT type liquid crystal panel, it is different from the pixel capacitance cs of scanning line.

Figure 32:
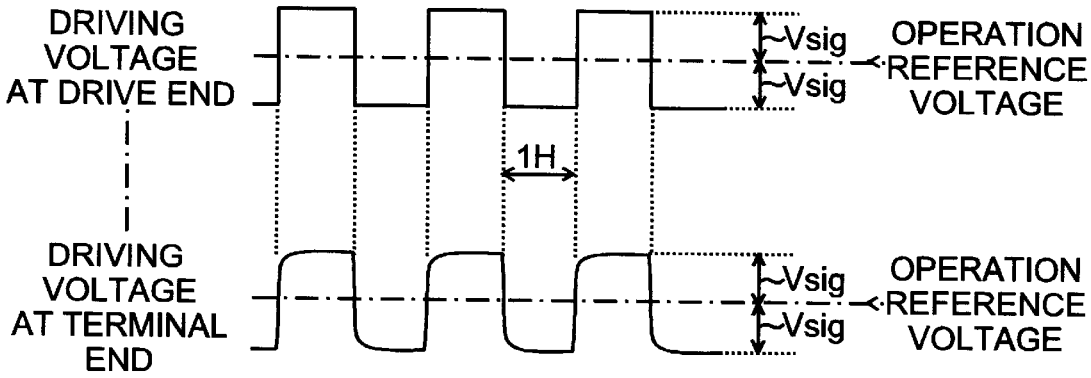
FIG. 32 is a diagram showing an example of signal line driving voltage waveform.

The effective voltage at the y-th pixel from the drive end of the signal line is derived by the same method as in embodiment 1. FIG. 32 shows an example of signal line driving voltage waveform. At the terminal end, as shown in the diagram, the waveform is distorted by the wiring resistance and pixel capacitance. To obtain an effective voltage of pixel connected to the signal line, integration may be operated from t=0 to TH as shown below so as to have the time dependence shown in formula (23) in V/a of the term of $(N-1)\cdot(V/a)_2/N$ in formula (3). That is, $$\{(N-1)\cdot(V/a)^2/N\}\times\int[1-2\exp\{-t/(RL\cdot CL)\}]^2\cdot dt\approx\{(N-1)\cdot(V/a)^2/N\}\cdot[1-2RL\cdot CL/TH]$$

Hence, the effective value of pixel at terminal end of signal line is $$Vecns=[\{V+V/a\}^2/N\}+\{(N-1)\cdot(V/a)^2/N\}\{1-2RL\cdot CL/TH\}]^{(1/2)} \quad (25)$$

Therefore, the effective voltage ratio γs=Vecns/Vecl is given in formula (25A)

$$\gamma s=[1-(2RL\cdot CL/TH)\cdot N/(a^2+N-1)\}]^{(1/2)} \quad (25A)$$

Accordingly, in signal line both-end simultaneous driving, assuming the pixel at the intersection of the y-th scanning line from the drive end of signal line to be the virtual terminal end or divided terminal end, the ratio of effective voltage of pixel disposed at the virtual terminal end or divided terminal end to effective voltage of pixel at drive end of signal line, and the ratio of effective voltage assuming the pixel at the intersection of the y-th scanning line in signal line one-end driving to be the terminal end are given in formula (26) by applying the relation of $RL\cdot CL=4y^2\cdot rs\cdot cs+2\pi\cdot y\cdot cs\cdot Rsw$ and others in formula (25A).

In the case of signal line both-end simultaneous driving, up to y=N, $$\gamma sw(y)=\{1-2(4y^2\cdot rs\cdot cs+2\pi\cdot y\cdot cs\cdot Rsw)\cdot N/(a^2+N-1)/(\pi^2\cdot TH)\}^{(1/2)}$$

In the case of signal line one-end driving, up to y=2*N*, $$\gamma ss(y)=\{1-2(4y^2\cdot rs\cdot cs+2\pi\cdot y\cdot cs\cdot Rss)\cdot N/(a^2+N-1)/(\pi^2\cdot TH)\}^{(1/2)} \quad (26)$$

It is known from formula (26) that the lateral luminance error in signal line both-end simultaneous driving is about ¼ as compared with signal line one-end driving.

Supposing the effective voltage ratio of virtual terminal end and drive end of signal line in signal line both-end driving to be γ1s, and the effective voltage ratio of terminal end and drive end in one-end driving to be γ2s, the output resistance of the signal line drive circuit is obtained in formula (27).

In the case of signal line both-end simultaneous driving, the output resistance is $$Rsw\leqq[1-(\gamma 1s)^2]\cdot\pi\cdot TH/(4N\cdot cs)\cdot(a^2+N-1)/N-2N\cdot rs/\pi$$

In the case of signal line one-end driving, the output resistance is $$Rss\leqq[1-(\gamma 2s)^2]\cdot\pi\cdot TH/(8N\cdot cs)\cdot(a^2+N-1)/N-4N\cdot rs/\pi \quad (27)$$

As shown above, also in the case of signal line both-end simultaneous driving of the invention, the signal line can be expressed by a series circuit composed of resistance of 2N·rs/π and a capacitance of 2N·cs/π, and therefore the liquid crystal display device small in longitudinal luminance error and longitudinal crosstalk and high in display quality is realized.

(Embodiment 9)

Figure 33:
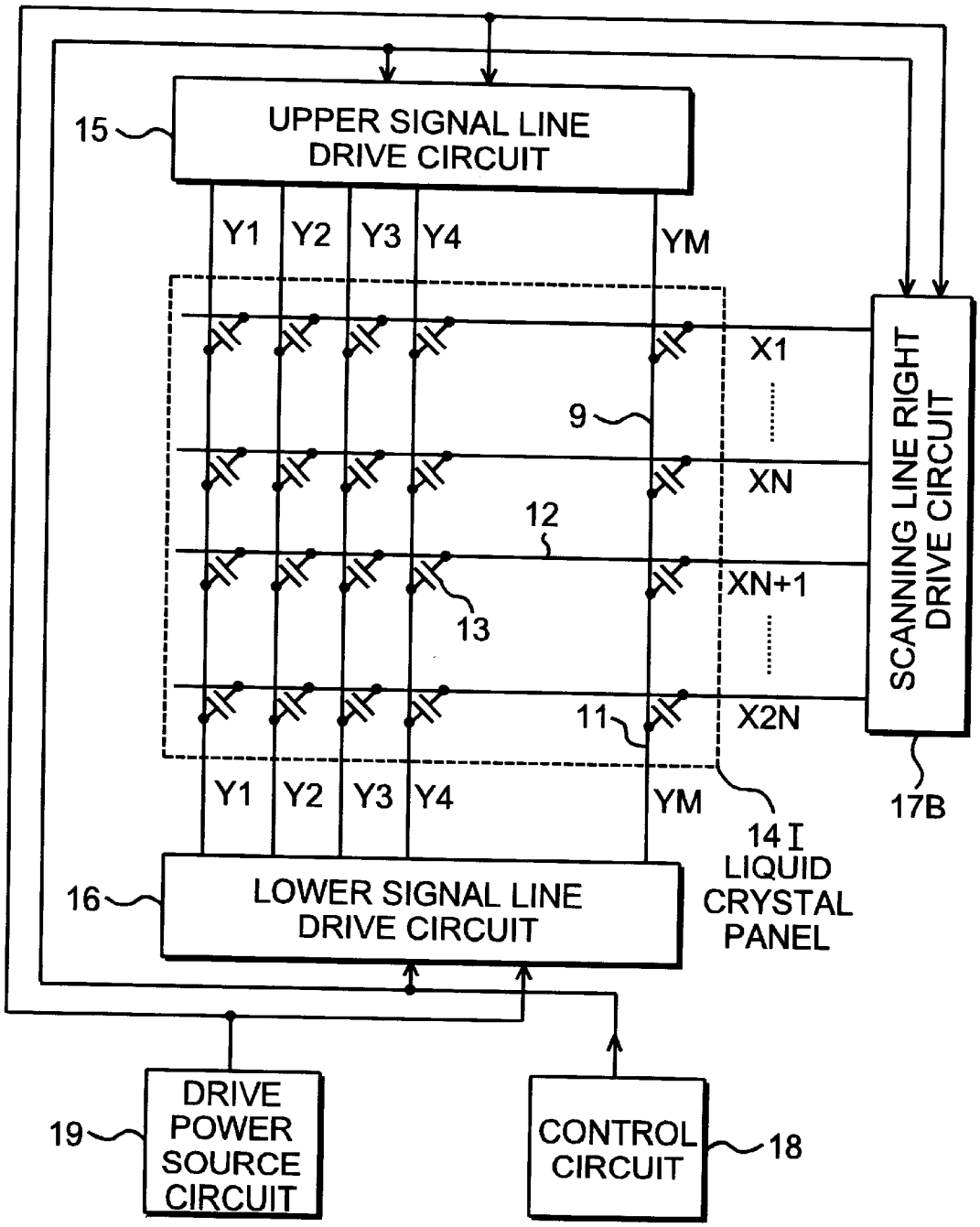
FIG. 33 is a block diagram of a liquid crystal display device in embodiment 9.

A liquid crystal display device in embodiment 9 of the invention is described below. FIG. 33 is a block diagram of the liquid crystal display device of this embodiment, and same parts as in the liquid crystal display device in FIG. 1 are identified with same reference numerals, and their explanation is omitted. In this example, scanning line drive terminals of the liquid crystal panel 14H in FIG. 25 are disposed in reverse right and left relation, and the signal line of the liquid crystal panel 14I is driven simultaneously at both ends. In such constitution, too, the same effects as in embodiment 8 are obtained.

(Embodiment 10)

Figure 34:
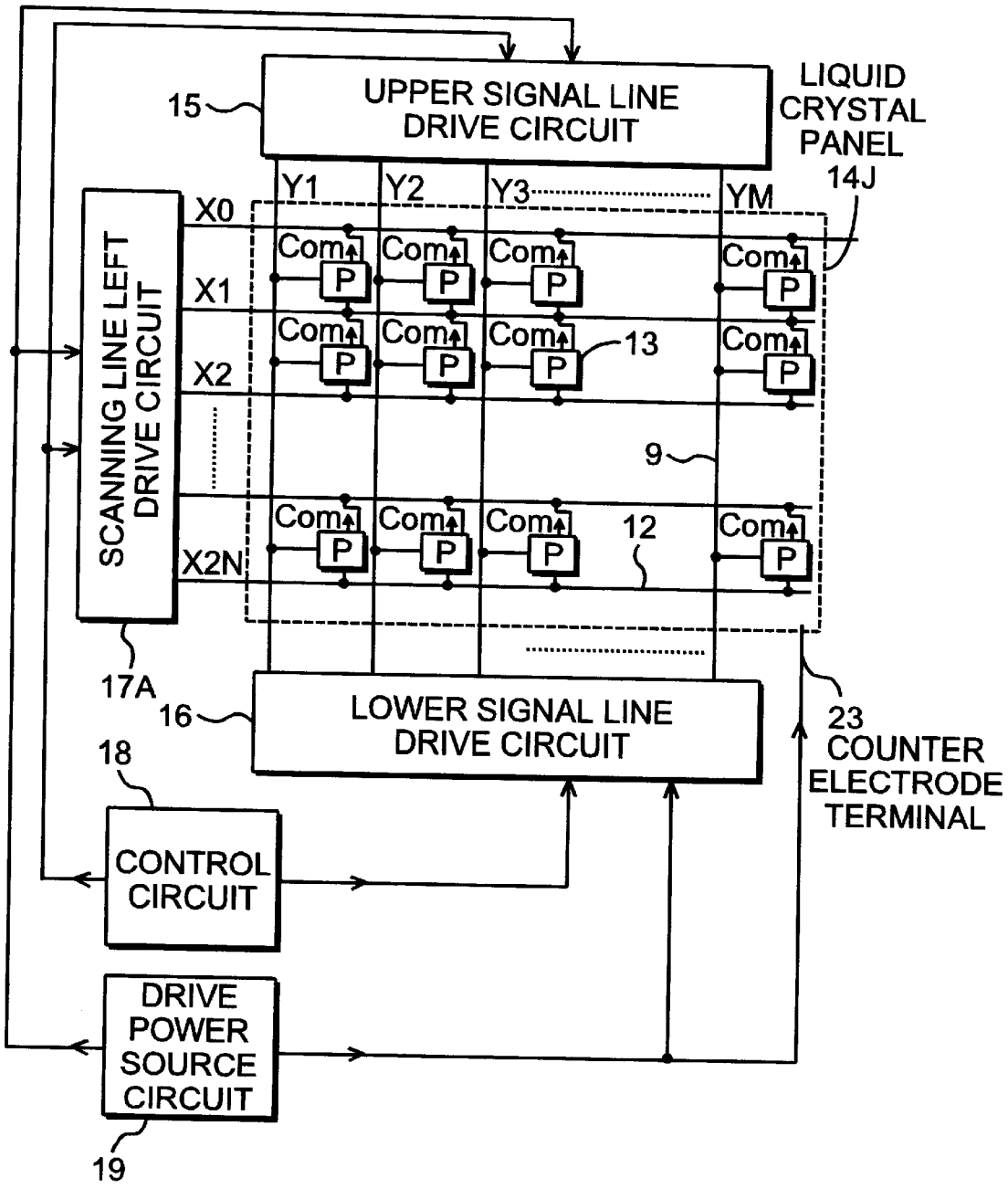
FIG. 34 is a block diagram of a liquid crystal display device in embodiment 10.

A liquid crystal display device in embodiment 10 of the invention is described below. FIG. 34 is a block diagram of the liquid crystal display device of this embodiment, and same parts as in the liquid crystal display device in FIG. 1 are identified with same reference numerals, and their explanation is omitted. In FIG. 34, both ends of the signal line 9 of the capacitive coupled TFT liquid crystal panel 14J are driven simultaneously, and the left end of the scanning line 11 is driven. The other constitution is same as in FIG. 24. As mentioned above, mostly, the signal line drive circuit of the TFT type liquid crystal panel incorporates a DA converter for realizing multi-gradation display, and the output circuit may be regarded as an analog amplifier, but for the sake of simplicity of explanation, the signal line drive circuit is composed of the same reference numerals as in FIG. 49.

The pixel capacitance of the TFT type liquid crystal panel is determined on the basis of the counter electrode as shown in embodiment 4, and therefore its constitution is different from the pixel capacitance of the simple matrix type liquid crystal panel. In FIG. 20, replacing the scanning lines by the signal lines, and supposing the wiring resistance to be rs and the pixel capacitance between the signal line and counter electrode to be cs, the signal line, same as the scanning line, can be regarded as a distributed parameter circuit, and in signal line both-end simultaneous driving, by dividing into two (or more) from the virtual terminal end, each can be expressed by the distributed parameter circuit driven at one end, and hence the signal line may be regarded as a lumped parameter circuit composed of resistance of 2N·rs and capacitor of 2N·cs from formulas (8) and (9). From the composition of the pixel shown in FIG. 17, cs may be approximated by formula (28).

$$Cs=Ccs+Cgs\cdot Ccg/(Cgs+Ccg) \quad (28)$$

Therefore, the signal line driving voltage is determined by using the pixel capacitance of formula (28) in formula (23). In driving of capacitive coupled TFT type liquid crystal panel, as shown in FIG. 17 and FIG. 18, when an ON voltage is applied to the gate of the TFT, simultaneously, the coupling voltage due to Vg+ or Vg− is applied to the drain of the TFT through the coupling capacitance Cst at the same time. This coupling voltage is supposed to be η(+) and η(−). These values η(+) and η(−) are constants determined by Cst, Cls, Cgd, etc. The voltage of the pixel selected by the scanning line is regarded to be combined with these coupling voltages η(+) and η(−) in addition to the signal line driving voltage. Accordingly, in driving of capacitive coupled TFT type liquid crystal panel, the amplitude of the signal line driving voltage can be decreased.

The effective voltage of the pixel of the capacitive coupled TFT type liquid crystal panel 14J is sample-held value of the signal line driving voltage at t=TH by the TFT. The TFT is similar to the ideal SW, and supposing the increase of effective voltage due to η(+) and η(−) to be δ, and the voltage for compensating the polarization voltage caused in the pixel as a result to be Δ, the substantial signal line driving voltage is V sig=VH−Vref1+Δ, or V sig=Vref2+Δ−VL. When this relation is applied to formula (23), and assuming t=TH, the effective voltage of the pixel is obtained. That is, supposing the output resistance of the signal line drive circuit of the capacitive coupled TFT type liquid crystal panel to be Rsw in the case of signal both-end simultaneous driving or Rss in the case of one-end driving, and the pixel at the intersection with the y-th scanning line from the drive end of signal line to be virtual terminal end or divided terminal end, the effective voltage of the pixel is expressed in formula (29), in which the number of scanning lines is 2N, the horizontal scanning time is TH, the operation reference voltage at VH is Vref1, and the operation reference voltage at VL is Vref2.

In signal line both-end simultaneous driving, the effective voltage of the pixel, assuming y≦N, is $$Vrmssw(y)=(Vsig-\Delta)\cdot[1-2\exp\{-\pi^2\cdot TH/(4y2\cdot rs\cdot cs\cdot+2\pi\cdot y\cdot cs\cdot Rsw\}]+\delta$$

In signal line one-end driving, the effective voltage of the pixel, assuming y≦2N, is $$Vrmsss(y)=(Vsig-\Delta)\cdot[1-2\exp\{-\pi^2\cdot TH/(4y^2\cdot rs\cdot cs+2\pi\cdot y\cdot cs\cdot Rss\}]+\delta \quad (29)$$

The effective voltage ratio of virtual terminal end or terminal end and drive end of signal line is given in formula (30) by using the effective voltage at drive end (Vsig−Δ)+δ and formula (29).

In signal line both-end simultaneous driving, the effective voltage ratio γ sw, assuming y=N, is $$\gamma sw\approx[1-2\exp\{-\pi^2\cdot TH/(4N^2\cdot rs\cdot cs+2\pi\cdot N\cdot cs\cdot Rsw\}]$$

In signal line one-end driving, the effective voltage ratio γss, assuming y=2N, is $$\gamma ss\approx[1-2\exp\{-\pi_2\cdot TH/(16N^2cs\cdot rs+4\pi\cdot N\cdot cs\cdot Rss\}] \quad (30)$$

Also in the capacitive coupled TFT type liquid crystal panel in signal line both-end simultaneous driving, the longitudinal luminance error is smaller than in signal line one-end driving as shown in formula (30). The waveform distortion is also about ¼, and the longitudinal crosstalk is smaller.

Supposing the effective voltage ratio of virtual terminal end and drive end of signal line in signal line both-end simultaneously driving to be γls and the effective voltage ratio of terminal end and drive end in one-side driving to be γ2s, the output resistance range of signal line driving circuit of TFT type liquid crystal panel is obtained from formula (30) as expressed in formula (31).

In signal line both-end simultaneous driving, $$Rsw\leqq-2N\cdot rs/\pi-\pi\cdot TH/[2N\cdot cs\cdot ln\{(1-\gamma\mathbf{1}s)/2\}]$$

In signal line one-end driving, $$Rss\leqq-4N\cdot rs/\pi-\pi\cdot TH/[4N\cdot cs\cdot ln\{(1-\gamma\mathbf{2}s)/2\}] \quad (31)$$

Thus, in signal line both-end simultaneous driving of the capacitive coupled TFT type liquid crystal panel, too, the signal line can be expressed as a series circuit composed of resistance of 2N·rs/π and capacitance of 2N·cs/π, and the same effects as in embodiment 8 are obtained.

(Embodiment 11)

Figure 35:
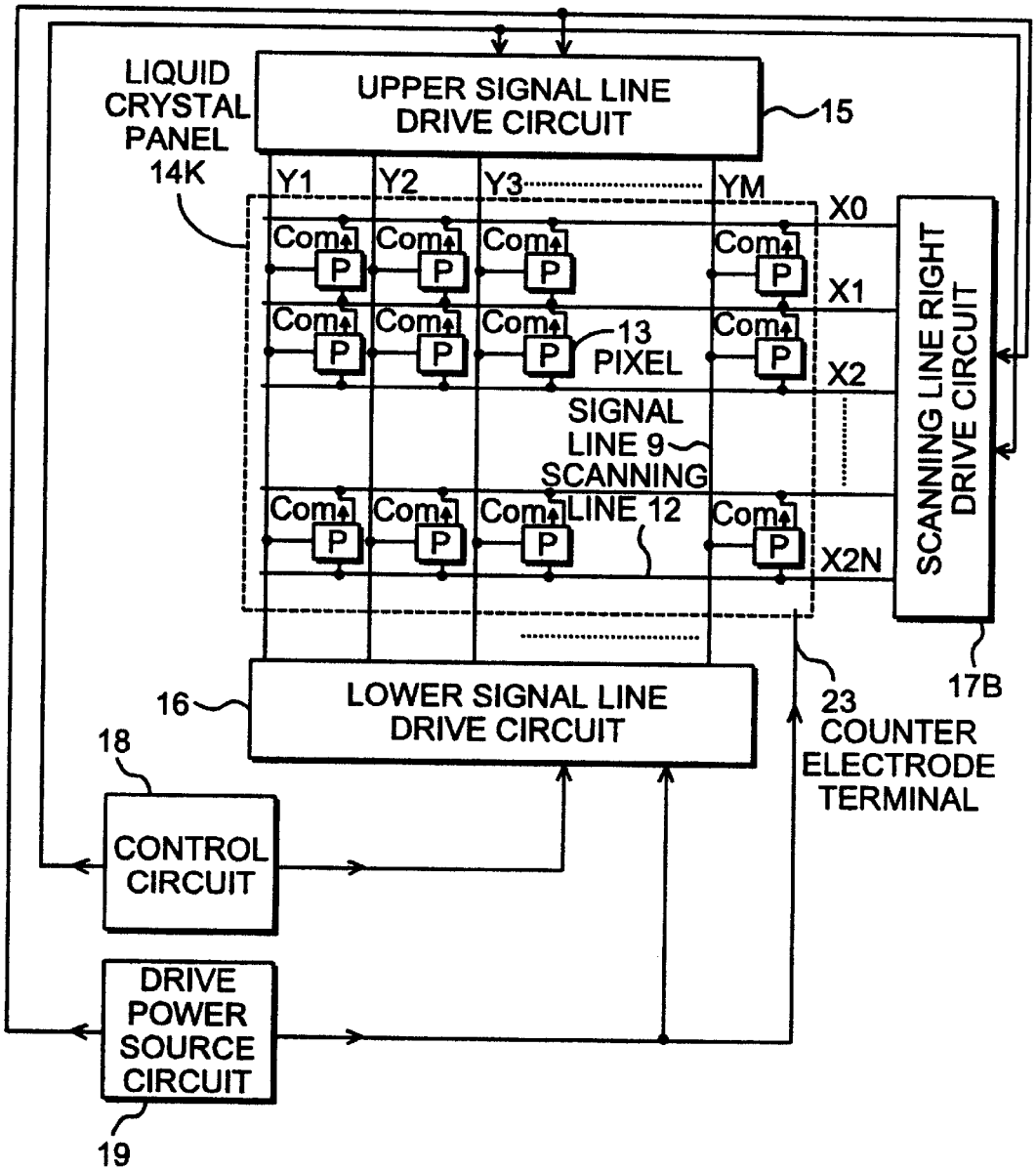
FIG. 35 is a block diagram of a liquid crystal display device in embodiment 11.

A liquid crystal display device in embodiment 11 of the invention is described below. FIG. 35 is a block diagram of the liquid crystal display device of this embodiment, and same parts as in the liquid crystal display device in FIG. 1 are identified with same reference numerals, and their explanation is omitted. In this embodiment, scanning line drive terminals of the liquid crystal panel 14J in FIG. 34 are disposed in reverse right and left relation, and the signal line of the liquid crystal panel 14K is driven simultaneously at both ends. In such constitution, too, the same effects as in embodiment 10 are obtained.

(Embodiment 12)

Figure 36:
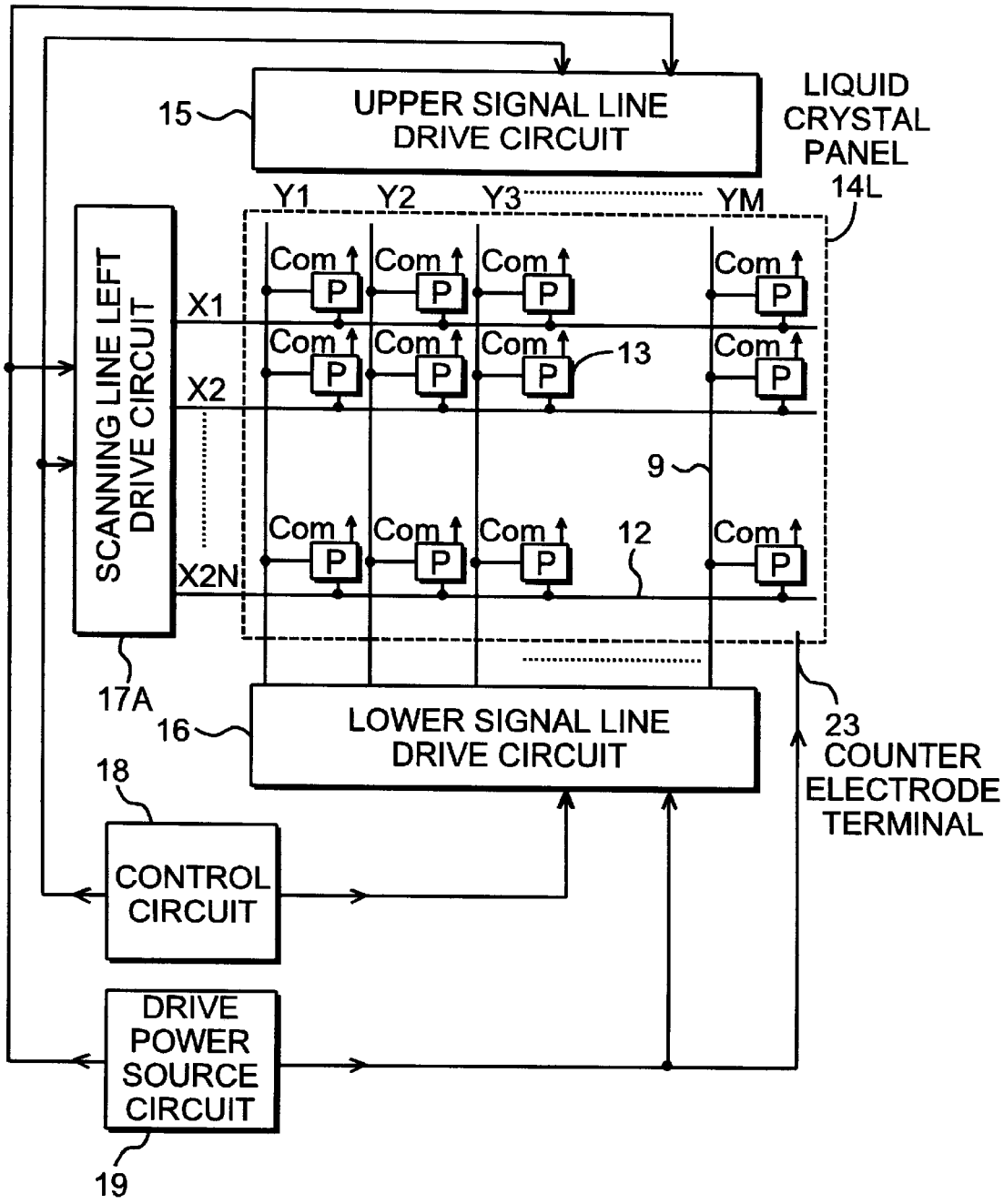
FIG. 36 is a block diagram of a liquid crystal display device in embodiment 12.

A liquid crystal display device in embodiment 12 of the invention is described below. FIG. 36 is a block diagram of the liquid crystal display device of this embodiment, and same parts as in the liquid crystal display device in FIG. 1 are identified with same reference numerals, and their explanation is omitted. The liquid crystal panel 14L in FIG. 36 is for signal line both-end simultaneous driving of the TFT type liquid crystal panel not coupled capacitively. In such constitution, too, the formulas (23), (24), and (28) to (31) can be applied, and the same effects as in embodiments are obtained.

(Embodiment 13)

Figure 37:
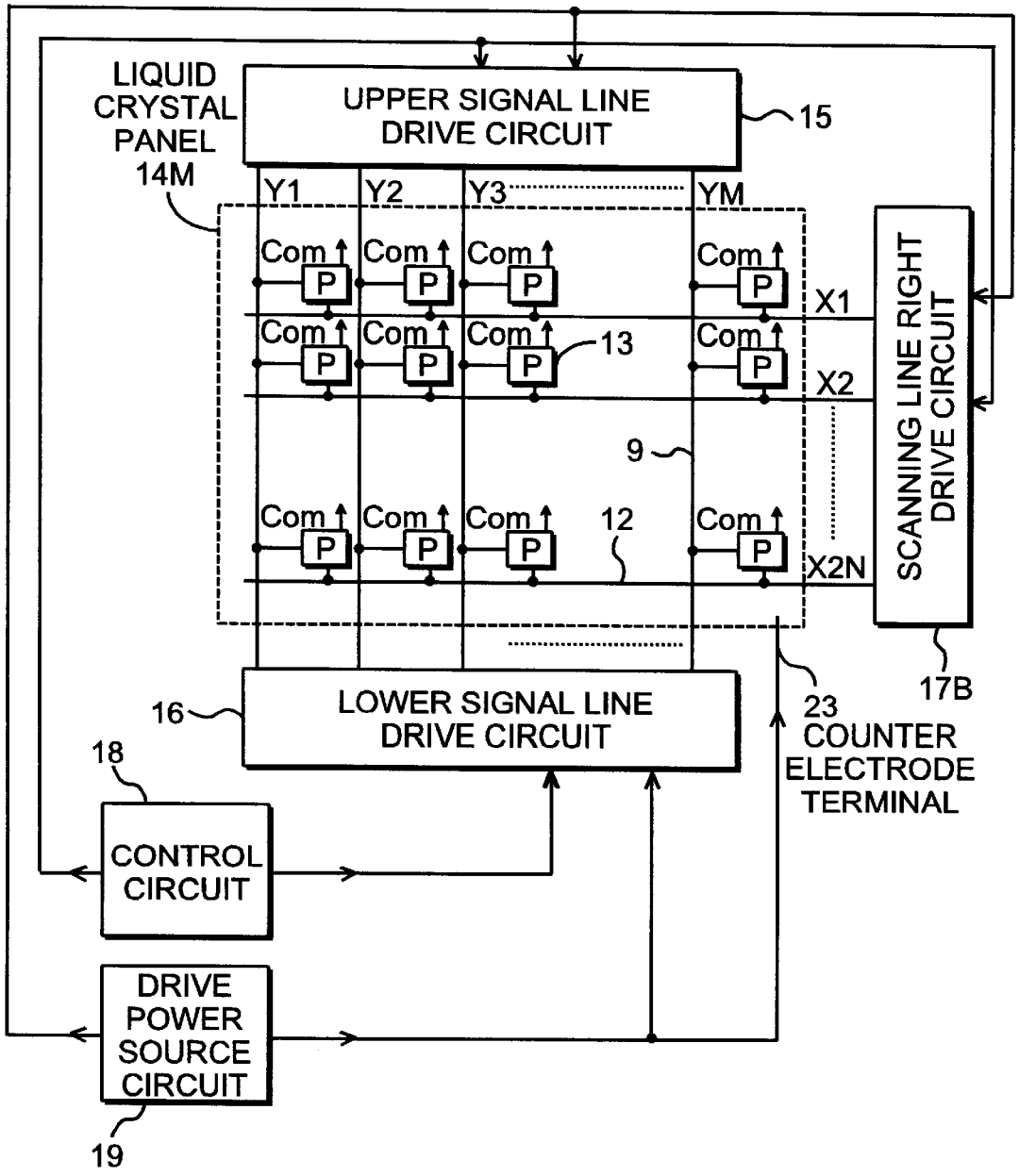
FIG. 37 is a block diagram of a liquid crystal display device in embodiment 13.

A liquid crystal display device in embodiment 13 of the invention is described below. FIG. 37 is a block diagram of the liquid crystal display device of this embodiment, and same parts as in the liquid crystal display device in FIG. 1 are identified with same reference numerals, and their explanation is omitted. In this embodiment, scanning line drive terminals of the liquid crystal panel 14L in FIG. 36 are disposed in reverse right and left relation, and the signal line of the liquid crystal panel 14M is driven simultaneously at both ends. In such constitution, too, the same effects as in embodiment 11 are obtained.

(Embodiment 14)

Figure 40:
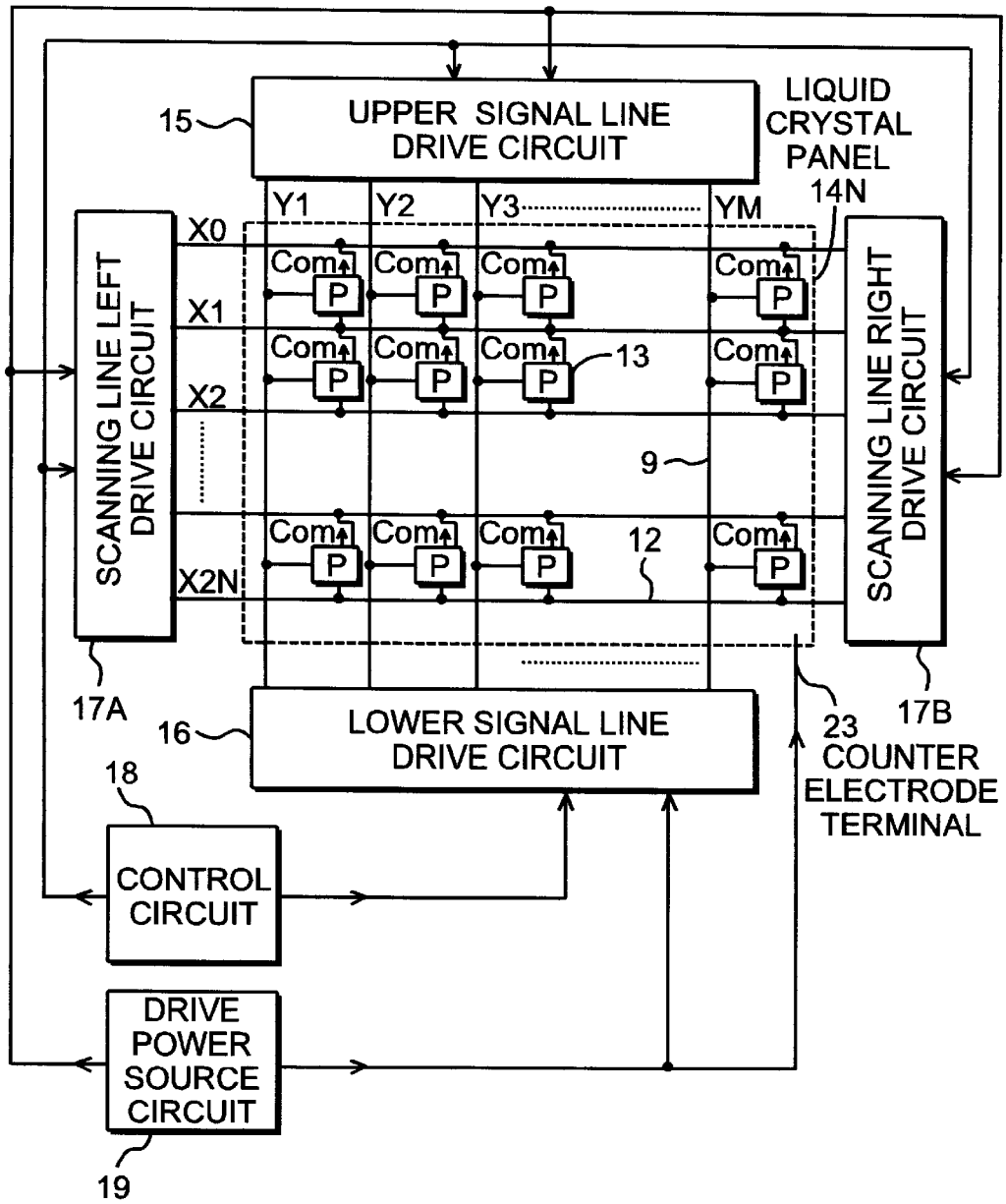
FIG. 40 is a block diagram of a liquid crystal display device in embodiment 14.

A liquid crystal display device in embodiment 14 of the invention is described below. FIG. 40 is a block diagram of the liquid crystal display device of this embodiment, and same parts as in the liquid crystal display device in FIG. 1 are identified with same reference numerals, and their explanation is omitted. In the embodiment, both ends of signal lines 9 and scanning lines 12 of the capacitive coupled TFT type liquid crystal panel 14N are driven simultaneously.

Figure 42:
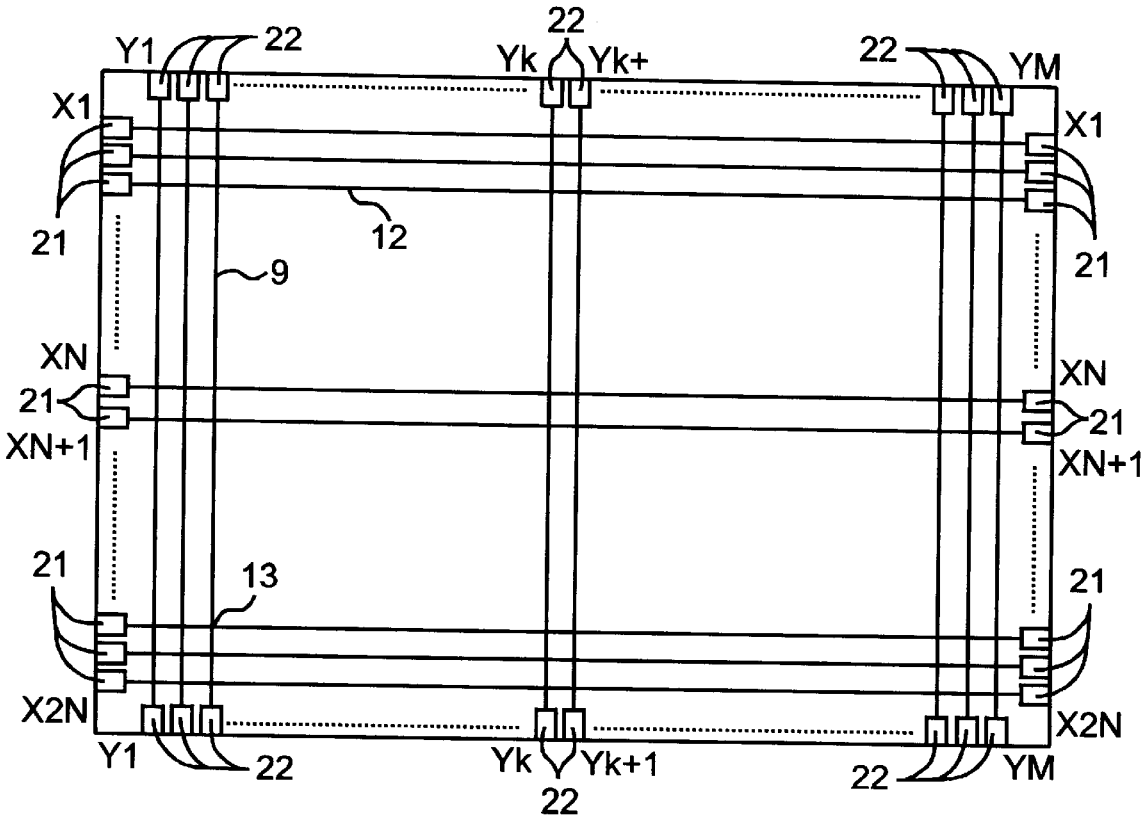
FIG. 42 is a block diagram of a liquid crystal panel having drive terminals at both ends of scanning lines and signal lines.

This embodiment is applied to driving of extra-large liquid crystal panel. Besides, this embodiment is also suited for the case necessary to use a drive circuit insufficient in driving capacitance, for example, a liquid crystal panel having a drive circuit formed (a liquid crystal panel using polysilicon TFT, etc.) or disposed (by mounting technology of chip-on-glass, etc.) outside of the image display region of the liquid crystal panel. A drive terminal structure of the liquid crystal panel 14N is shown in FIG. 42.

The results and effects about signal line both-end simultaneous driving and scanning line both-end simultaneous driving already explained can be applied directly. That is, the signal line can be expressed as a series circuit composed of resistance of 2N·rs/π and capacitance of 2N·cs/π, and the scanning line can be expressed as a series circuit composed of resistance of M·r/π and capacitance of M·c./π.

(Embodiment 15)

Figure 41:
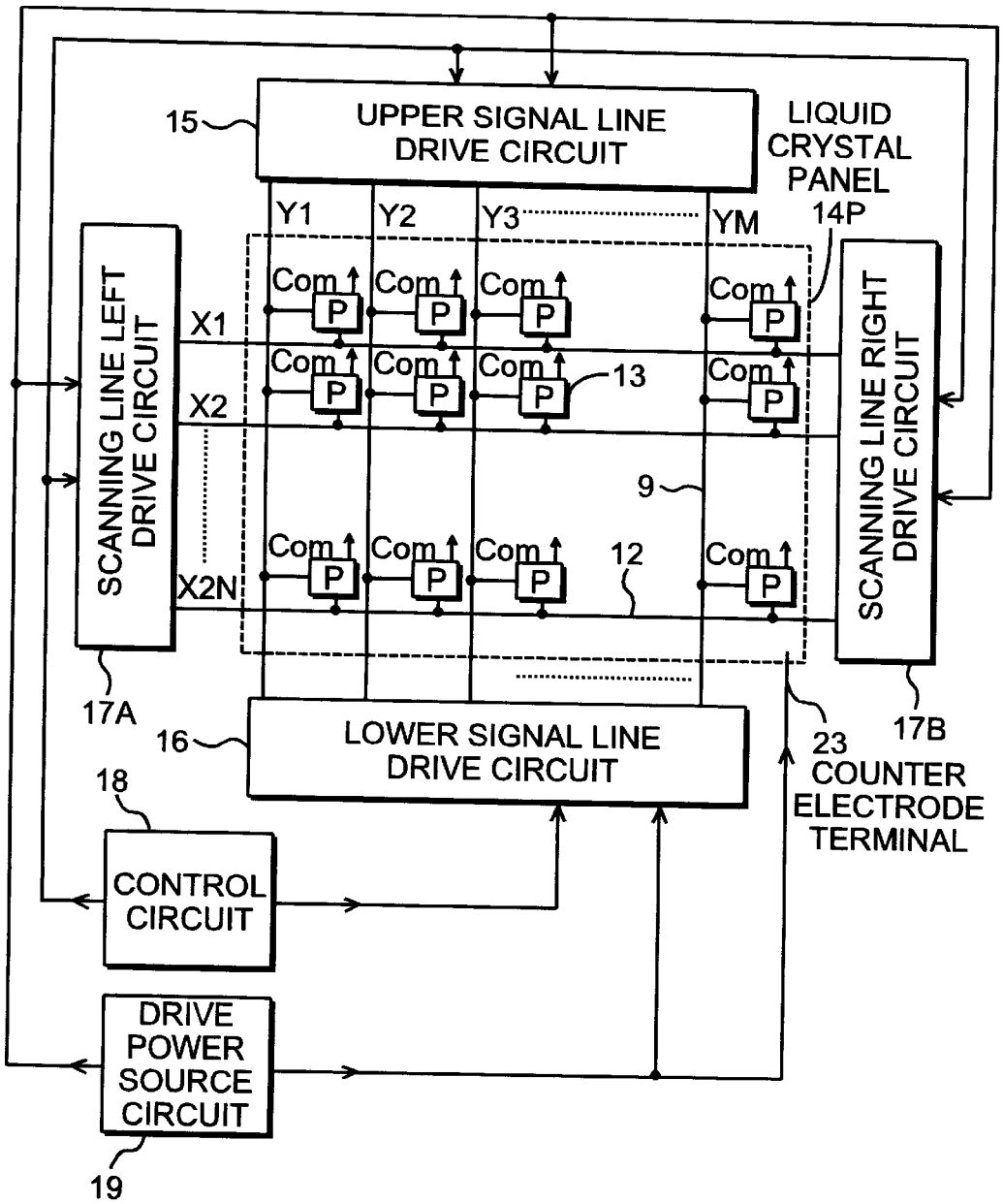
FIG. 41 is a block diagram of a liquid crystal display device in embodiment 15.

A liquid crystal display device in embodiment 15 of the invention is described below. FIG. 41 is a block diagram of the liquid crystal display device of this embodiment, and same parts as in the liquid crystal display device in FIG. 1 are identified with same reference numerals, and their explanation is omitted. In this embodiment, both ends of signal lines 9 and scanning lines 12 of TFT type liquid crystal panel 14P not coupled capacitively are driven simultaneously. In such constitution, too, the same effects as in embodiment 14 are obtained.

(Embodiment 16)

Figure 43:
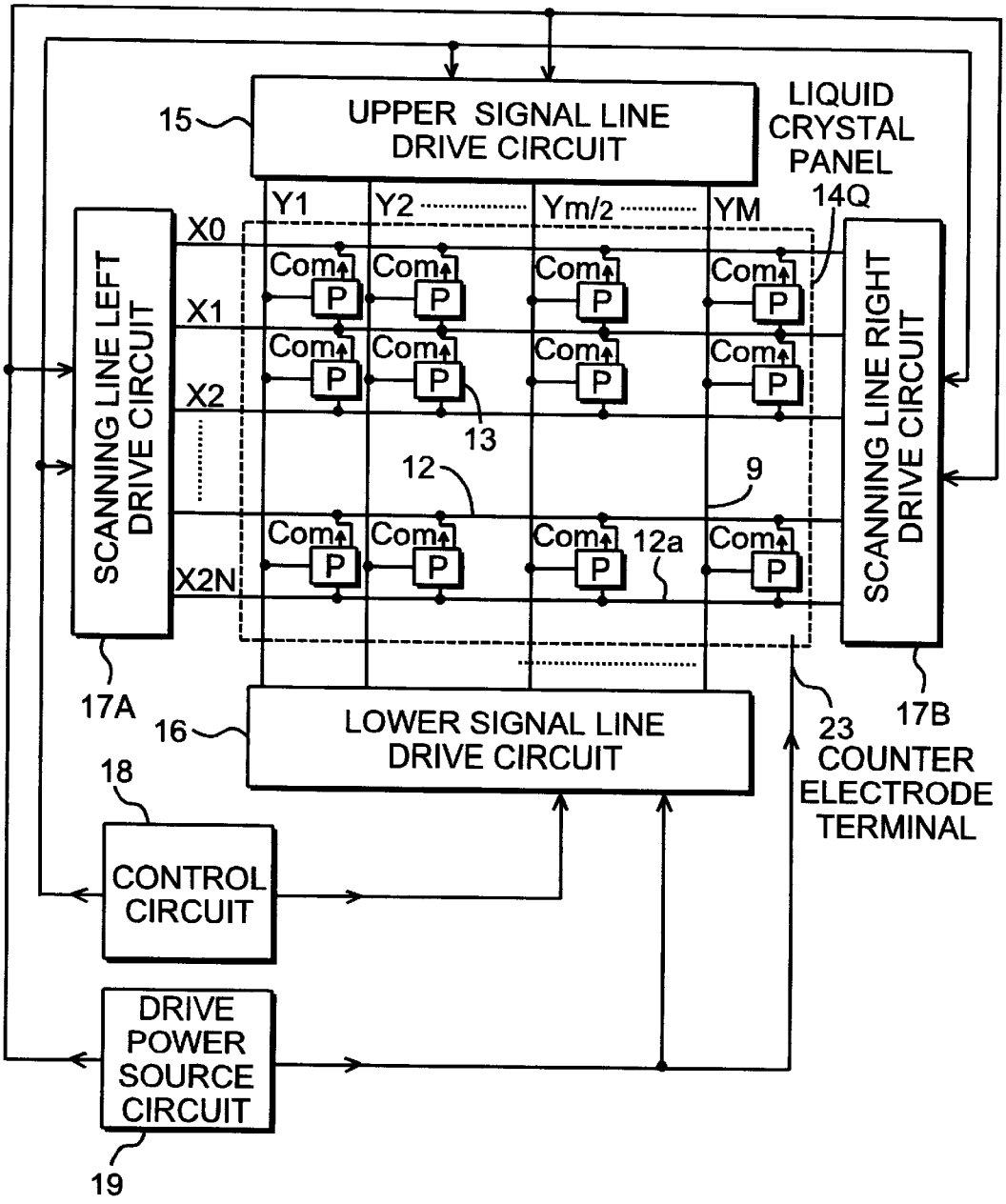
FIG. 43 is a block diagram of a liquid crystal display device in embodiment 16.
Figure 44:
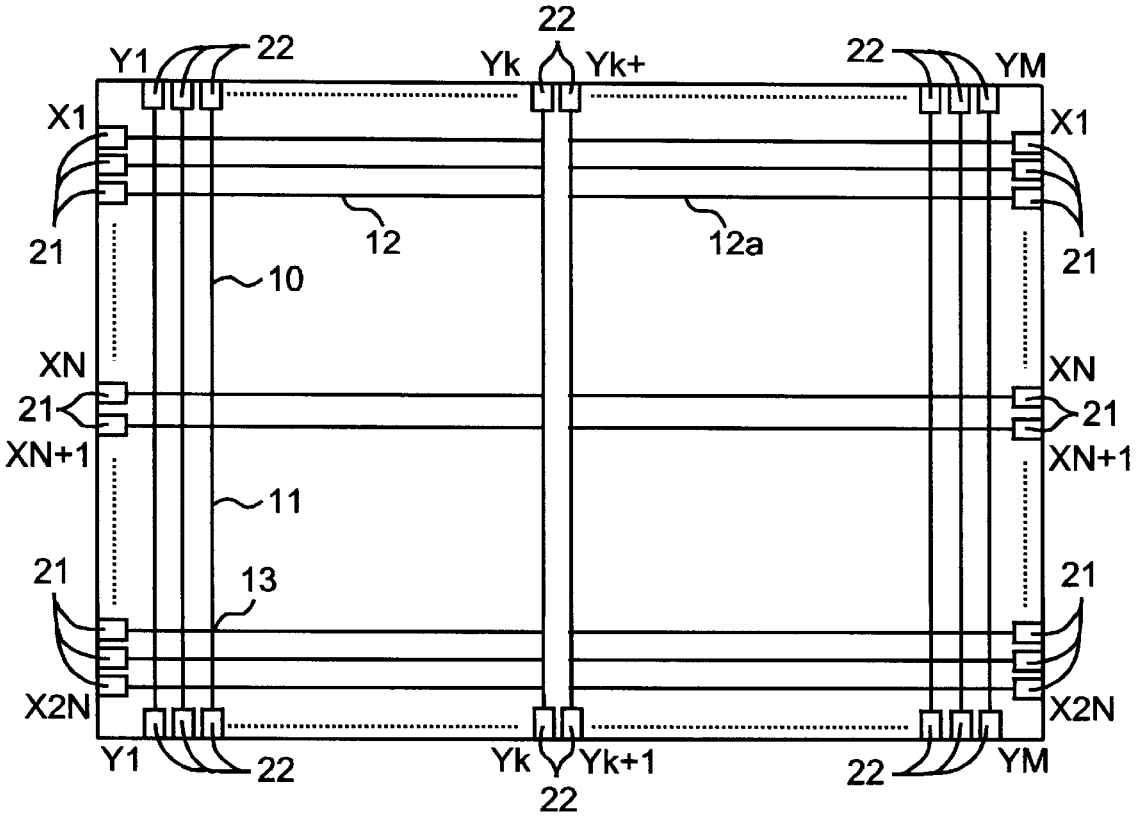
FIG. 44 is a block diagram of a liquid crystal panel having drive terminals at the ends of right and left scanning lines and at both ends of signal lines.

A liquid crystal display device in embodiment 16 of the invention is described below. FIG. 43 is a block diagram of the liquid crystal display device of this embodiment, and same parts as in the liquid crystal display device in FIG. 1 are identified with same reference numerals, and their explanation is omitted. In the embodiment, both ends of signal lines 9 of the capacitive coupled TFT type liquid crystal panel 14Q, and right scanning line and left scanning line are driven simultaneously. The embodiment is applied to an extra-large liquid crystal display device, and it is also effective when dividing the display screen into two sections and displaying different pieces of information. It is similarly applied with same effects also in the TFT type liquid crystal panel not coupled capacitively, simple matrix type liquid crystal panel, and liquid crystal panel forming or disposing drive circuit of signal lines and scanning lines outside of the image region of the liquid crystal panel. The drive terminal structure of the liquid crystal panel 14Q is shown in FIG. 44. The results and effects about signal line both-end simultaneous driving and scanning line both-end simultaneous driving already explained can be applied directly. That is, the signal line can be expressed as a series circuit composed of resistance of 2N·rs/π and capacitance of 2N·cs/π, and the scanning line can be expressed as a series circuit composed of resistance of M·r/π and capacitance of M·c/π.

(Embodiment 17)

Figure 45:
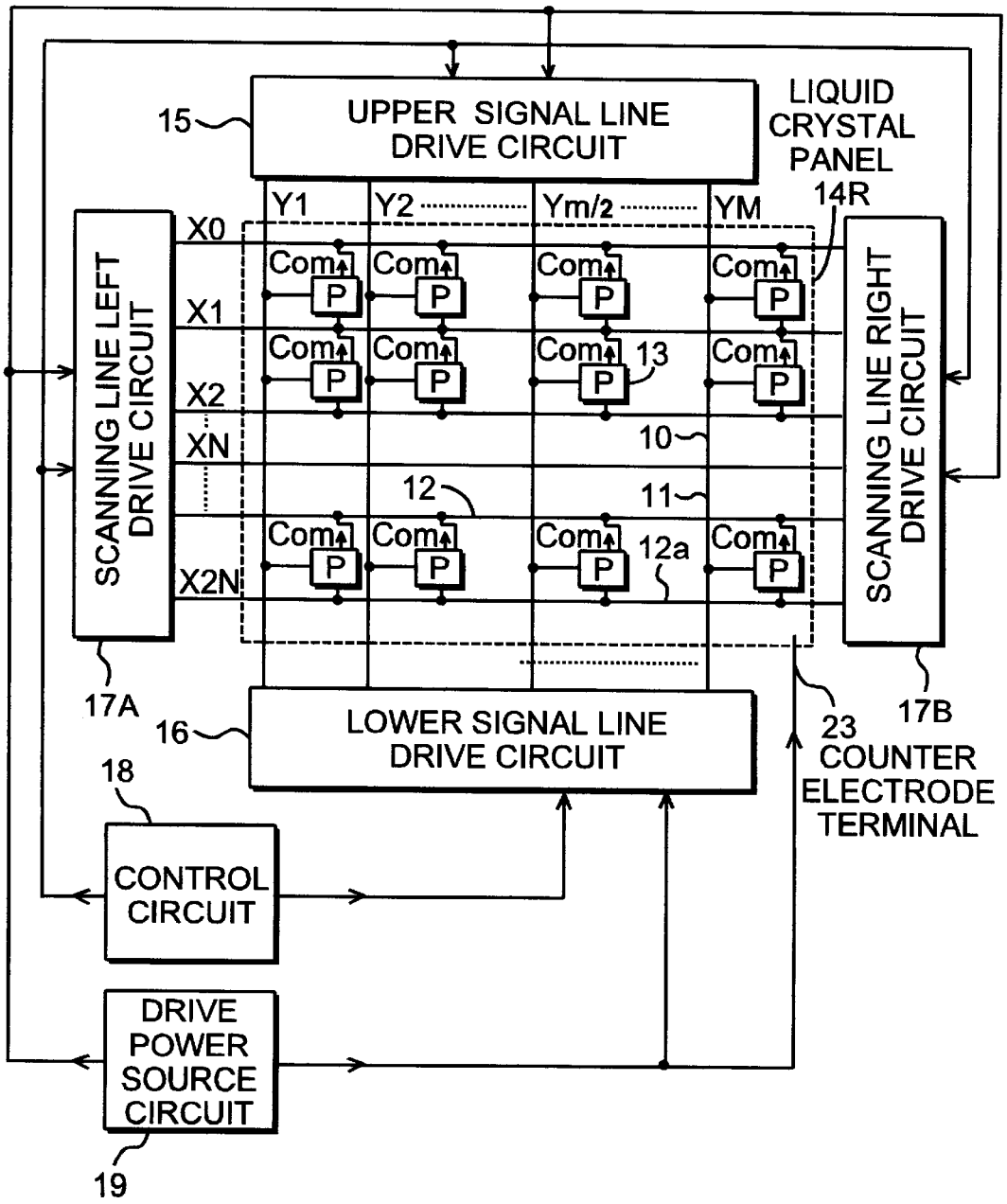
FIG. 45 is a block diagram of a liquid crystal display device in embodiment 17.
Figure 46:
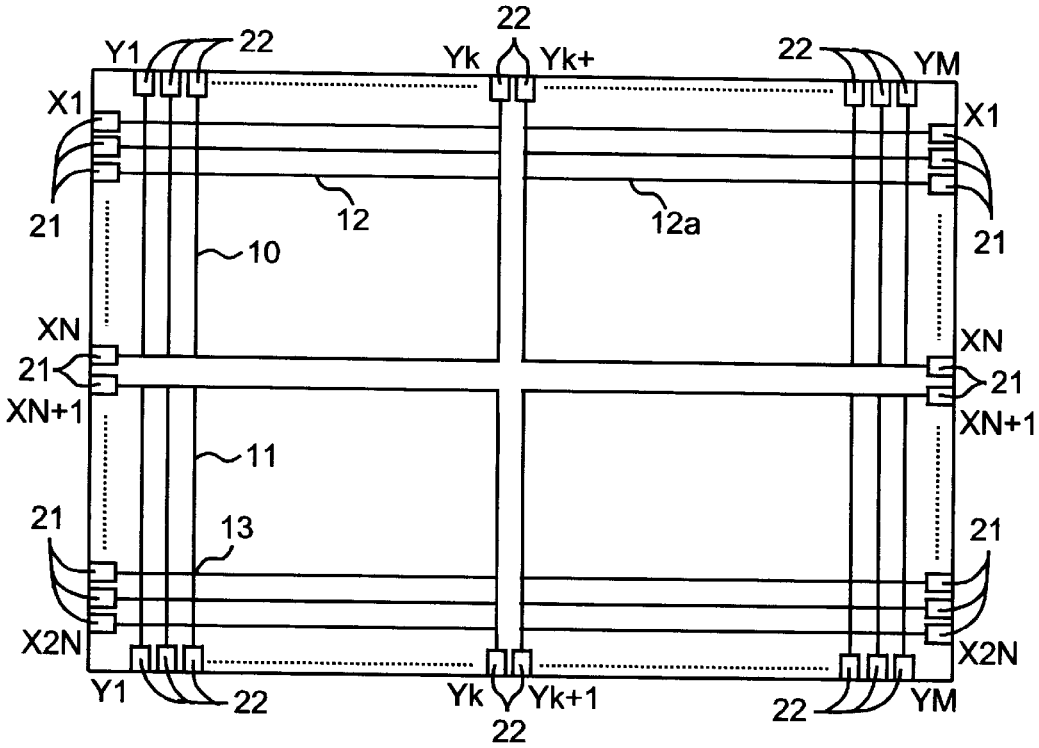
FIG. 46 is a block diagram of a liquid crystal panel having drive terminals in right and left scanning lines and upper and lower signal lines.

A liquid crystal display device in embodiment 17 of the invention is described below. FIG. 45 is a block diagram of the liquid crystal display device of this embodiment, and same parts as in the liquid crystal display device in FIG. 1 are identified with same reference numerals, and their explanation is omitted. In the embodiment, signal lines and scanning lines are divided into two respectively, and the capacitive coupled TFT type liquid crystal panel 14R is driven simultaneously at both ends. The embodiment is applied to an extra-large liquid crystal display device, and it is also effective when dividing the display screen into four sections and displaying different pieces of information. It is similarly applied with same effects also in the TFT type liquid crystal panel not coupled capacitively, simple matrix type liquid crystal panel, and liquid crystal panel forming or disposing drive circuit around the liquid crystal panel. The drive terminal structure of the liquid crystal panel 14R is shown in FIG. 46.

The results and effects about signal line both-end simultaneous driving and scanning line both-end simultaneous driving already explained can be applied directly. That is, the signal line can be expressed as a series circuit composed of resistance of 2N·rs/π and capacitance of 2N·cs/π, and the scanning line can be expressed as a series circuit composed of resistance of M·r/π and capacitance of M·c/π.

(Embodiment 18)

Figure 47:
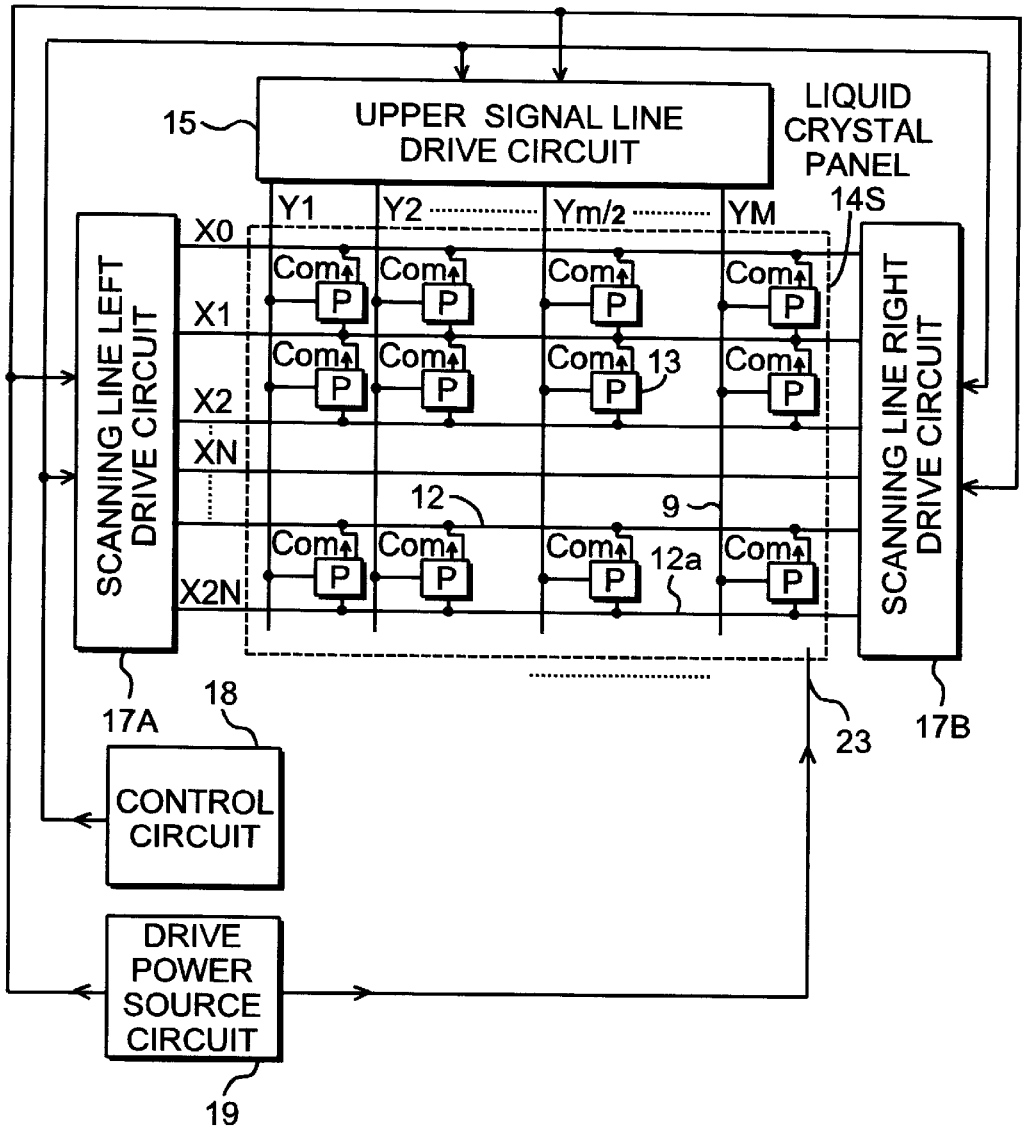
FIG. 47 is a block diagram of a liquid crystal display device in embodiment 18.

A liquid crystal display device in embodiment 18 of the invention is described below. FIG. 47 is a block diagram of the liquid crystal display device of this embodiment, and same parts as in the liquid crystal display device in FIG. 1 are identified with same reference numerals, and their explanation is omitted. In the embodiment, the scanning line is divided into left scanning line 12 and right scanning line 12*a,* and in this liquid crystal panel 14S, the right and left scanning lines are driven simultaneously, while the signal line 9 is driven at one end. This embodiment is suited to a large display device with a wide screen, for dividing the screen into two sections and displaying independent pieces of information.

In the embodiment, too, the results and effects about signal line one-end simultaneous driving and scanning line both-end simultaneous driving already explained can be applied directly. That is, the signal line can be expressed as a series circuit composed of resistance of 4N·rs/π and capacitance of 4N·cs/π, and the scanning line can be expressed as a series circuit composed of resistance of M·r/π and capacitance of M·c/π.

The liquid crystal panel 14S in FIG. 47 is of capacitive coupled TFT type, same effects are obtained in the TFT type not coupled capacitively, or the liquid crystal panel forming or disposing a drive circuit outside of the image display region of the liquid crystal panel. The drive terminal structure of the liquid crystal panel 14S is shown in FIG. 48.

Figure 48:
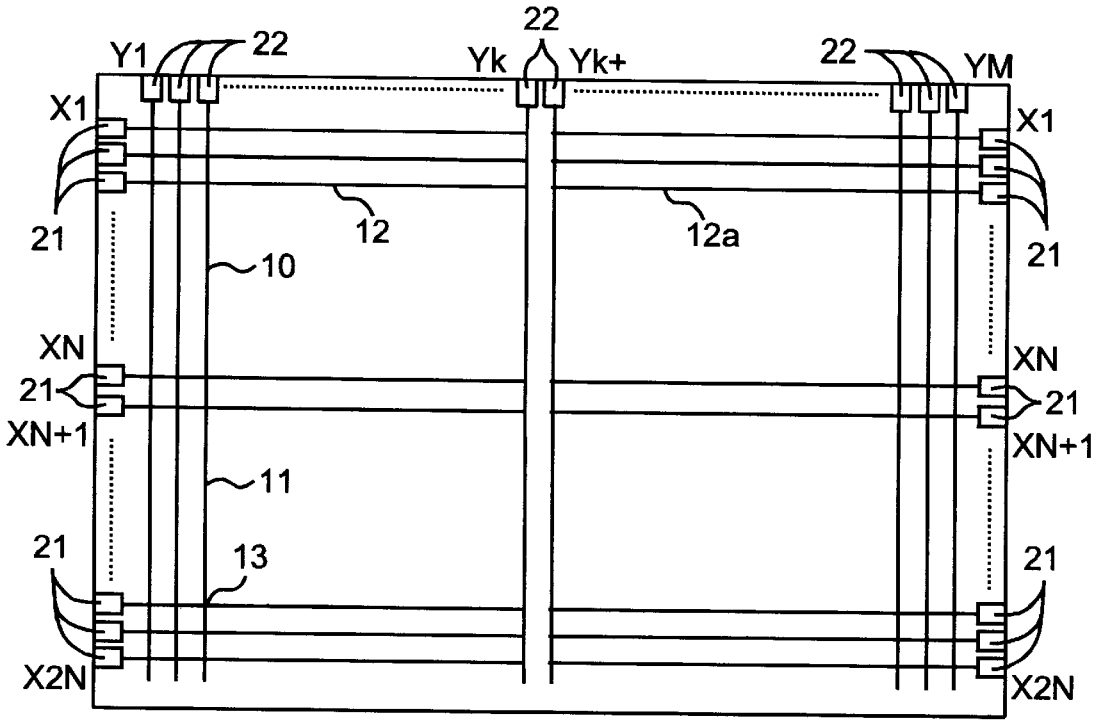
FIG. 48 is a block diagram of a liquid crystal panel having drive terminals in right and left scanning lines.

Incidentally, when the signal line drive terminals are formed upside down of the liquid crystal panel 14S in FIG. 48, the same effects are obtained by one-end driving by lower signal line drive circuit.

The ratio of time constant for both-end driving and one-end driving is determined as follows. Supposing the time constant at terminal end of one-end driving of scanning line to be αgs, and the time constant at virtual terminal end or terminal end of scanning line divided into two in both-end driving to be αgw (screen central pixel), by using formula (18), the ratio of αgs/αgw is expressed as shown in formula (32).

$$\begin{aligned}\alpha gs/\alpha gw &= (4r\cdot c\cdot M^2 + 2\pi\cdot M\cdot c\cdot Rgs)/ \\ &\quad (r\cdot c\cdot M^2 + \pi\cdot M\cdot c\cdot /Rgw) \\ &= \{4 + 2\pi\cdot Rgs/(r\cdot M)\}/\{1 + \pi\cdot Rgw/(r\cdot M)\}\end{aligned} \tag{32}$$

Herein, supposing the constant to be k and αgas/αgw≧k, from formula (32), the following is obtained.

$$Rgs \geqq (k-4)r\cdot M/(2\pi) + k\cdot Rgw/2$$

Assuming k=4, when the time constant in both-end driving is ¼ of the time constant in one-end driving, and there is no effect of wiring resistance, the relation of Rgs and Rgw is obtained. That is, $$Rgs \geqq 2Rgw \quad (33)$$

Thus, if the output resistance of the both-end driving is ½ or less of the output resistance at one end, the time constant is ¼ of one-end driving, and it is known that there is no effect of wiring resistance. Formula (33) is very effective when estimating the output resistance in one-end or both-end driving. This is because the output resistance in both-end driving can be easily predicted from the drive circuit of one-end driving. The same results are obtained in the signal lines.

In the diagrams of the foregoing embodiments, the scanning line drive circuit and signal line drive circuit are disposed outside of the liquid crystal panel, but they may be also formed in the portion outside of the image display region of the liquid crystal display panel by COG (chip on glass) technique, or by TAB (tape automated bonding) technique outside of the image display region, even in the region overlapping with the liquid crystal panel.

Finally, reference numerals used in the drawings are briefly explained. The signal line drive circuits are indicated by the same reference numerals 15 and 16 throughout all the drawings. Actually, however, between the TFT type liquid crystal panel and simple matrix type liquid crystal panel, the constitution of the signal line drive circuit is different, and the signal line drive circuit in FIG. 1 cannot be applied in FIG. 16. In principle, they should be expressed differently, but in such a case the reference numerals are increased and complicated, and since the functions of driving the signal lines are the same, the same reference numerals are commonly used for the signal line drive circuits throughout the drawings (it is not meant that the detail of the specification is identical).

As for the drive power source circuit, since the function of supplying driving voltage to the scanning line or the signal line drive circuit is same in all drive power source circuits, the reference numeral 19 is commonly used in all drawings (it is not meant that the detail of the specification is identical). The reference numerals of scanning line drive circuits and control circuits are also given according to the same concept.

Incidentally, the scanning line and signal line drive circuits, drive power source circuit, control circuit and others in the drawings are mass-produced at the present, and the structure and operating principle of these circuits are known, and hence the explanation is omitted except for the parts particularly necessary for description of the invention of the present application (for example, the analog switch for composing the output circuit of drive circuit).

In the equivalent circuit of liquid crystal panel, and equivalent circuit of TFT, only the parameters that can be clearly handled numerically in design or in theory were included (for example, wiring resistance, capacitance between electrodes of TFT, liquid crystal capacitance, capacitance at intersection of signal line and scanning line). The coincidence between the calculated values using these parameters and measured values is proved.

However, for example, by wiring to connect the drive end of scanning line or signal line and the drive circuit, wiring resistance and parasitic capacitance are formed, and parameters not expressed in the invention are actually present, but they are omitted. This is because such parasitic capacitance and wiring resistance are small numerically and induce only small errors if ignored, and, if necessary, they can be calculated later by using the formulas presented in the invention.

Thus, according to the invention as set forth in claims 1 to 11, by driving the scanning lines or signals lines of the liquid crystal panel simultaneously at both ends, if the driving current of scanning lines or signal lines is same as in one-end driving, the delay time of the scanning line driving voltage or signal line driving voltage applied to each pixel of the liquid crystal panel can be reduced as compared with one-end-driving. As a result, in the large-sized liquid crystal display device of long diagonal length and large in the number of pixels in the horizontal direction and vertical direction, luminance unevenness can be decreased. Moreover, in two scanning line drive circuits or signal line drive circuits necessary for both-end simultaneous driving of scanning lines or signal lines of the liquid crystal panel, ICs of identical pattern can be used, so that the cost required for simultaneous driving is not so much increased.

In particular, according to the invention by expressing the scanning lines driven simultaneously at both ends, being divided virtually into two at virtual terminal end or divided evenly into two, by a lumped parameter circuit composed of resistance of $M \cdot r/\pi$ and capacitance of $M \cdot c/\pi$, or by expressing the signal lines driven simultaneously at both ends, being divided virtually into two at virtual terminal end or divided evenly into two, by a lumped parameter circuit composed of resistance of $2N \cdot rs/\pi$ and capacitance of $2N \cdot cs/\pi$, the luminance distribution in the scanning line direction of each pixel or the luminance distribution in the signal line direction can be accurately predicted. By using such equivalent circuit, a liquid crystal display device setting the luminance unevenness within a specified value can be designed.

In particular, according to the invention, the output resistance of the drive circuit for scanning line both-end simultaneous driving or signal line both-end simultaneous driving can be determined optimally.

In particular, according to the invention the driving current of the drive circuit for scanning line both-end simultaneous driving or signal line both-end simultaneous driving can be obtained accurately.

In particular, according to the invention in the liquid crystal panel by scanning line both-end simultaneous driving or signal line both-end simultaneous driving, the ratio of effective voltage applied to the pixel at the center of the scanning line or signal lines to effective voltage applied to the pixel at the drive end can be obtained accurately.

In particular, according to the invention, the threshold voltage of the TFT type liquid crystal panel by scanning line both-end simultaneous driving can be obtained.

Also, according to the invention, even in the case of one-end driving of scanning lines or signal lines of the liquid crystal panel, by expressing the equivalent circuit of each scanning line by a lumped parameter circuit composed of resistance of $2M \cdot r/\pi$ and capacitance of $2M \cdot c/\pi$, and similarly by expressing the equivalent circuit of each signal line by a lumped parameter circuit composed of resistance of $4N \cdot rs/\pi$ and capacitance of $4N \cdot cs/\pi$, the driving voltage of each pixel, effective voltage ratio of drive end and terminal end, threshold voltage of liquid crystal panel, output resistance of drive circuit, and driving current of drive circuit can be analyzed or set more accurately.

What is claimed is:

1. A liquid crystal display device comprising:

a liquid crystal panel having plural signal lines and plural scanning lines disposed in a matrix, and disposing pixels at intersections of said signal lines and scanning lines, where the optical state of the liquid crystal cells of said pixels is changed by applying a voltage to said scanning lines and signal lines corresponding to said pixels, at least one signal line drive circuit selected from first and second signal line drive circuits for applying a signal line drive voltage in every horizontal scanning to one end and to the other end, respectively, of said signal lines, at least one scanning line drive circuit selected from first and second scanning line drive circuits for applying a scanning line drive voltage to one end and to the other end, respectively, of said scanning line to be activated at the horizontal scanning, and a control circuit for instructing generation of said signal line voltage in synchronism with said scanning line driving voltage to said signal line drive circuit on the basis of an input image signal, wherein, at least either said signal lines or said scanning lines are driven by both end drive scheme, that is, both first and second drive circuits are selected, and when the scanning lines are driven by both end drive scheme, an output resistance of said scanning line drive circuits is set below one half of the output resistance of the scanning drive circuit used in single end drive scheme, and when the signal lines are driven by both end drive scheme, an output resistance of said signal line drive circuit is set below one half of the output resistance of the signal drive circuit used in single end drive scheme.

2. A liquid crystal display device of claim 1, wherein said first signal line drive circuit is selected and the signal line drive voltage is applied to one end of each signal line, and said first and second scanning line drive circuits are both selected and the scanning line drive voltage is applied to both ends of each scanning line.

3. A liquid crystal display device of claim 1, wherein said plural signal lines are divided into upper signal lines and lower signal lines in the vertical direction, said first and second signal line drive circuits are both selected, and the voltage from said first signal drive circuit is applied to one end of said upper signal lines and the voltage from said second signal drive circuit is applied to one end of said lower signal lines, and said first and second scanning line drive circuits are both selected and the scanning line drive voltage is applied to both ends of each scanning line.

4. A liquid crystal display device of claim 1, wherein said first and second signal line drive circuits are both selected and the signal line drive voltage is applied to both ends of each signal line, and said first scanning line drive circuit is selected and the scanning line drive voltage is applied to one end of each scanning line.

5. A liquid crystal display device of claim 1, wherein said first and second signal line drive circuits are both selected and the signal line drive voltage is applied to both ends of each signal line, and said first and second scanning line drive circuits are both selected and the scanning line drive voltage is applied to both ends of each scanning line.

6. A liquid crystal display device of claim 1, wherein each of said plural scanning lines is divided into right scanning line and left scanning line, said first signal line drive circuit is selected and the signal line drive voltage is applied to one end of each signal line, and said first and second scanning line drive circuits are both selected and the voltage from said first scanning line drive circuit is applied to one end of said right scanning line and the voltage from said second scanning line drive circuit is applied to one end of said left scanning line.

7. A liquid crystal display device of claim 1, wherein each of said plural scanning lines is divided into right scanning line and left scanning line, said first and second signal line drive circuits are both selected and the signal line drive voltage is applied to both ends of each signal line, and said first and second scanning line drive circuits are both selected and the voltage from said first scanning line drive circuit is applied to one end of said right scanning line and the voltage from said second scanning line drive circuit is applied to one end of said left scanning line.

8. A liquid crystal display device of claim 1, wherein each of said plural signal lines is divided into upper signal line and lower signal line in the vertical direction, and said each scanning line is divided into right scanning line and left scanning line in horizontal direction, said first and second signal line drive circuits are both selected and the voltage from said first signal line drive circuit is applied to one end of said upper signal line and the voltage from said second signal line drive circuit is applied to one end of said lower signal line, and said first and second scanning line drive circuits are both selected and the voltage from said first scanning line drive circuit is applied to one end of said right scanning line and the voltage from said second scanning line drive circuit is applied to one end of said left scanning line.

9. A liquid crystal display device of any one of claims 1, 2 and 6, wherein said first signal line drive circuit is selected and said first and second scanning line drive circuits are both selected, said liquid crystal panel being driven by said first and second scanning line drive circuits and said first signal line drive circuit such that regarding each scanning line to be M/2 stages of ladder form distributed rc circuit, with the equivalent circuit of each scanning line as seen from the first and second scanning line drive circuits to be an RC series circuit composed of resistance R of $M \cdot c/\pi$ and capacitance C of $M \cdot c/\pi$, and regarding each signal line to be 2N stages of ladder form distributed rscs circuit, with the equivalent circuit of signal line as seen from said first signal line drive circuit to be an RC series circuit composed of resistance R of $4N \cdot rs/\pi$ and capacitance C of $4N \cdot cs/\pi$, where the number of scanning lines in the horizontal direction of the liquid crystal panel is denoted by 2N, the number of signal lines in the vertical direction by M, the wiring resistance per pixel of said scanning lines by r, the pixel capacitance per pixel of the scanning lines including the liquid crystal cell by c, the wiring resistance per pixel of said signal lines by rs, and the pixel capacitance per pixel of the signal lines including said liquid crystal cell by cs.

10. A liquid crystal display device of any one of claims 1, 3, 5, 7 and 8, wherein said first and second signal line drive circuits are both selected and said first and second scanning line drive circuits are both selected, and, said liquid crystal panel being driven by said first and second scanning line drive circuits and said first and second signal line drive circuits such that regarding each scanning line of 2N scanning lines to be M/2 stages of ladder form distributed rc circuit, with the equivalent circuit of scanning lines as seen from said first and second scanning line drive circuits to be an RC series circuit composed of resistance R of $M \cdot r/\pi$ and capacitance C of $M \cdot c/\pi$, and regarding each one of said signal lines to be N stages of ladder form distributed rscs circuit, with the equivalent circuit of scanning lines as seen from said first and second signal line drive circuits to be an RC series circuit composed of resistance R of $2N \cdot rs/\pi$ and capacitance C of $2N \cdot cs/\pi$, where the number of scanning lines in the horizontal direction of the liquid crystal panel is denoted by 2N, the number of signal lines in the vertical direction by M, the wiring resistance per pixel of said scanning lines by r, the pixel capacitance per pixel of the scanning lines including the liquid crystal cell by c, the wiring resistance per pixel of said signal lines by rs, and the pixel capacitance per pixel of said signal lines including said liquid crystal cell by cs.

11. A liquid crystal display device of claim 1 or 4, wherein, said first and second signal line drive circuits are both selected and said first scanning line drive circuit is selected, said liquid crystal panel being driven by said scanning line drive circuit and said first and second signal line drive circuit such that, regarding said scanning lines to be M stages of ladder form distributed rc circuit, with the equivalent circuit of scanning lines as seen from said scanning line drive circuits to be an RC series circuit composed of resistance R of $2M \cdot r/\pi$ and capacitance C of $2M \cdot c/\pi$, and regarding said signal lines to be N stages of ladder form distributed rscs circuit, with the equivalent circuit of said signal lines as seen from said first and second signal line drive circuits to be an RC series circuit composed of resistance R of $2N \cdot rs/\pi$ and capacitance C of $2N \cdot cs/\pi$, where the number of scanning lines in the horizontal direction of the liquid crystal panel is denoted by 2N, the number of signal lines in the vertical direction by M, the wiring resistance per pixel of said scanning lines by r, the pixel capacitance per pixel of the scanning lines including the liquid crystal cell by c, the wiring resistance per pixel of signal lines by rs, and the pixel capacitance per pixel of the signal lines including said liquid crystal cell by cs.

12. A liquid crystal display device of claim 1, wherein each of said plural signal lines is divided into upper signal line and lower signal line in vertical direction, said first and second signal line drive circuits are both selected and the voltage from said first signal line drive circuit is applied to one end of said upper signal line and the voltage from said second signal line drive circuit is applied to one end of said lower signal line, said first scanning line drive circuit is selected and the scanning line drive voltage is applied to one end of said each scanning line, said liquid crystal panel being driven by said first scanning line drive circuit and said first and second signal line drive circuits such that, regarding said scanning lines to be M stages of ladder form distributed rc circuit, with the equivalent circuit of scanning lines as seen from said first scanning line drive circuits to be an RC series circuit composed of resistance R of $2M \cdot r/\pi$ and capacitance C of $2M \cdot c/\pi$, and regarding said signal lines as seen from said first and second signal line drive circuits to be N stages of ladder form distributed circuit with the equivalent circuit of the signal lines to be an RC series circuit composed of resistance R of $2N \cdot rs/\pi$ and capacitance C of $2N \cdot cs/\pi$, where the number of said scanning lines in the horizontal direction of the liquid crystal panel is denoted by 2N, the number of said signal lines in the vertical direction by M, the wiring resistance per pixel of said scanning lines by r, the pixel capacitance per pixel of the scanning lines including said liquid crystal cell by c, the wiring resistance per pixel of said signal lines by rs, and the pixel capacitance per pixel of the signal lines including said liquid crystal cell by cs.

13. A liquid crystal display device of any one of claims 1, 2, 3 and 5–8, wherein, said first and second scanning line drive circuits are both selected and the output resistance Rgw of said first and second scanning line drive circuits satisfies either $$Rgw \leqq \{1-(\gamma 1)^2\} \cdot \{\pi \cdot TH/(1.5M \cdot c)\} \cdot \{(a^2+N-1)/(a^2)\} - M \cdot r/(2\pi)$$

or $$Rgw \leqq -\pi \cdot Tdpw/(M \cdot c \cdot \ln \beta w) M \cdot r/\pi$$

where $$\beta w = (Vpthw - Vgon + Vref)/(VgoffVgon),$$

where the number of said scanning lines in the horizontal direction of said liquid crystal panel is denoted by 2N, the number of said signal lines in the vertical direction by M, the wiring resistance per pixel of said scanning lines by r, the pixel capacitance per pixel of the scanning line including said liquid crystal cell by c, the horizontal scanning time by TH, the ratio of effective voltage of pixel at terminal end of said scanning lines to effective voltage of pixel at drive end of said scanning lines by $\gamma 1$, the ON voltage of the liquid crystal panel at drive end of scanning lines by Vgon, the OFF voltage of the liquid crystal panel by Vgoff, the delay time of the liquid crystal panel by Tdpw, the operation reference voltage by Vref, the threshold voltage of the liquid crystal panel by Vpthw, and the ratio of amplitude of scanning line driving voltage to amplitude of signal line driving voltage by a.

14. A liquid crystal display device of claims 1 or 4 wherein, said first scanning line drive circuit is selected and the output resistance Rgs of said scanning line drive circuits satisfies either $$Rgs \leqq \{1-(\gamma 1)^2\} \cdot \{\pi \cdot TH/(3M \cdot c)\} \cdot \{(a^2+N-1)/(a^2)\} - 2M \cdot r/(2\pi)$$

or $$Rgs \leqq -\pi \cdot Tdps/(2M \cdot c \cdot \ln \beta s) - 2M \cdot r/\pi$$

where $$\beta s=(Vpths-Vgon+Vref)/(Vgoff-Vgon),$$

where the number of said scanning lines in the horizontal direction of said liquid crystal panel is denoted by 2N, the number of said signal lines by M, the wiring resistance per pixel of said scanning lines by r, the pixel capacitance per pixel of the scanning lines including said liquid crystal cell by c, the horizontal scanning time by TH, the ratio of effective voltage of pixel at terminal end of said scanning lines to effective voltage of pixel at drive end of said scanning lines by γ2, the ON voltage of the liquid crystal panel at drive end of scanning lines by Vgon, the OFF voltage of the liquid crystal panel by Vgoff, the delay time of the liquid crystal panel by Tdps, the operation reference voltage by Vref, the threshold voltage of the liquid crystal panel by Vpths, and the ratio of amplitude of scanning line driving voltage to amplitude of signal line driving voltage by a.

15. A liquid crystal display device of any one of claims 1, 3, 4, 5, 7 and 8, wherein, said first and second signal line drive circuits are both selected and the output resistance Rsw of said first and second signal line drive circuits satisfies either $$Rsw \leqq \{1-(\gamma 1s)^2\}\cdot\{\cdot TH/(4N\cdot cs)\}\cdot\{(a^2+N-1)/N\}-2\cdot rs/\pi$$

or $$Rsw \leqq -2N\cdot rs/\pi-\pi\cdot TH/[2N\cdot cs\cdot 1n\{(1-\gamma 1s)/2\}],$$

where the number of said scanning lines in the horizontal direction of said liquid crystal panel is denoted by 2N, the number of said signal lines in the vertical direction by M, the ratio of effective voltage of pixel at terminal end of the signal lines to effective voltage of pixel at drive end by γ1s, the wiring resistance per pixel of the signal lines by rs, the pixel capacitance by cs, the horizontal scanning time by TH, and the ratio of amplitude of scanning line driving voltage to amplitude of signal line driving voltage by a.

16. A liquid crystal display device of any one of claims 1, 2 and 6, wherein, said first signal line drive circuit is selected and the output resistance Rss of said signal line drive circuit satisfies either $$Rss \leqq \{1-(\gamma 2s)^2\}\cdot\{\pi\cdot TH/(8N\cdot cs)\}\cdot\{(a^2+N-1)/N\}-4N\cdot rs/\pi$$

$$Rss \leqq -4N\cdot rs/\pi-\pi\cdot TH/\{4N\cdot cs\cdot 1n\{(1-\gamma 2s/2\},$$

where the number of said scanning lines in the horizontal direction of said liquid crystal panel is denoted by 2N, the number of said signal lines in the vertical direction by M, the ratio of effective voltage of pixel at terminal end of the signal lines to effective voltage of pixel at drive end by γ2s, the wiring resistance per pixel of the signal lines by rs, the pixel capacitance by cs, the horizontal scanning time by TH, and the ratio of amplitude of scanning line driving voltage to amplitude of signal line driving voltage by a.

17. A liquid crystal display device of any one of claims 1, 2, 3 and 5–8, wherein, said first and second scanning line drive circuits are both selected and apply V(+) and V(−) alternately in every vertical scanning time to the selected scanning line, and apply the operation reference voltage Vref to the non-selected scanning lines, and at the same time said signal lines are fed with VL when said V(+) is applied to said scanning lines or fed with VH when said V(−) is applied to said scanning lines, the individual scanning line driving current of said first and second scanning line drive circuits satisfies $$2N\cdot M\cdot c(V(+)-VL)/(\pi\cdot TV) \text{ when } V(+) \text{ is applied,}$$

or $$2N\cdot M\cdot c(V(-)-VH)/(\pi\cdot TV) \text{ when } V(-) \text{ is applied,}$$

where the number of said scanning lines in the horizontal direction of said liquid crystal cell is denoted by 2N, the number of said signal lines in the vertical direction by M, the wiring resistance per pixel of said scanning lines by r, the pixel capacitance per pixel of the scanning lines including said liquid crystal cell by c, the horizontal scanning time by TH, and the vertical scanning time TV by 2N·TH.

18. A liquid crystal display device of claim 1 or 4, wherein, said first scanning line drive circuit is selected and applies V(+) and V(−) alternately in every vertical scanning time to the selected scanning line, applies the operation reference voltage Vref to the non-selected scanning lines, and at the same time said signal lines are fed with VL when said V(+) is applied to said scanning lines or fed with VH when said V(−) is applied to said scanning lines, the scanning line driving current of said scanning line drive circuit satisfies $$4N\cdot M\cdot c(V(+)-VL)/(\pi\cdot TV) \text{ when } V(+) \text{ is applied,}$$

or $$4N\cdot M\cdot c(V(-)-VH)/(\pi\cdot TV) \text{ when } V(-) \text{ is applied,}$$

where the number of said scanning lines in the horizontal direction of said liquid crystal cell is denoted by 2N, the number of said signal lines in the vertical direction by M, the wiring resistance per pixel of said scanning lines by r, the pixel capacitance per pixel of the scanning lines including said liquid crystal cell by c, the horizontal scanning time by TH, the vertical scanning time TV by 2N·TH.

19. A liquid crystal display device of any one of claims 1–2, 3 and 5–8, wherein, said first and second scanning line drive circuits are both selected and apply, as scanning line drive voltage, Vgon followed by Vg(+) and Vg(−) alternately in every vertical scanning time to the selected scanning line, and apply Vgoff to the non-selected scanning lines, the individual scanning line driving current of said first and second scanning line drive circuits satisfies $$2N\cdot M\cdot c(Vgon-Vgoff)/(\pi\cdot TV) \text{ when } Vgon \text{ is applied,}$$

$$N\cdot M\cdot c(Vg(+)-Vgoff)/(\pi\cdot TV) \text{ when } Vg(+) \text{ is applied,}$$

or $$N\cdot M\cdot c(Vg(-)-Vgoff)/(\pi\cdot TV) \text{ when } Vg(-) \text{ is applied,}$$

where the number of said scanning lines in the horizontal direction of said liquid crystal cell is denoted by 2N, the number of said signal lines in the vertical. direction by M, the wiring resistance per pixel of said scanning lines by r, the pixel capacitance per pixel of the scanning lines including said liquid crystal cell by c, the horizontal scanning time by TH, and the vertical scanning time TV by 2N·TH.

20. A liquid crystal display device of claim 1 or 4 wherein, said first scanning line drive circuit is selected and applies, as scanning line driving voltage, Vgon followed by Vg(+) and Vg(−) alternately in every vertical scanning time to the selected scanning line, and to apply Vgoff to the non-selected scanning lines, the scanning line driving current of said first scanning line drive circuit is $$4N\cdot M\cdot c(Vgon-Vgoff)/(\pi\cdot TV) \text{ when } Vgon \text{ is applied,}$$

$$2N\cdot M\cdot c(Vg(+)-Vgoff)/(\pi\cdot TV) \text{ when } Vg(+) \text{ is applied,}$$

or $$2N\cdot M\cdot c(Vg(-)-Vgoff)/(\pi\cdot TV) \text{ when } Vg(-) \text{ is applied,}$$

where the number of said scanning lines in the horizontal direction of said liquid crystal cell is denoted by 2N, the number of said signal lines in the vertical direction by M, the wiring resistance per pixel of said scanning lines by r, the pixel capacitance per pixel of the scanning lines including said liquid crystal cell by c, the horizontal scanning time by TH, and the vertical scanning time TV by 2N·TH.

21. A liquid crystal display device of any one of claims 1, 3, 4, 5, 7 and 8, wherein, said first and second signal line drive circuits are both selected and apply, as signal line driving voltages, VH and VL alternately in every horizontal scanning time of said first scanning pulse to the signal lines, the individual signal line driving current of said first and second signal line drive circuits satisfies $$8(VH-Vref\mathbf{1})N^2\cdot M\cdot cs/(\pi\cdot TV) \text{ when } VH \text{ is applied,}$$

or $$8(VL-Vref\mathbf{2})N^2\cdot M\cdot cs/(\pi\cdot TV) \text{ when } VL \text{ is applied,}$$

where the number of said scanning lines in the horizontal direction of said liquid crystal cell is denoted by 2N, the number of said signal lines in the vertical direction by M, the wiring resistance per pixel of said signal lines by rs, the pixel capacitance per pixel of the signal lines including said liquid crystal cell by cs, the horizontal scanning time by TH, the vertical scanning time TV by 2N·TH, the operation reference voltage corresponding to VH by Vref1, and the operation reference voltage corresponding to VL by Vref2.

22. A liquid crystal display device of any one of claims 1, 2 and 6, wherein, said first signal line drive circuit is selected and applies, as signal line driving voltages, VH and VL alternately in every horizontal scanning time, the signal line driving current of said first signal line drive circuit is $$16(VH-Vref\mathbf{1})N^2\cdot M\cdot cs/(\pi\cdot TV) \text{ when } VH \text{ is applied,}$$

or $$16(VL-Vref\mathbf{2})N^2\cdot M\cdot cs/(\pi\cdot TV) \text{ when } VL \text{ is applied,}$$

where the number of said scanning lines in the horizontal direction of said liquid crystal cell is denoted by 2N, the number of said signal lines in the vertical direction by M, the wiring resistance per pixel of said signal lines by rs, the pixel capacitance per pixel of the signal lines including said liquid crystal cell by Cs, the horizontal scanning time by TH, the vertical scanning time TV by 2N·TH, the operation reference voltage corresponding to VH by Vref1, and the operation reference voltage corresponding to VL by Vref2.

23. A liquid crystal display device of any one of claims 1–2, wherein the liquid crystal panel comprises one of drive terminals at both ends of each scanning line, and a drive circuit outside of the image display region of the liquid crystal panel.

24. A liquid crystal display device of any one of claims 1–8, wherein the liquid crystal panel comprises one of drive terminals at both ends of each signal line, and a drive circuit outside of the image display region of the liquid crystal panel.

25. A liquid crystal display device of any one of claims 1–8, wherein the liquid crystal panel comprises one of drive terminals at both ends of each scanning line and each signal line, and a drive circuit outside of the image display region of the liquid crystal panel.

26. A driving method of liquid crystal display device for driving a liquid crystal panel having plural signal lines and plural scanning lines disposed in a matrix, and disposing pixels at intersections of said signal lines and scanning lines, where the optical state of the liquid crystal cells of said pixels is changed by applying a voltage to said scanning lines and signal lines corresponding to said pixels, said liquid crystal display device comprising:

at least one signal line drive circuit selected from first and second signal line drive circuits for applying a signal line drive voltage in every horizontal scanning time to one end and to the other end, respectively, of said signal line, at least one scanning line drive circuit selected from first and second scanning line drive circuits for applying a scanning line drive voltage to one end and to the other end, respectively, of said scanning line to be activated at the horizontal scanning, a control circuit for instructing generation of said signal line drive voltage from said selected signal line drive circuit in synchronism with said scanning line drive voltage applied by said selected scanning line drive circuit, on the basis of an input image signal, said method comprising:

at least either said signal or said scanning lines are driven by both end drive scheme, that is, said first and second drive circuits are both selected, the scanning line drive voltage is changed from Vgn to Vgn+1 at time t=0, the operation reference voltage at this time is Vref, the operation reference voltage when the signal line drive voltage is VH is Vref1 and the operation reference voltage when the signal line drive voltage is VL is Vref2, the signal line drive voltage Vs(y, t) applied to the pixel at a terminal end, which is a position on said signal line intersecting with the y-th scanning line from the drive end of said signal line, is given if the signal line voltage is changing to VII at t0, as $$Vs(y, t) = (VHV - ref1)\,[1 - 2\exp\{\pi^2 \cdot t/$$

-continued $$(4rs \cdot cs \cdot y^2 + 2\pi \cdot cs \cdot y \cdot Rs)\}]$$

or if the signal line voltage is changing to VL at t=0, as $$Vs(y, t) = (VL - Vref2)\,[1 - 2\exp\{-\pi^2 \cdot t/(4rs \cdot cs \cdot y^2 + 2\pi \cdot cs \cdot y \cdot Rs)\}]$$

and the scanning line drive voltage Vg(x, t) applied to the pixel at a terminal end, which is a position on said scanning line intersecting with the x-th signal line from the drive end of said scanning line, is given as $$Vg(x, t) = (Vgn - V_{gn+1})\exp\{-\pi^2 \cdot t/(4r \cdot c \cdot x^2 + 2\pi \cdot c \cdot x \cdot Rg)\}] + V_{gn+1} - Vref,$$

where the number of said scanning lines in the horizontal direction of said liquid crystal cell is denoted by 2N, the number of said signal lines in the vertical direction by M, the pixel capacitance per pixel of the signal lines including said liquid crystal cell by cs, the output resistance of said signal line drive circuit by Rs, the wiring resistance per pixel of said scanning lines by r, the pixel capacitance per pixel of the scanning lines including said liquid crystal cell by c, and the output resistance of said scanning line drive circuits by Rg.

27. A driving method of liquid crystal display device of claim 26, wherein, said first signal line drive circuit is selected, said first and second scanning line drive circuits are both selected and, said Rs is replaced by the output resistance of said first signal line drive circuit Rss, y is set to be 2N, and said Rg is replaced by the output resistance of said first and second scanning line drive circuit Rgw, x is set to be M/2.

28. A driving method of liquid crystal display device of claim 26, wherein, each of said plural signal lines is divided into upper and lower signal lines, said first and second signal line drive circuits are both selected, said first and second scanning line drive circuits are both selected and, said Rs is replaced by the output resistance of said first and second signal line drive circuit Rsw, y is set to be N, and said Rg is replaced by the output resistance of said first and second scanning line drive circuit Rgw, x is set to be M/2.

29. A driving method of liquid crystal display device of claim 26, wherein, said first and second signal line drive circuits are both selected, said first scanning line drive circuit is selected and, said Rs is replaced by the output resistance of said first and second signal line drive circuit Rsw, y is set to be N, and said Rg is replaced by the output resistance of said first scanning line drive circuit Rgs, x is set to be M.

30. A driving method of liquid crystal display device of claim 26, wherein, said first and second signal line drive circuits are both selected, said first and second scanning line drive circuits are both selected and, said Rs is replaced by the output resistance of said first and second signal line drive circuit Rsw, y is set to be N, and said Rg is replaced by the output resistance of said first and second scanning line drive circuit Rgw, x is set to be M/2.

31. A driving method of liquid crystal display device of claim 26, wherein, each of said plural scanning lines is divided into right and left scanning lines, said first signal line drive circuit is selected, said first and second scanning line drive circuits are both selected and, said Rs is replaced by the output resistance of said first signal line drive circuit Rss, y is set to be 2N, and said Rg is replaced by the output resistance of said first and second scanning line drive circuit Rgw, x is set to be M/2.

32. A driving method of liquid crystal display device of claim 26, wherein, each of said plural scanning lines is divided into right and left scanning lines, said first and second signal line drive circuits are both selected, said first and second scanning line drive circuits are both selected and, said Rs is replaced by the output resistance of said first and second signal line drive circuit Rsw, y is set to be N, and said Rg is replaced by the output resistance of said first and second scanning line drive circuit Rgw, x is set to be M/2.

33. A driving method of liquid crystal display device of claim 26, wherein, each of said plural scanning lines is divided into right and left scanning lines, each of said plural signal lines is divided into upper and lower signal lines, said first and second signal line drive circuits are both selected, said first and second scanning line drive circuits are both selected and, said Rs is replaced by the output resistance of said first and second signal line drive circuit Rsw, y is set to be N, and said Rg is replaced by the output resistance of said first and second scanning line drive circuit Rg is set to be Rgw, x is set to be M/2.

34. A driving method of liquid crystal display device of any one of claims 26, 27, 28 and 30–33, wherein said first and second scanning line drive circuits are both selected and said x is set to M/2, the ratio γgw(x) of effective voltage of pixels at terminal end x-th apart from the drive end of said scanning line to effective voltage of pixel at drive end of said scanning line is given as:

$$\gamma gw(x) = [1 - 1.5(4r \cdot c \cdot x^2 + 2\pi \cdot c \cdot x \cdot Rgw)/(\pi^2 \cdot TH) \cdot (a^2/(a^2 + N1)\}]^{\left(\frac{1}{2}\right)},$$

where the wiring resistance per pixel of said scanning line is denoted by r, the pixel capacitance per pixel of scanning line including said liquid crystal cell by c, the horizontal scanning time by TB, the output resistance of said first and second scanning line drive circuits by Rgw, and the ratio of amplitude of scanning line driving voltage to amplitude of signal line driving voltage by a.

35. A driving method of liquid crystal display device of claim 26 or 29, wherein said first scanning line drive circuit is selected and said x is set to M, the ratio γgs(x) of effective voltage of pixel at terminal end x-th apart from the drive end of said scanning line to effective voltage of pixel at drive end of said scanning line is given as:

$$\gamma gs(x) = [1 - 1.5(4r \cdot c \cdot x^2 + 2\pi \cdot c \cdot x \cdot Rgs)/(\pi^2 \cdot TH) \cdot (a^2/(a^2 + NI))]^{(\frac{1}{2})},$$

where the wiring resistance per pixel of said scanning line is denoted by r, the pixel capacitance per pixel of scanning line including said liquid crystal cell by c, the horizontal scanning time by TB, the output resistance of said first scanning line drive circuit by Rgs, and the ratio of amplitude of scanning line driving voltage to amplitude of signal line driving voltage by a.

36. A driving method of liquid crystal display device of any one of claims 26, 28, 29, 30 and 32, wherein said first and second signal line drive circuits are both selected and said y is set to N, the ratio γsw(y) of effective voltage of pixel at terminal end y-th apart from the drive end of said signal line to effective voltage of pixel at drive end of said signal line is given by either $$\gamma sw(y) = [1 - 2(4rs \cdot cs \cdot y^2 + 2\pi \cdot cs \cdot y \cdot Rsw)/(\pi^2 \cdot TH) \cdot (N/(a^2 + NI))]^{(\frac{1}{2})}$$

or $$\gamma sw(y) = [1 - 2\exp(\pi^2 \cdot TH/(4y^2 \cdot rs \cdot cs + 2\pi \cdot y \cdot cs \cdot Rsw)\}],$$

where the wiring resistance per pixel of said signal line is denoted by rs, the pixel capacitance per pixel of signal line including said liquid crystal cell by cs, the horizontal scanning time by TH, the output resistance of said first and second signal line drive circuits by Rsw, and the ratio of amplitude of scanning line driving voltage to amplitude of signal line driving voltage to be a.

37. A driving method of liquid crystal display device of any one of claims 26, 27 and 31, wherein said first signal line drive circuit is selected and y is set to 2N, the ratio γss(y) of effective voltage of pixel at terminal end y-th apart from the drive end of said signal line to effective voltage of pixel at drive end of said signal line is given by either $$\gamma ss(y) = [1 - 2(4rs \cdot cs \cdot y^2 + 2\pi \cdot cs \cdot y \cdot Rss)/(\pi^2 \cdot TH) \cdot (N/(a^2 + NI))]^{(\frac{1}{2})}$$

-continued or $$\gamma ss(y) = [1 - 2\exp(\pi^2 \cdot TH/(4y^2 \cdot rs \cdot cs + 2\pi \cdot y \cdot cs \cdot Rss)\}],$$

where the wiring resistance per pixel of said signal line is denoted by rs, the pixel capacitance per pixel of signal line including said liquid crystal cell by cs, the horizontal scanning time by TH, the output resistance of said signal line drive circuit by Rss, and the ratio of amplitude of scanning line driving voltage to amplitude of signal line driving voltage by a.

38. A driving method of liquid crystal display device of any one of claims 26, 27, 28 and 30–33, wherein said liquid crystal panel is TFT liquid crystal panel, said first and second scanning line drive circuits are both selected and said scanning line drive voltage at the drive end of said scanning lines is changed over from OFF voltage Vgoff to ON voltage Vgon at time t=0, with the operation reference voltage Vref at this time, and the threshold voltage Vpthw of the TFT at a terminal end, which is a position on said scanning line x-th apart from the drive end of said scanning line of the TFT liquid crystal, is given as:

$$Vpthw = (Vgoff - Vgon)\exp\{-\pi^2 \cdot Tdpw/(4 \cdot x^2 \cdot r \cdot c + 2\pi \cdot x \cdot c \cdot Rgw)\} + Vgon - Vref,$$

where x=M/2 and the delay time of the liquid crystal panel is denoted by Tdpw, the wiring resistance per pixel of said scanning lines by r, the pixel capacitance per pixel of said scanning lines including said liquid crystal cell by c, and the output resistance of said first and second scanning line drive circuits by Rgw.

39. A driving method of liquid crystal display device of claim 26 or 29, wherein said liquid crystal panel is TFT liquid crystal panel, said first scanning line drive circuit is selected and said scanning line drive voltage at the drive end of said scanning lines is changed over from OFF voltage Vgoff to ON voltage Vgon at time t=0 with the operation reference voltage Vref at this time, and the threshold voltage Vpths of the TFT at the terminal end, which is a position on said scanning line x-th apart from the drive end of said scanning line of the TFT liquid crystal is given as:

$$Vpths = (Vgoff - Vgon)\exp\{-\pi^2 \cdot Tdps/(4x^2 \cdot r \cdot c + 2\pi \cdot x \cdot c \cdot Rgs)\} + Vgon - Vref$$

where x=M and the delay time of the liquid crystal panel is denoted by Tdps, the wiring resistance per pixel of said scanning lines by r, the pixel capacitance per pixel of said scanning lines including said liquid crystal cell by c, and the output resistance of said scanning line drive circuit by Rgs.

* * * * *